US008038548B2

(12) United States Patent
Felker et al.

(10) Patent No.: US 8,038,548 B2
(45) **Date of Patent: *Oct. 18, 2011**

(54) LOW LIFT GOLF BALL

(75) Inventors: David L. Felker, Escondido, CA (US); Douglas C. Winfield, Madison, AL (US); Rocky Lee, Philadelphia, PA (US)

(73) Assignee: Aero-X Golf, Inc., Escondido, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/877,071

(22) Filed: Sep. 7, 2010

(65) Prior Publication Data

US 2010/0323822 A1 Dec. 23, 2010

Related U.S. Application Data

(63) Continuation of application No. 12/765,802, filed on Apr. 22, 2010, which is a continuation of application No. 12/757,964, filed on Apr. 9, 2010.

(60) Provisional application No. 61/168,134, filed on Apr. 9, 2009.

(51) Int. Cl.
*A63B 37/12* (2006.01)

(52) U.S. Cl. ..... 473/380; 473/384

(58) Field of Classification Search ..... 473/378–384
See application file for complete search history.

(56) References Cited

U.S. PATENT DOCUMENTS 4,063,259 A 12/1977 Lynch et al.
4,762,326 A 8/1988 Gobush
4,979,747 A 12/1990 Jonkouski
4,991,852 A 2/1991 Pattison
5,078,402 A 1/1992 Oka
5,518,246 A 5/1996 Moriyama et al.
5,564,708 A 10/1996 Hwang
5,782,702 A 7/1998 Yamagishi et al.
5,836,832 A 11/1998 Boehm et al.

(Continued)

FOREIGN PATENT DOCUMENTS

JP 2000042138 A 2/2000

(Continued)

OTHER PUBLICATIONS

International Search Report and Written Opinion for PCT/US2010/030637 mailed Nov. 9, 2010 (8 pages).

(Continued)

*Primary Examiner* — Raeann Trimiew
(74) *Attorney, Agent, or Firm* — Procopio Cory Hargreaves & Savitch LLP; Noel C. Gillespie

(57) ABSTRACT

A golf ball having a plurality of dimples formed on its outer surface, the outer surface of the golf ball being divided into plural areas comprising at least first areas containing a plurality of first dimples and second areas containing a plurality of second dimples, the areas together forming a spherical polyhedron shape, the first dimples comprising truncated spherical dimples having a first, truncated chord depth and the second dimples comprising spherical dimples having a second, spherical chord depth, the first dimples are of larger radius than the second dimples and have a truncated chord depth which is less than the spherical chord depth of the first dimples, and the total surface area of all first areas being less than the total surface area of all second areas.

20 Claims, 28 Drawing Sheets

U.S. PATENT DOCUMENTS

| | | | |
|---|---|---|---|
| 5,846,141 | A | 12/1998 | Morgan et al. |
| 5,863,264 | A | 1/1999 | Yamagishi et al. |
| 5,935,023 | A | 8/1999 | Maehara et al. |
| 5,957,786 | A | 9/1999 | Aoyama |
| 5,997,418 | A | 12/1999 | Tavares et al. |
| 6,045,461 | A | 4/2000 | Yamagishi et al. |
| 6,053,820 | A | 4/2000 | Kasashima et al. |
| 6,213,898 | B1 | 4/2001 | Ogg |
| 6,224,499 | B1 | 5/2001 | Ogg |
| 6,241,627 | B1 | 6/2001 | Kasashima et al. |
| 6,290,615 | B1 | 9/2001 | Ogg |
| 6,299,552 | B1 | 10/2001 | Morgan et al. |
| 6,450,902 | B1 | 9/2002 | Hwang |
| 6,464,601 | B2 | 10/2002 | Ogg |
| 6,503,158 | B2 | 1/2003 | Murphy et al. |
| 6,537,159 | B2 | 3/2003 | Ogg |
| 6,551,203 | B2 | 4/2003 | Ogg |
| 6,602,153 | B2 | 8/2003 | Ogg |
| 6,652,341 | B2 | 11/2003 | Ogg |
| 6,658,371 | B2 | 12/2003 | Boehm et al. |
| 6,729,976 | B2 | 5/2004 | Bissonnette et al. |
| 6,796,912 | B2 | 9/2004 | Dalton et al. |
| 6,814,677 | B2 | 11/2004 | Ogg |
| 6,923,736 | B2 | 8/2005 | Aoyama et al. |
| 6,939,252 | B1 | 9/2005 | Stanczak et al. |
| 6,939,253 | B2 | 9/2005 | Ogg |
| 6,945,880 | B2 | 9/2005 | Aoyama et al. |
| 6,991,564 | B2 | 1/2006 | Sajima |
| 7,156,757 | B2 | 1/2007 | Bissonnette et al. |
| 7,175,542 | B2 | 2/2007 | Watanabe et al. |
| 7,226,369 | B2 | 6/2007 | Aoyama et al. |
| 7,229,364 | B2 | 6/2007 | Aoyama |
| 7,238,121 | B2 | 7/2007 | Watanabe et al. |
| 7,357,732 | B2 | 4/2008 | Watanabe et al. |
| 7,476,163 | B2 | 1/2009 | Kasashima |
| 7,481,723 | B2 | 1/2009 | Sullivan et al. |
| 7,491,137 | B2 | 2/2009 | Bissonnette et al. |
| 7,503,856 | B2 | 3/2009 | Nardacci et al. |
| 7,594,867 | B2 | 9/2009 | Nardacci |
| 7,604,553 | B2 | 10/2009 | Shinohara |
| 2001/0036873 | A1 | 11/2001 | Ogg |
| 2002/0016227 | A1 | 2/2002 | Emerson et al. |
| 2002/0016228 | A1 | 2/2002 | Emerson et al. |
| 2002/0068649 | A1 | 6/2002 | Kennedy et al. |
| 2003/0158002 | A1 | 8/2003 | Morgan et al. |
| 2003/0190968 | A1 | 10/2003 | Kasashima |
| 2004/0106467 | A1 | 6/2004 | Ogg |
| 2004/0152541 | A1 | 8/2004 | Sajima |
| 2004/0157682 | A1 | 8/2004 | Morgan et al. |
| 2004/0254033 | A1 | 12/2004 | Ogg et al. |
| 2005/0064958 | A1 | 3/2005 | Sullivan et al. |
| 2005/0079931 | A1 | 4/2005 | Aoyama et al. |
| 2006/0019772 | A1 | 1/2006 | Sullivan et al. |
| 2006/0199667 | A1 | 9/2006 | Jones |
| 2006/0264271 | A1 | 11/2006 | Veilleux et al. |
| 2007/0010342 | A1 | 1/2007 | Sato et al. |
| 2007/0049423 | A1 | 3/2007 | Nardacci |
| 2007/0167257 | A1 | 7/2007 | Sullivan et al. |
| 2007/0219020 | A1 | 9/2007 | Sullivan et al. |
| 2008/0220907 | A1 | 9/2008 | Aoyama et al. |
| 2009/0247325 | A1 | 10/2009 | Sullivan et al. |
| 2010/0125005 | A1 | 5/2010 | Umezawa |
| 2010/0261551 | A1* | 10/2010 | Felker et al. ..... 473/372 |
| 2010/0267491 | A1* | 10/2010 | Felker et al. ..... 473/384 |
| 2010/0273579 | A1* | 10/2010 | Felker et al. ..... 473/384 |

FOREIGN PATENT DOCUMENTS

| | | | |
|---|---|---|---|
| KR | 100138895 | B1 | 7/1998 |
| KR | 100669808 | B1 | 1/2007 |
| KR | 100774432 | B1 | 11/2007 |

OTHER PUBLICATIONS

International Search Report and Written Opinion for PCT/US2010/030638 mailed Dec. 14, 2010 (8 pages).
International Search Report and Written Opinion for PCT/US2010/030646 mailed Nov. 30, 2010 (13 pages).
International Search Report and Written Opinion for PCT/US2010/030643 mailed Nov. 9, 2010 (9 pages).
International Search Report and Written Opinion for PCT/US2010/030648 mailed Nov. 9, 2010 (8 pages).
International Search Report and Written Opinion for PCT/US2010/030641 mailed Nov. 9, 2010 (12 pages).
International Search Report and Written Opinion for PCT/US2010/030640 mailed Nov. 9, 2010 (8 pages).
International Search Report and Written Opinion for PCT/US2010/030645 mailed Nov. 9, 2010 (8 pages).
International Search Report and Written Opinion for PCT/US2010/030639 mailed Apr. 15, 2011 (16 pages).

* cited by examiner $d_1$ = truncated dimple chord depth $d_2$ = spherical dimple chord depth.

LOW LIFT GOLF BALL

RELATED APPLICATIONS INFORMATION

This application claims the benefit as a Continuation under 35 U.S.C. §120 of copending patent application Ser. No. 12/765,802 filed Apr. 22, 2010 and entitled "A Low Lift Golf Ball," which in turn claims the benefit as a Continuation under 35 U.S.C. §120 of copending patent application Ser. No. 12/757,964 filed Apr. 9, 2010 and entitled "A Low Lift Golf Ball," which in turn claims the benefit under §119(e) of U.S. Provisional Application Ser. No. 61/168,134 filed Apr. 9, 2009 and entitled "Golf Ball With Improved Flight Characteristics," all of which are incorporated herein by reference in their entirety as if set forth in full.

BACKGROUND

1. Technical Field

The embodiments described herein are related to the field of golf balls and, more particularly, to a spherically symmetrical golf ball having a dimple pattern that generates low-lift in order to control dispersion of the golf ball during flight.

2. Related Art

The flight path of a golf ball is determined by many factors. Several of the factors can be controlled to some extent by the golfer, such as the ball's velocity, launch angle, spin rate, and spin axis. Other factors are controlled by the design of the ball, including the ball's weight, size, materials of construction, and aerodynamic properties.

The aerodynamic force acting on a golf ball during flight can be broken down into three separate force vectors: Lift, Drag, and Gravity. The lift force vector acts in the direction determined by the cross product of the spin vector and the velocity vector. The drag force vector acts in the direction opposite of the velocity vector. More specifically, the aerodynamic properties of a golf ball are characterized by its lift and drag coefficients as a function of the Reynolds Number (Re) and the Dimensionless Spin Parameter (DSP). The Reynolds Number is a dimensionless quantity that quantifies the ratio of the inertial to viscous forces acting on the golf ball as it flies through the air. The Dimensionless Spin Parameter is the ratio of the golf ball's rotational surface speed to its speed through the air.

Since the 1990's, in order to achieve greater distances, a lot of golf ball development has been directed toward developing golf balls that exhibit improved distance through lower drag under conditions that would apply to, e.g., a driver shot immediately after club impact as well as relatively high lift under conditions that would apply to the latter portion of, e.g., a driver shot as the ball is descending towards the ground. A lot of this development was enabled by new measurement devices that could more accurately and efficiently measure golf ball spin, launch angle, and velocity immediately after club impact.

Today the lift and drag coefficients of a golf ball can be measured using several different methods including an Indoor Test Range such as the one at the USGA Test Center in Far Hills, N.J., or an outdoor system such as the Trackman Net System made by Interactive Sports Group in Denmark. The testing, measurements, and reporting of lift and drag coefficients for conventional golf balls has generally focused on the golf ball spin and velocity conditions for a well hit straight driver shot—approximately 3,000 rpm or less and an initial ball velocity that results from a driver club head velocity of approximately 80-100 mph.

For right-handed golfers, particularly higher handicap golfers, a major problem is the tendency to "slice" the ball. The unintended slice shot penalizes the golfer in two ways: 1) it causes the ball to deviate to the right of the intended flight path and 2) it can reduce the overall shot distance.

A sliced golf ball moves to the right because the ball's spin axis is tilted to the right. The lift force by definition is orthogonal to the spin axis and thus for a sliced golf ball the lift force is pointed to the right.

The spin-axis of a golf ball is the axis about which the ball spins and is usually orthogonal to the direction that the golf ball takes in flight. If a golf ball's spin axis is 0 degrees, i.e., a horizontal spin axis causing pure backspin, the ball will not hook or slice and a higher lift force combined with a 0-degree spin axis will only make the ball fly higher. However, when a ball is hit in such a way as to impart a spin axis that is more than 0 degrees, it hooks, and it slices with a spin axis that is less than 0 degrees. It is the tilt of the spin axis that directs the lift force in the left or right direction, causing the ball to hook or slice. The distance the ball unintentionally flies to the right or left is called Carry Dispersion. A lower flying golf ball, i.e., having a lower lift, is a strong indicator of a ball that will have lower Carry Dispersion.

The amount of lift force directed in the hook or slice direction is equal to: Lift Force*Sine (spin axis angle). The amount of lift force directed towards achieving height is: Lift Force*Cosine (spin axis angle).

A common cause of a sliced shot is the striking of the ball with an open clubface. In this case, the opening of the clubface also increases the effective loft of the club and thus increases the total spin of the ball. With all other factors held constant, a higher ball spin rate will in general produce a higher lift force and this is why a slice shot will often have a higher trajectory than a straight or hook shot.

Table 1 shows the total ball spin rates generated by a golfer with club head speeds ranging from approximately 85-105 mph using a 10.5 degree driver and hitting a variety of prototype golf balls and commercially available golf balls that are considered to be low and normal spin golf balls:

TABLE 1

| Spin Axis, degree | Typical Total Spin, rpm | Type Shot |
|---|---|---|
| −30 | 2,500-5,000 | Strong Slice |
| −15 | 1,700-5,000 | Slice |
| 0 | 1,400-2,800 | Straight |
| +15 | 1,200-2,500 | Hook |
| +30 | 1,000-1,800 | Strong Hook |

If the club path at the point of impact is "outside-in" and the clubface is square to the target, a slice shot will still result, but the total spin rate will be generally lower than a slice shot hit with the open clubface. In general, the total ball spin will increase as the club head velocity increases.

In order to overcome the drawbacks of a slice, some golf ball manufacturers have modified how they construct a golf ball, mostly in ways that tend to lower the ball's spin rate. Some of these modifications include: 1) using a hard cover material on a two-piece golf ball, 2) constructing multi-piece balls with hard boundary layers and relatively soft thin covers in order to lower driver spin rate and preserve high spin rates on short irons, 3) moving more weight towards the outer layers of the golf ball thereby increasing the moment of inertia of the golf ball, and 4) using a cover that is constructed or treated in such a ways so as to have a more slippery surface.

Others have tried to overcome the drawbacks of a slice shot by creating golf balls where the weight is distributed inside the ball in such a way as to create a preferred axis of rotation.

Still others have resorted to creating asymmetric dimple patterns in order to affect the flight of the golf ball and reduce the drawbacks of a slice shot. One such example was the Polara™ golf ball with its dimple pattern that was designed with different type dimples in the polar and equatorial regions of the ball.

In reaction to the introduction of the Polara golf ball, which was intentionally manufactured with an asymmetric dimple pattern, the USGA created the "Symmetry Rule". As a result, all golf balls not conforming to the USGA Symmetry Rule are judged to be non-conforming to the USGA Rules of Golf and are thus not allowed to be used in USGA sanctioned golf competitions.

These golf balls with asymmetric dimples patterns or with manipulated weight distributions may be effective in reducing dispersion caused by a slice shot, but they also have their limitations, most notably the fact that they do not conform with the USGA Rules of Golf and that these balls must be oriented a certain way prior to club impact in order to display their maximum effectiveness.

The method of using a hard cover material or hard boundary layer material or slippery cover will reduce to a small extent the dispersion caused by a slice shot, but often does so at the expense of other desirable properties such as the ball spin rate off of short irons or the higher cost required to produce a multi-piece ball.

SUMMARY

A low lift golf ball is described herein.

According to one aspect, a golf ball having a plurality of dimples formed on its outer surface, the outer surface of the golf ball being divided into plural areas comprising at least first areas containing a plurality of first dimples and second areas containing a plurality of second dimples, the areas together forming a spherical polyhedron shape, the first dimples comprising truncated spherical dimples having a first, truncated chord depth and the second dimples comprising spherical dimples having a second, spherical chord depth, the first dimples are of larger radius than the second dimples and have a truncated chord depth which is less than the spherical chord depth of the first dimples, and the total surface area of all first areas being less than the total surface area of all second areas.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

Figure 1:
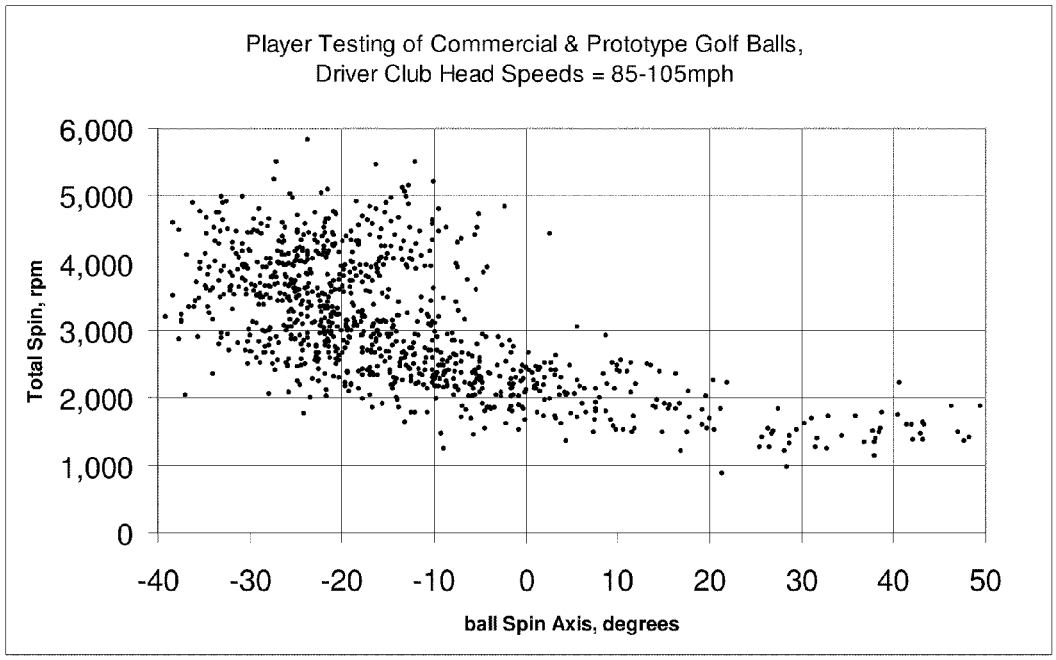
FIG. 1 is a graph of the total spin rate versus the ball spin axis for various commercial and prototype golf balls hit with a driver at club head speed between 85-105 mph.

The embodiments described herein may be understood more readily by reference to the following detailed description. However, the techniques, systems, and operating structures described can be embodied in a wide variety of forms and modes, some of which may be quite different from those in the disclosed embodiments. Consequently, the specific structural and functional details disclosed herein are merely representative. It must be noted that, as used in the specification and the appended claims, the singular forms "a", "an", and "the" include plural referents unless the context clearly indicates otherwise.

The embodiments described below are directed to the design of a golf ball that achieves low lift right after impact when the velocity and spin are relatively high. In particular, the embodiments described below achieve relatively low lift even when the spin rate is high, such as that imparted when a golfer slices the golf ball, e.g., 3500 rpm or higher. In the embodiments described below, the lift coefficient after impact can be as low as about 0.18 or less, and even less than 0.15 under such circumstances. In addition, the lift can be significantly lower than conventional golf balls at the end of flight, i.e., when the speed and spin are lower. For example, the lift coefficient can be less than 0.20 when the ball is nearing the end of flight.

As noted above, conventional golf balls have been designed for low initial drag and high lift toward the end of flight in order to increase distance. For example, U.S. Pat. No. 6,224,499 to Ogg teaches and claims a lift coefficient greater than 0.18 at a Reynolds number (Re) of 70,000 and a spin of 2000 rpm, and a drag coefficient less than 0.232 at a Re of 180,000 and a spin of 3000 rpm. One of skill in the art will understand that and Re of 70,000 and spin of 2000 rpm are industry standard parameters for describing the end of flight. Similarly, one of skill in the art will understand that a Re of greater than about 160,000, e.g., about 180,000, and a spin of 3000 rpm are industry standard parameters for describing the beginning of flight for a straight shot with only back spin.

The lift (CL) and drag coefficients (CD) vary by golf ball design and are generally a function of the velocity and spin rate of the golf ball. For a spherically symmetrical golf ball the lift and drag coefficients are for the most part independent of the golf ball orientation. The maximum height a golf ball achieves during flight is directly related to the lift force generated by the spinning golf ball while the direction that the golf ball takes, specifically how straight a golf ball flies, is related to several factors, some of which include spin rate and spin axis orientation of the golf ball in relation to the golf ball's direction of flight. Further, the spin rate and spin axis are important in specifying the direction and magnitude of the lift force vector.

The lift force vector is a major factor in controlling the golf ball flight path in the x, y, and z directions. Additionally, the total lift force a golf ball generates during flight depends on several factors, including spin rate, velocity of the ball relative to the surrounding air and the surface characteristics of the golf ball.

For a straight shot, the spin axis is orthogonal to the direction the ball is traveling and the ball rotates with perfect backspin. In this situation, the spin axis is 0 degrees. But if the ball is not struck perfectly, then the spin axis will be either positive (hook) or negative (slice). FIG. 1 is a graph illustrating the total spin rate versus the spin axis for various commercial and prototype golf balls hit with a driver at club head speed between 85-105 mph. As can be seen, when the spin axis is negative, indicating a slice, the spin rate of the ball increases. Similarly, when the spin axis is positive, the spin rate decreases initially but then remains essentially constant with increasing spin axis.

The increased spin imparted when the ball is sliced, increases the lift coefficient (CL). This increases the lift force in a direction that is orthogonal to the spin axis. In other words, when the ball is sliced, the resulting increased spin produces an increased lift force that acts to "pull" the ball to the right. The more negative the spin axis, the greater the portion of the lift force acting to the right, and the greater the slice.

Thus, in order to reduce this slice effect, the ball must be designed to generate a relatively lower lift force at the greater spin rates generated when the ball is sliced.

Figure 2:
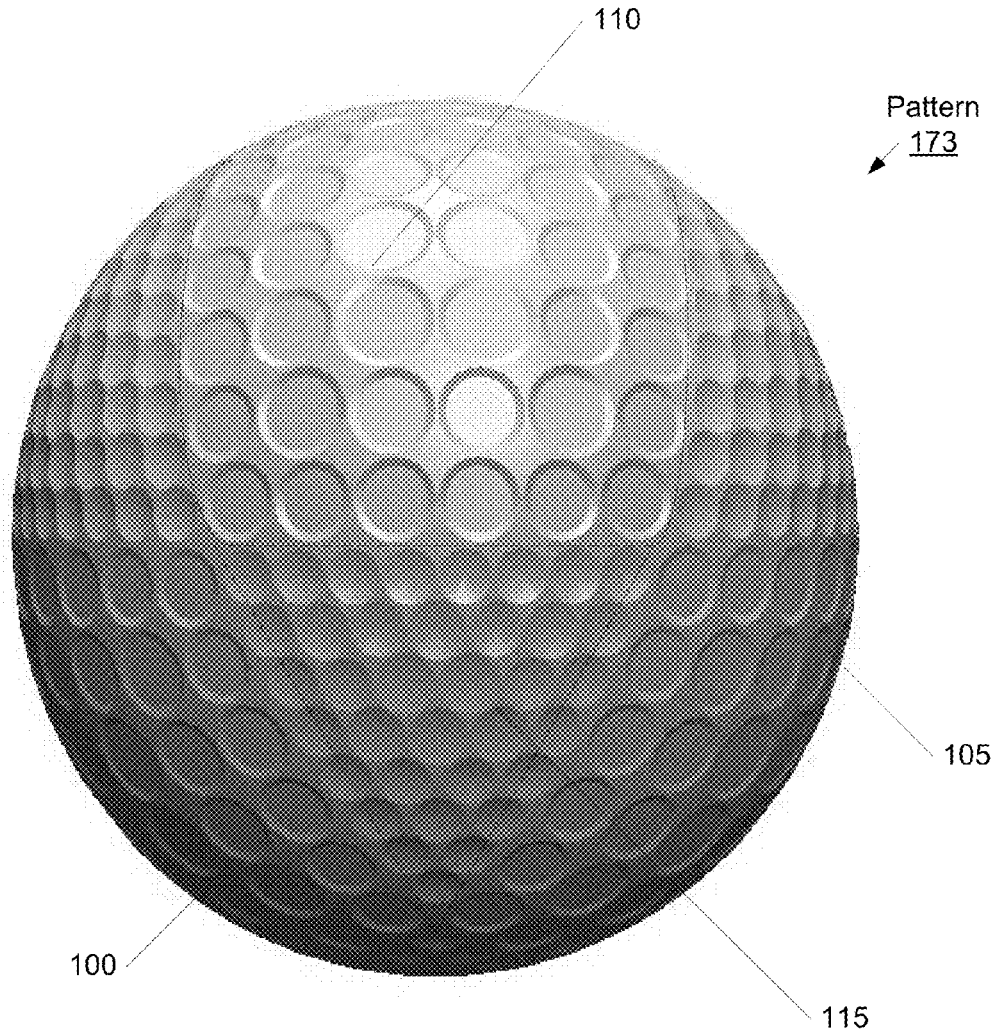
FIG. 2 is a picture of golf ball with a dimple pattern in accordance with one embodiment.

Referring to FIG. 2, there is shown golf ball 100, which provides a visual description of one embodiment of a dimple pattern that achieves such low initial lift at high spin rates. FIG. 2 is a computer generated picture of dimple pattern 173. As shown in FIG. 2, golf ball 100 has an outer surface 105, which has a plurality of dissimilar dimple types arranged in a cuboctahedron configuration. In the example of FIG. 2, golf ball 100 has larger truncated dimples within square region 110 and smaller spherical dimples within triangular region 115 on the outer surface 105. The example of FIG. 2 and other embodiments are described in more detail below; however, as will be explained, in operation, dimple patterns configured in accordance with the embodiments described herein disturb the airflow in such a way as to provide a golf ball that exhibits low lift at the spin rates commonly seen with a slice shot as described above.

As can be seen, regions 110 and 115 stand out on the surface of ball 100 unlike conventional golf balls. This is because the dimples in each region are configured such that they have high visual contrast. This is achieved for example by including visually contrasting dimples in each area. For example, in one embodiment, flat, truncated dimples are included in region 110 while deeper, round or spherical dimples are included in region 115. Additionally, the radius of the dimples can also be different adding to the contrast.

But this contrast in dimples does not just produce a visually contrasting appearance; it also contributes to each region having a different aerodynamic effect. Thereby, disturbing air flow in such a manner as to produce low lift as described herein.

While conventional golf balls are often designed to achieve maximum distance by having low drag at high speed and high lift at low speed, when conventional golf balls are tested, including those claimed to be "straighter," it can be seen that these balls had quite significant increases in lift coefficients (CL) at the spin rates normally associated with slice shots. Whereas balls configured in accordance with the embodiments described herein exhibit lower lift coefficients at the higher spin rates and thus do not slice as much.

Figure 5:
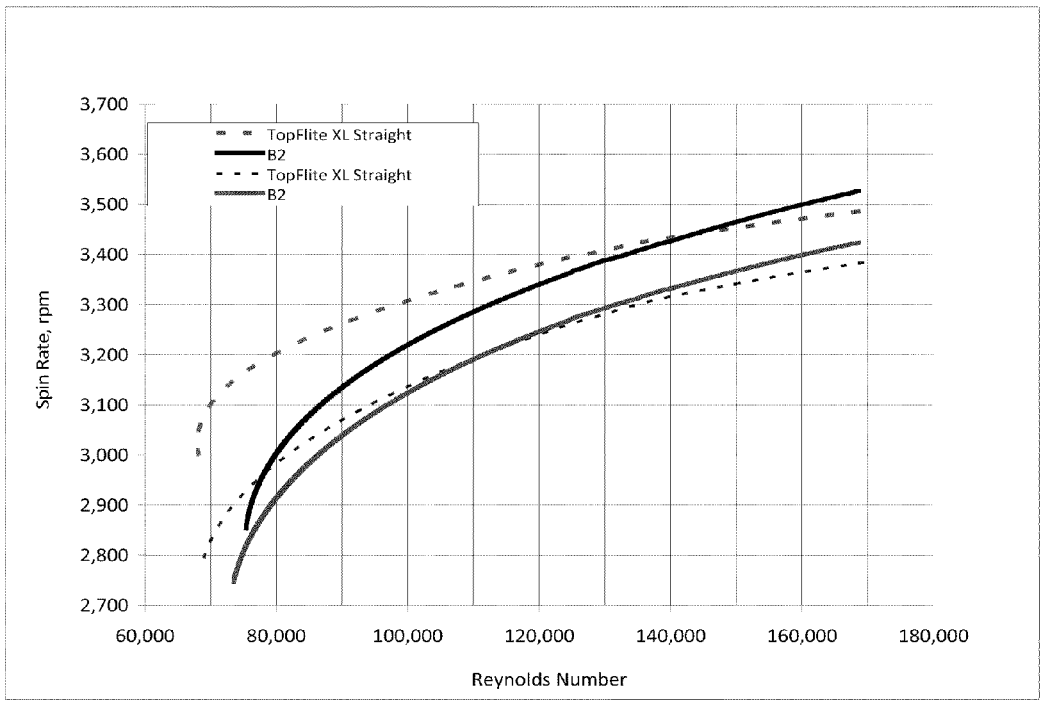
FIG. 5 is a graph of the total spin rate and Reynolds number for the TopFlite XL Straight golf ball and a B2 prototype ball, configured in accordance with one embodiment, hit with a driver club using a Golf Labs robot.

A ball configured in accordance with the embodiments described herein and referred to as the B2 Prototype, which is a 2-piece Surlyn-covered golf ball with a polybutadiene rubber based core and dimple pattern "273", and the TopFlite® XL Straight ball were hit with a Golf Labs robot using the same setup conditions so that the initial spin rates were about 3,400-3,500 rpm at a Reynolds Number of about 170,000. The spin rate and Re conditions near the end of the trajectory were about 2,900 to 3,200 rpm at a Reynolds Number of about 80,000. The spin rates and ball trajectories were obtained using a 3-radar unit Trackman Net System. FIG. 5 illustrates the full trajectory spin rate versus Reynolds Number for the shots and balls described above.

Figure 4:
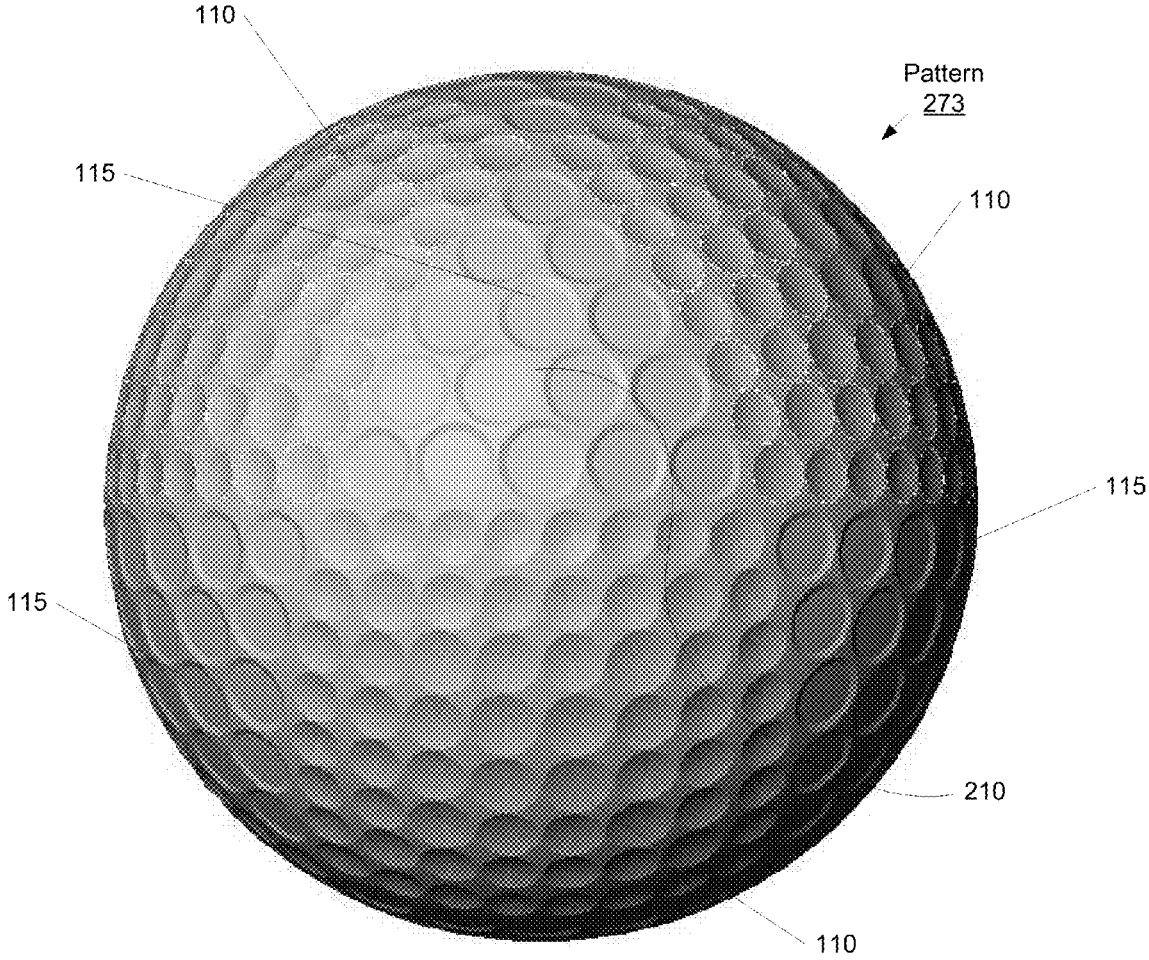
FIG. 4 is a schematic diagram showing the triangular polar region of another embodiment of the golf ball with a cuboctahedron pattern of FIG. 3.

The B2 prototype ball had dimple pattern design 273, shown in FIG. 4. Dimple pattern design 273 is based on a cuboctahedron layout and has a total of 504 dimples. This is the inverse of pattern 173 since it has larger truncated dimples within triangular regions 115 and smaller spherical dimples within square regions or areas 110 on the outer surface of the ball. A spherical truncated dimple is a dimple which has a spherical side wall and a flat inner end, as seen in the triangular regions of FIG. 4. The dimple patterns 173 and 273, and alternatives, are described in more detail below with reference to Tables 5 to 11.

Figure 6:
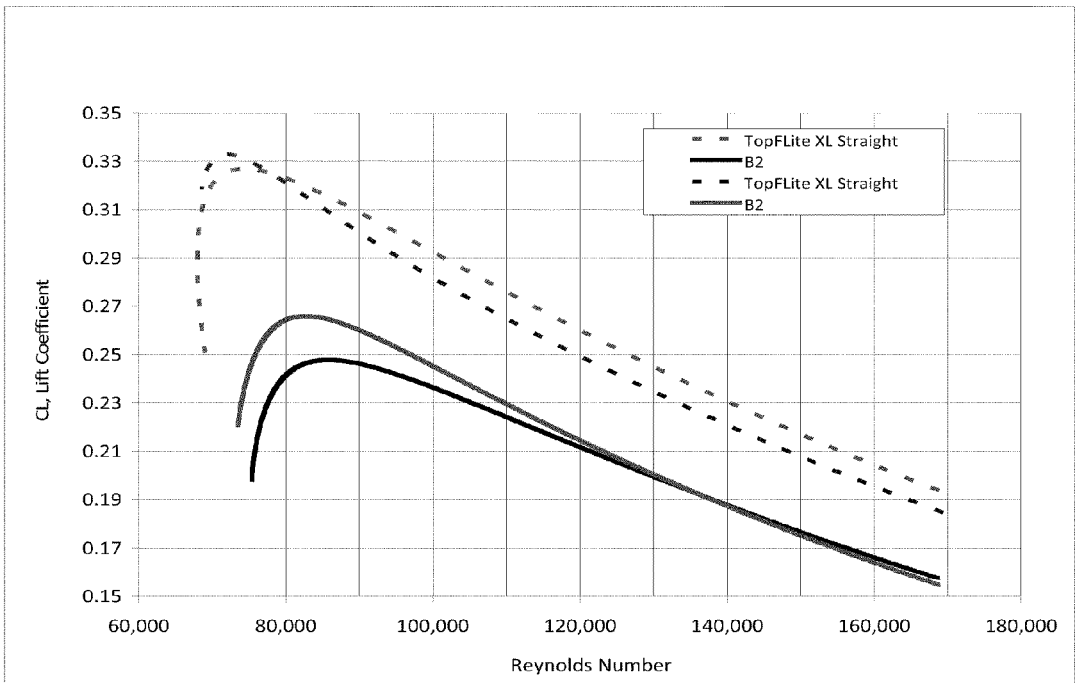
FIG. 6 is a graph or the Lift Coefficient versus Reynolds Number for the golf ball shots shown in FIG. 5.

FIG. 6 illustrates the CL versus Re for the same shots shown in FIG. 5; TopFlite® XL Straight and the B2 prototype golf ball which was configured in accordance with the systems and methods described herein. As can be seen, the B2 ball has a lower CL over the range of Re from about 75,000 to 170,000. Specifically, the CL for the B2 prototype never exceeds 0.27, whereas the CL for the TopFlite® XL Straight gets well above 0.27. Further, at a Re of about 165,000, the CL for the B2 prototype is about 0.16, whereas it is about 0.19 or above for the TopFlite® XL Straight.

FIGS. 5 and 6 together illustrate that the B2 ball with dimple pattern 273 exhibits significantly less lift force at spin rates that are associated with slices. As a result, the B2 prototype will be much straighter, i.e., will exhibit a much lower carry dispersion.

For example, a ball configured in accordance with the embodiments described herein can have a CL of less than about 0.22 at a spin rate of 3,200-3,500 rpm and over a range of Re from about 120,000 to 180,000. For example, in certain embodiments, the CL can be less than 0.18 at 3500 rpm for Re values above about 155,000.

This is illustrated in the graphs of FIGS. 20-24, which show the lift coefficient versus Reynolds Number at spin rates of 3,000 rpm, 3,500 rpm, 4,000 rpm, 4,500 rpm and 5,000 rpm, respectively, for the TopFlite® XL Straight, Pro V1, 173 dimple pattern, and 273 dimple pattern. To obtain the regression data shown in FIGS. 23 -28, a Trackman Net System consisting of 3 radar units was used to track the trajectory of a golf ball that was struck by a Golf Labs robot equipped with various golf clubs. The robot was setup to hit a straight shot with various combinations of initial spin and velocity. A wind gauge was used to measure the wind speed at approximately 20 ft elevation near the robot location. The Trackman Net System measured trajectory data (x, y, z location vs. time) were then used to calculate the lift coefficients (CL) and drag coefficients (CD) as a function of measured time-dependent quantities including Reynolds Number, Ball Spin Rate, and Dimensionless Spin Parameter. Each golf ball model or design was tested under a range of velocity and spin conditions that included 3,000-5,000 rpm spin rate and 120,000-180,000 Reynolds Number. It will be understood that the Reynolds Number range of 150,000-180,000 covers the initial ball velocities typical for most recreational golfers, who have club head speeds of 85-100 mph. A 5-term multivariable regression model was then created from the data for each ball designed in accordance with the embodiments described herein for the lift and drag coefficients as a function of Reynolds Number (Re) and Dimensionless Spin Parameter (W), i.e., as a function of Re, W, Re^2, W^2, ReW, etc. Typically the predicted CD and CL values within the measured Re and W space (interpolation) were in close agreement with the measured CD and CL values. Correlation coefficients of >96% were typical.

Under typical slice conditions, with spin rates of 3,500 rpm or greater, the 173 and 273 dimple patterns exhibit lower lift coefficients than the other golf balls. Lower lift coefficients translate into lower trajectory for straight shots and less dispersion for slice shots. Balls with dimple patterns 173 and 273 have approximately 10% lower lift coefficients than the other golf balls under Re and spin conditions characteristics of slice shots. Robot tests show the lower lift coefficients result in at least 10% less dispersion for slice shots.

For example, referring again to FIG. 6, it can be seen that while the TopFlite® XL Straight is suppose to be a straighter ball, the data in the graph of FIG. 6 illustrates that the B2 prototype ball should in fact be much straighter based on its lower lift coefficient. The high CL for the TopFlite® XL Straight means that the TopFlite® XL Straight ball will create a larger lift force. When the spin axis is negative, this larger lift force will cause the TopFlite® XL Straight to go farther right increasing the dispersion for the TopFlite® XL Straight. This is illustrated in Table 2:

TABLE 2

| Ball | Dispersion, ft | Distance, yds |
|---|---|---|
| TopFlite ® XL Straight | 95.4 | 217.4 |
| Ball 173 | 78.1 | 204.4 |

Figure 7:
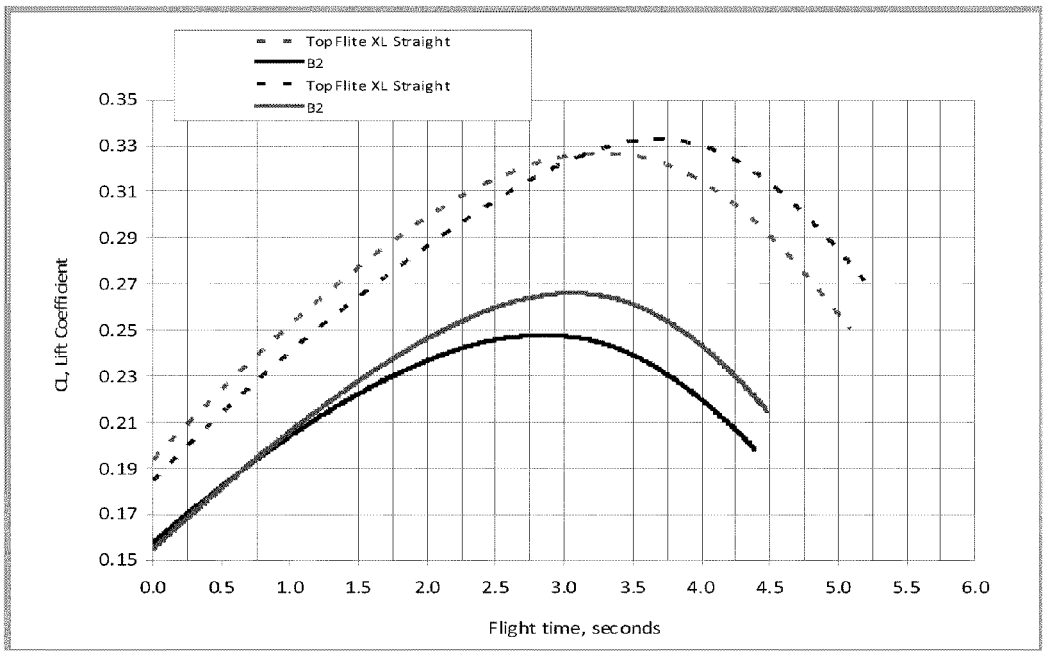
FIG. 7 is a graph of Lift Coefficient versus flight time for the golf ball shots shown in FIG. 5.

FIG. 7 shows that for the robot test shots shown in FIG. 5 the B2 ball has a lower CL throughout the flight time as compared to other conventional golf balls, such as the TopFlite® XL Straight. This lower CL throughout the flight of the ball translates in to a lower lift force exerted throughout the flight of the ball and thus a lower dispersion for a slice shot.

Figure 8:
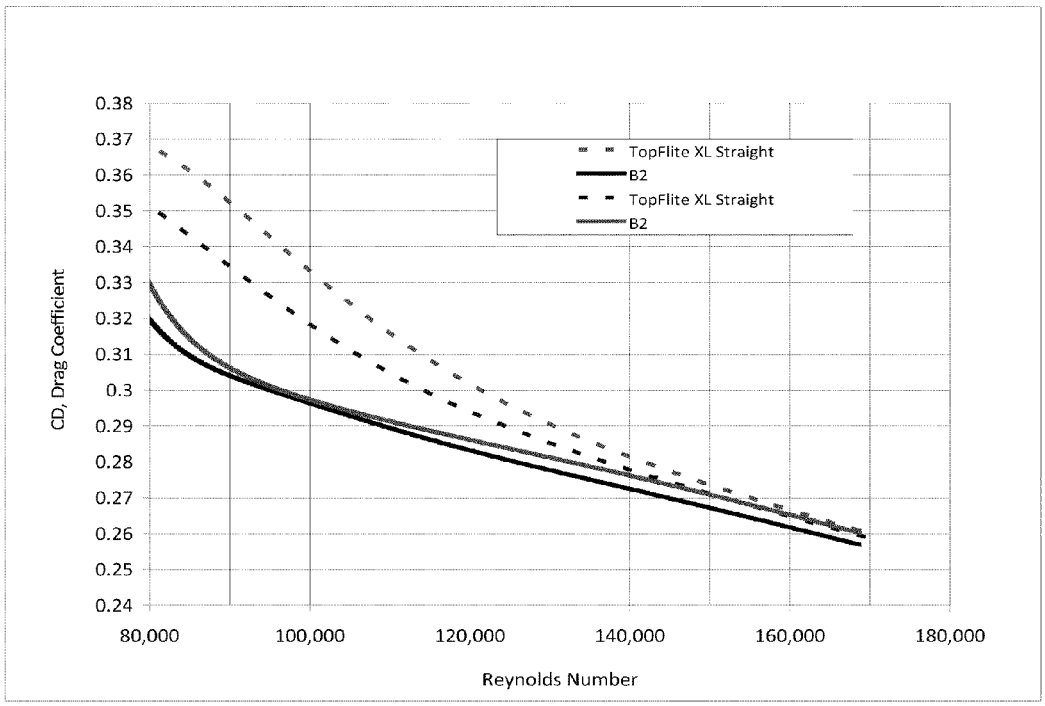
FIG. 8 is a graph of the Drag Coefficient versus Reynolds Number for the golf ball shots shown in FIG. 5.

As noted above, conventional golf ball design attempts to increase distance, by decreasing drag immediately after impact. FIG. 8 shows the drag coefficient (CD) versus Re for the B2 and TopFlite® XL Straight shots shown in FIG. 5. As can be seen, the CD for the B2 ball is about the same as that for the TopFlite® XL Straight at higher Re. Again, these higher Re numbers would occur near impact. At lower Re, the CD for the B2 ball is significantly less than that of the TopFlite® XL Straight.

Figure 9:
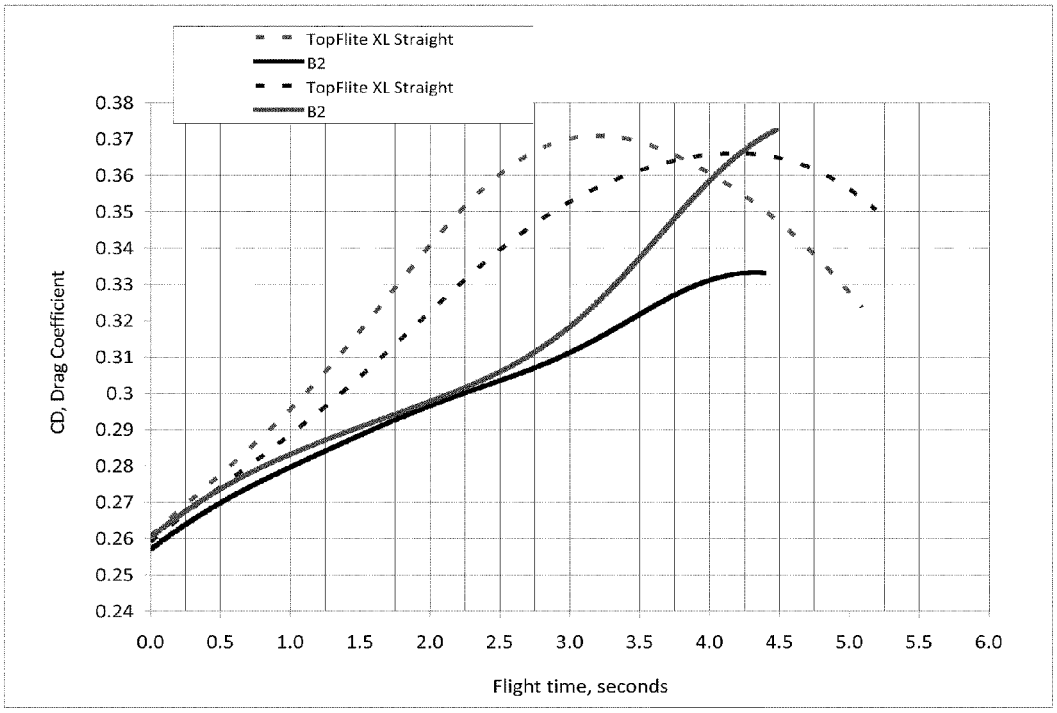
FIG. 9 is a graph of the Drag Coefficient versus flight time for the golf ball shots shown in FIG. 5.

In FIG. 9 it can be seen that the CD curve for the B2 ball throughout the flight time actually has a negative inflection in the middle. Thus, the drag for the B2 ball will be less in the middle of the ball's flight as compared to the TopFlite XL Straight. It should also be noted that while the B2 does not carry quite as far as the TopFlite XL Straight, testing reveals that it actually roles farther and therefore the overall distance is comparable under many conditions. This makes sense of course because the lower CL for the B2 ball means that the B2 ball generates less lift and therefore does not fly as high, something that is also verified in testing. Because the B2 ball does not fly as high, it impacts the ground at a shallower angle, which results in increased role.

Returning to FIGS. 2-4, the outer surface 105 of golf ball 100 can include dimple patterns of Archimedean solids or Platonic solids by subdividing the outer surface 105 into patterns based on a truncated tetrahedron, truncated cube, truncated octahedron, truncated dodecahedron, truncated icosahedron, icosidodecahedron, rhombicuboctahedron, rhombicosidodecahedron, rhombitruncated cuboctahedron, rhombitruncated icosidodecahedron, snub cube, snub dodecahedron, cube, dodecahedron, icosahedrons, octahedron, tetrahedron, where each has at least two types of subdivided regions (A and B) and each type of region has its own dimple pattern and types of dimples that are different than those in the other type region or regions.

Furthermore, the different regions and dimple patterns within each region are arranged such that the golf ball 100 is spherically symmetrical as defined by the United States Golf Association ("USGA") Symmetry Rules. It should be appreciated that golf ball 100 may be formed in any conventional manner such as, in one non-limiting example, to include two pieces having an inner core and an outer cover. In other non-limiting examples, the golf ball 100 may be formed of three, four or more pieces.

Tables 3 and 4 below list some examples of possible spherical polyhedron shapes which may be used for golf ball 100, including the cuboctahedron shape illustrated in FIGS. 2-4. The size and arrangement of dimples in different regions in the other examples in Tables 3 and 4 can be similar or identical to that of FIG. 2 or 4.

TABLE 3

13 Archimedean Solids and 5 Platonic solids - relative surface areas for the polygonal patches

| Name of Archimedean solid | # of Region A | Region A shape | % surface area for all of the Region A's | # of Region B | Region B shape | % surface area for all of the Region B's | # of Region C |
|---|---|---|---|---|---|---|---|
| truncated icosidodeca-hedron | 30 | triangles | 17% | 20 | Hexagons | 30% | 12 |
| Rhombicos idodeca-hedron | 20 | triangles | 15% | 30 | squares | 51% | 12 |
| snub dodeca-hedron | 80 | triangles | 63% | 12 | Pentagons | 37% | |
| truncated icosahedron | 12 | pentagons | 28% | 20 | Hexagons | 72% | |
| truncated cubocta-hedron | 12 | squares | 19% | 8 | Hexagons | 34% | 6 |
| Rhombicub-octahedron | 8 | triangles | 16% | 18 | squares | 84% | |
| snub cube | 32 | triangles | 70% | 6 | squares | 30% | |
| Icosado-decahedron | 20 | triangles | 30% | 12 | Pentagons | 70% | |
| truncated dodeca-hedron | 20 | triangles | 9% | 12 | Decagons | 91% | |
| truncated octahedron | 6 | squares | 22% | 8 | Hexagons | 78% | |
| Cubocta-hedron | 8 | triangles | 37% | 6 | squares | 63% | |
| truncated cube | 8 | triangles | 11% | 6 | Octagons | 89% | |
| truncated tetrahedron | 4 | triangles | 14% | 4 | Hexagons | 86% | |

| Name of Archimedean solid | Region C shape | % surface area for all of the Region C's | Total number of Regions | % surface area per single A Region | % surface area per single B Region | % surface area per single C Region |
|---|---|---|---|---|---|---|
| truncated icosidodeca-hedron | decagons | 53% | 62 | 0.6% | 1.5% | 4.4% |
| Rhombicos idodeca-hedron | pentagons | 35% | 62 | 0.7% | 1.7% | 2.9% |
| snub dodeca-hedron | | | 92 | 0.8% | 3.1% | |
| truncated icosahedron | | | 32 | 2.4% | 3.6% | |
| truncated cubocta-hedron | octagons | 47% | 26 | 1.6% | 4.2% | 7.8% |
| Rhombicub-octahedron | | | 26 | 2.0% | 4.7% | |
| snub cube | | | 38 | 2.2% | 5.0% | |
| Icosado-decahedron | | | 32 | 1.5% | 5.9% | |
| truncated dodeca-hedron | | | 32 | 0.4% | 7.6% | |
| truncated octahedron | | | 14 | 3.7% | 9.7% | |

TABLE 3-continued

| 13 Archimedean Solids and 5 Platonic solids - relative surface areas for the polygonal patches | | | |
|---|---|---|---|
| Cubocta-hedron | 14 | 4.6% | 10.6% |
| truncated cube | 14 | 1.3% | 14.9% |
| truncated tetrahedron | 8 | 3.6% | 21.4% |

TABLE 4

| Name of Platonic Solid | # of Regions | Shape of Regions | | Surface area per Region |
|---|---|---|---|---|
| Tetrahedral Sphere | 4 | triangle | 100% | 25% |
| Octahedral Sphere | 8 | triangle | 100% | 13% |
| Hexahedral Sphere | 6 | squares | 100% | 17% |
| Icosahedral Sphere | 20 | triangles | 100% | 5% |
| Dodecahadral Sphere | 12 | pentagons | 100% | 8% |

Figure 3:
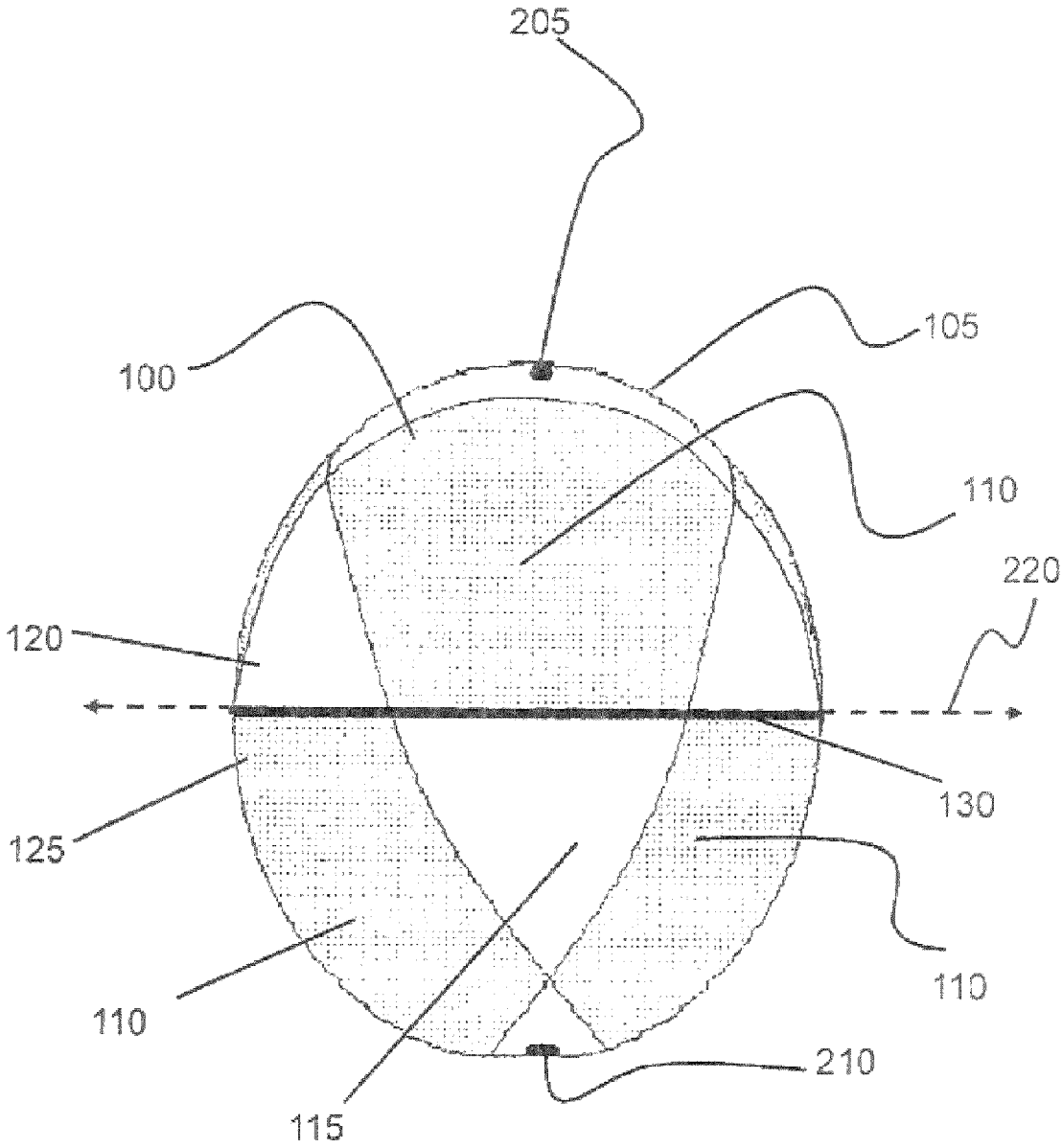
FIG. 3 is a top-view schematic diagram of a golf ball with a cuboctahedron pattern in accordance with one embodiment and in the poles-forward-backward (PFB) orientation.

FIG. 3 is a top-view schematic diagram of a golf ball with a cuboctahedron pattern illustrating a golf ball, which may be ball 100 of FIG. 2 or ball 273 of FIG. 4, in the poles-forward-backward (PFB) orientation with the equator 130 (also called seam) oriented in a vertical plane 220 that points to the right/left and up/down, with pole 205 pointing straight forward and orthogonal to equator 130, and pole 210 pointing straight backward, i.e., approximately located at the point of club impact. In this view, the tee upon which the golf ball 100 would be resting would be located in the center of the golf ball 100 directly below the golf ball 100 (which is out of view in this figure). In addition, outer surface 105 of golf ball 100 has two types of regions of dissimilar dimple types arranged in a cuboctahedron configuration. In the cuboctahedral dimple pattern 173, outer surface 105 has larger dimples arranged in a plurality of three square regions 110 while smaller dimples are arranged in the plurality of four triangular regions 115 in the front hemisphere 120 and back hemisphere 125 respectively for a total of six square regions and eight triangular regions arranged on the outer surface 105 of the golf ball 100. In the inverse cuboctahedral dimple pattern 273, outer surface 105 has larger dimples arranged in the eight triangular regions and smaller dimples arranged in the total of six square regions. In either case, the golf ball 100 contains 504 dimples. In golf ball 173, each of the triangular regions and the square regions containing thirty-six dimples. In golf ball 273, each triangular region contains fifteen dimples while each square region contains sixty four dimples. Further, the top hemisphere 120 and the bottom hemisphere 125 of golf ball 100 are identical and are rotated 60 degrees from each other so that on the equator 130 (also called seam) of the golf ball 100, each square region 110 of the front hemisphere 120 borders each triangular region 115 of the back hemisphere 125. Also shown in FIG. 4, the back pole 210 and front pole (not shown) pass through the triangular region 115 on the outer surface 105 of golf ball 100.

Accordingly, a golf ball 100 designed in accordance with the embodiments described herein will have at least two different regions A and B comprising different dimple patterns and types. Depending on the embodiment, each region A and B, and C where applicable, can have a single type of dimple, or multiple types of dimples. For example, region A can have large dimples, while region B has small dimples, or vice versa; region A can have spherical dimples, while region B has truncated dimples, or vice versa; region A can have various sized spherical dimples, while region B has various sized truncated dimples, or vice versa, or some combination or variation of the above. Some specific example embodiments are described in more detail below.

It will be understood that there is a wide variety of types and construction of dimples, including non-circular dimples, such as those described in U.S. Pat. No. 6,409,615, hexagonal dimples, dimples formed of a tubular lattice structure, such as those described in U.S. Pat. No. 6,290,615, as well as more conventional dimple types. It will also be understood that any of these types of dimples can be used in conjunction with the embodiments described herein. As such, the term "dimple" as used in this description and the claims that follow is intended to refer to and include any type of dimple or dimple construction, unless otherwise specifically indicated.

It should also be understood that a golf ball designed in accordance with the embodiments described herein can be configured such that the average volume per dimple in one region, e.g., region A, is greater than the average volume per dimple in another regions, e.g., region B. Also, the unit volume in one region, e.g., region A, can be greater, e.g., 5% greater, 15% greater, etc., than the average unit volume in another region, e.g., region B. The unit volume can be defined as the volume of the dimples in one region divided by the surface area of the region. Also, the regions do not have to be perfect geometric shapes. For example, the triangle areas can incorporate, and therefore extend into, a small number of dimples from the adjacent square region, or vice versa. Thus, an edge of the triangle region can extend out in a tab like fashion into the adjacent square region. This could happen on one or more than one edge of one or more than one region. In this way, the areas can be said to be derived based on certain geometric shapes, i.e., the underlying shape is still a triangle or square, but with some irregularities at the edges. Accordingly, in the specification and claims that follow when a region is said to be, e.g., a triangle region, this should also be understood to cover a region that is of a shape derived from a triangle.

Figure 10:
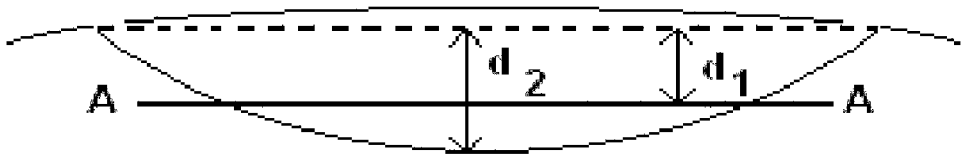
FIG. 10 is a diagram illustrating the relationship between the chord depth of a truncated and a spherical dimple in accordance with one embodiment.
Figure 12:
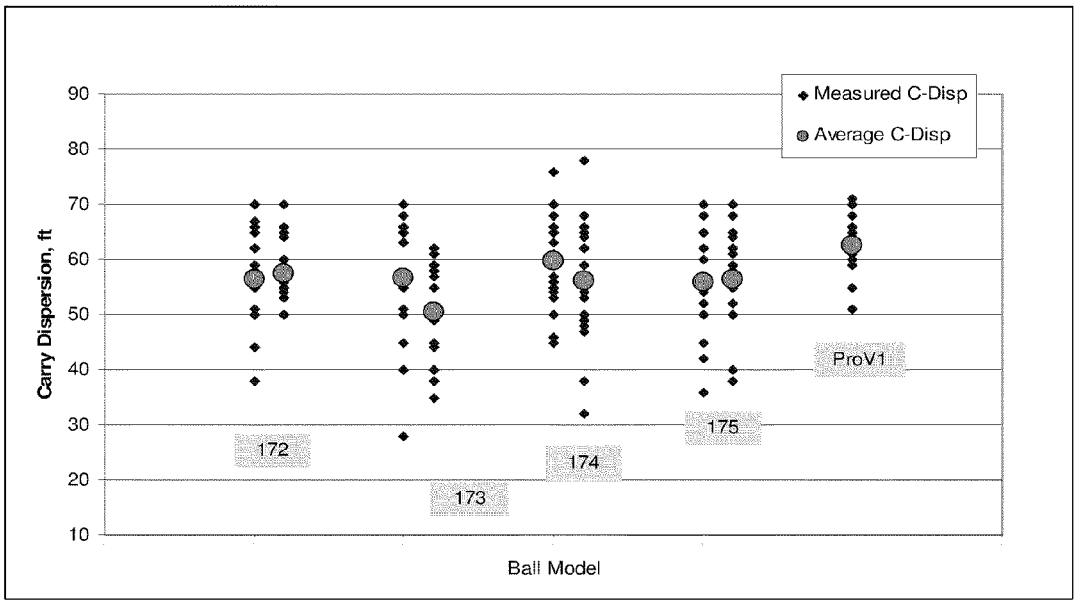
FIG. 12 is a graph illustrating the carry dispersion for the balls tested and shown in FIG. 11.
Figure 13:
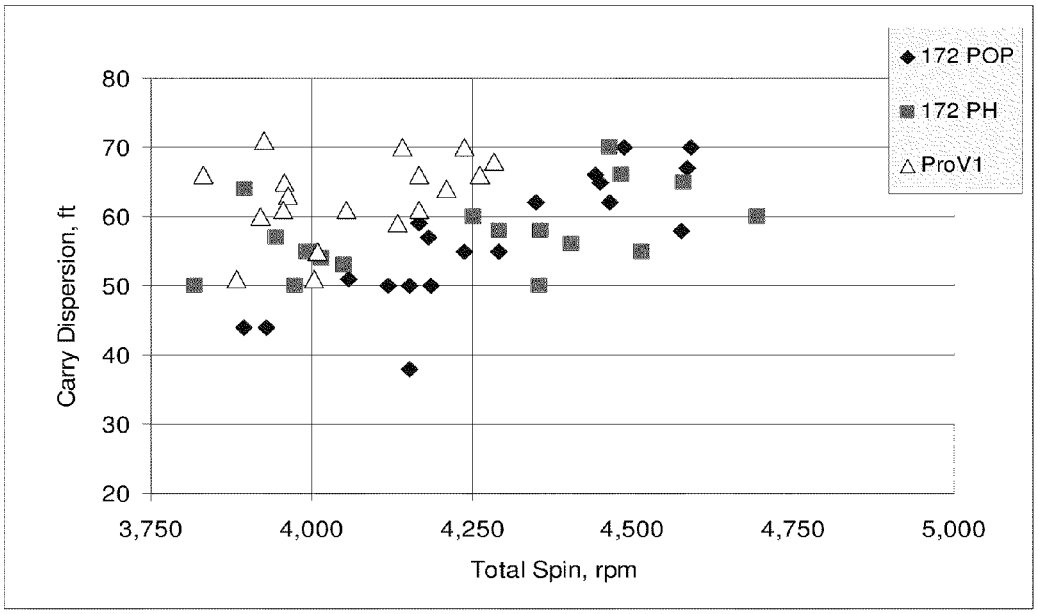
FIG. 13 is a graph of the carry dispersion versus initial total spin rate for a golf ball with the 172 dimple pattern and the ProV1® for the same robot test data shown in FIG. 11.
Figure 14:
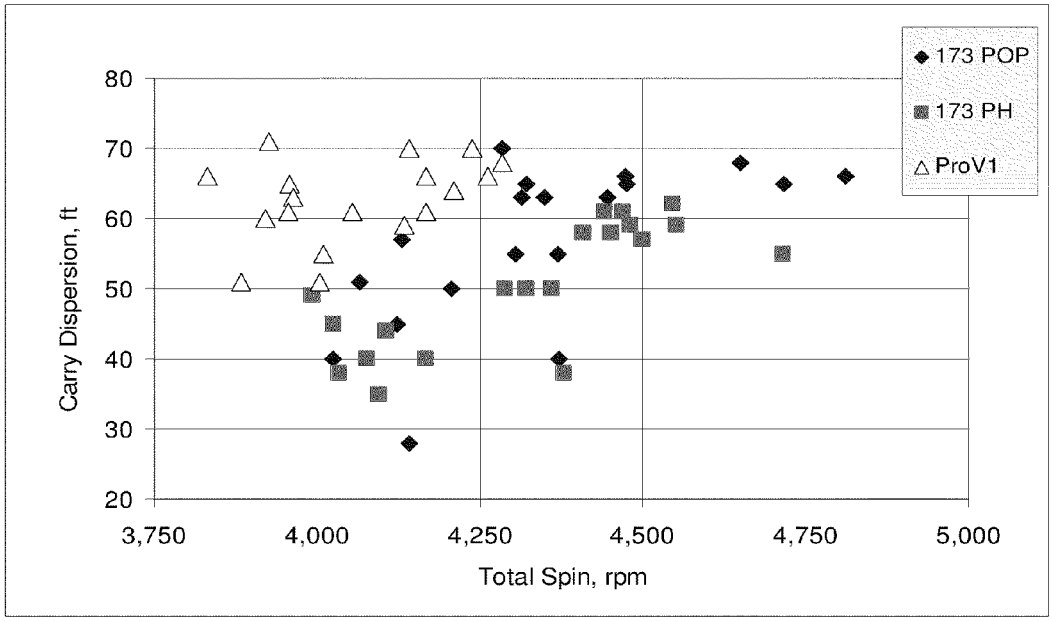
FIG. 14 is a graph of the carry dispersion versus initial total spin rate for a golf ball with the 173 dimple pattern and the ProV1® for the same robot test data shown in FIG. 11.
Figure 15:
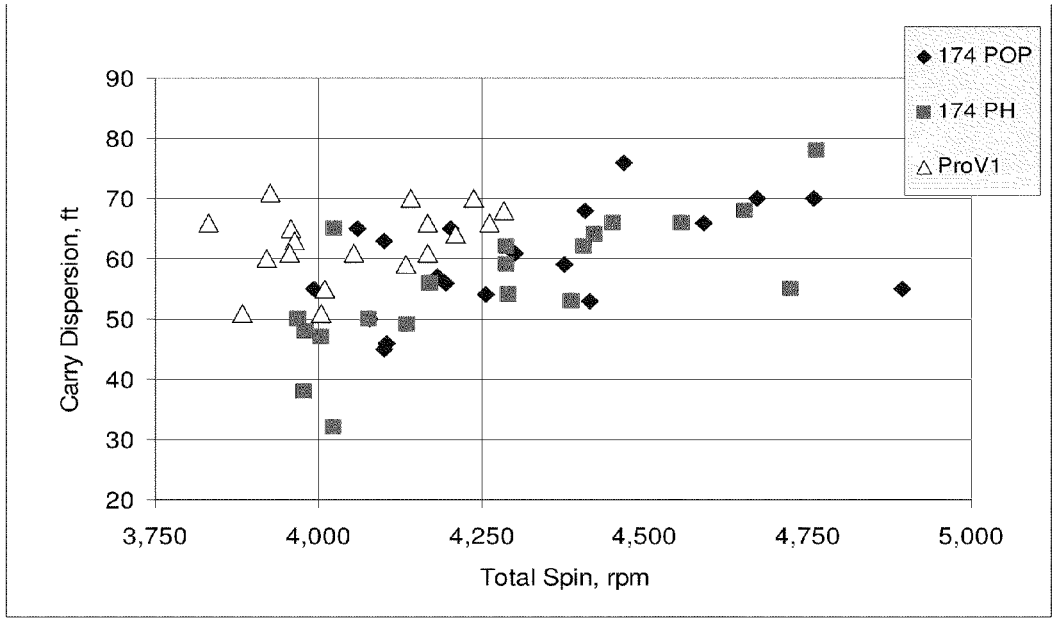
FIG. 15 is a graph of the carry dispersion versus initial total spin rate for a golf ball with the 174 dimple pattern and the ProV1® for the same robot test data shown in FIG. 11.
Figure 16:
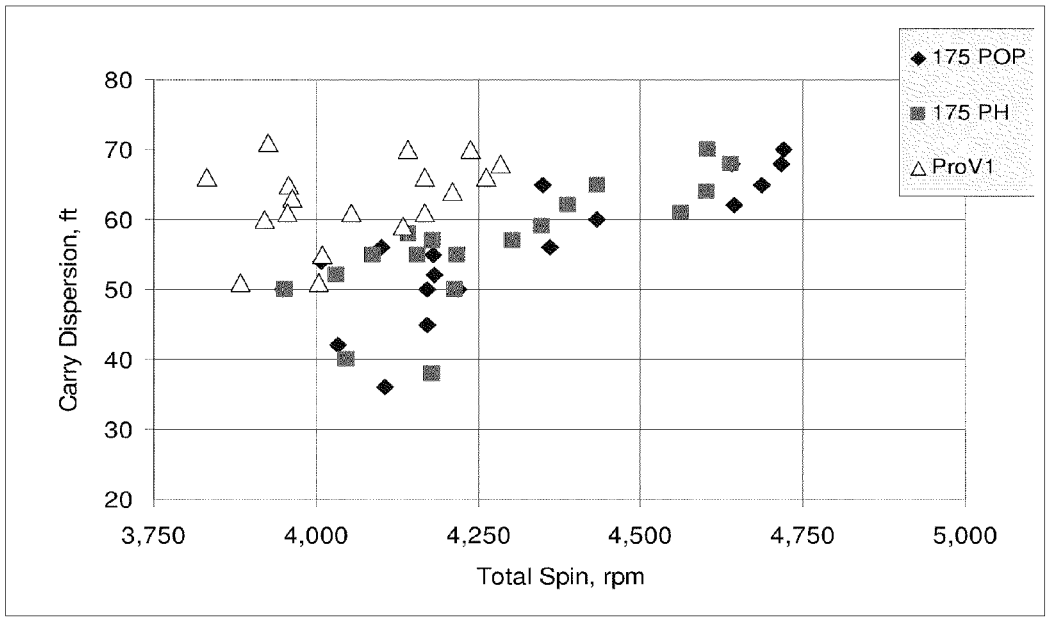
FIG. 16 is a graph of the carry dispersion versus initial total spin rate for a golf ball with the 175 dimple pattern and the ProV1® for the same robot test data shown in FIG. 11.

But first, FIG. 10 is a diagram illustrating the relationship between the chord depth of a truncated and a spherical dimple. The golf ball having a preferred diameter of about 1.68 inches contains 504 dimples to form the cuboctahedral pattern, which was shown in FIGS. 2-4. As an example of just one type of dimple, FIG. 12 shows truncated dimple 400 compared to a spherical dimple having a generally spherical chord depth of 0.012 inches and a radius of 0.075 inches. The truncated dimple 400 may be formed by cutting a spherical indent with a flat inner end, i.e. corresponding to spherical dimple 400 cut along plane A-A to make the dimple 400 more shallow with a flat inner end, and having a truncated chord depth smaller than the corresponding spherical chord depth of 0.012 inches.

The dimples can be aligned along geodesic lines with six dimples on each edge of the square regions, such as square region 110, and eight dimples on each edge of the triangular region 115. The dimples can be arranged according to the three-dimensional Cartesian coordinate system with the X-Y plane being the equator of the ball and the Z direction passing through the pole of the golf ball 100. The angle Φ is the circumferential angle while the angle θ is the co-latitude with 0 degrees at the pole and 90 degrees at the equator. The dimples in the North hemisphere can be offset by 60 degrees from the South hemisphere with the dimple pattern repeating every 120 degrees. Golf ball 100, in the example of FIG. 2, has a total of nine dimple types, with four of the dimple types in each of the triangular regions and five of the dimple types in each of the square regions. As shown in Table 5 below, the various dimple depths and profiles are given for various implementations of golf ball 100, indicated as prototype codes 173-175. The actual location of each dimple on the surface of the ball for dimple patterns 172-175 is given in Tables 6-9. Tables 10 and 11 provide the various dimple depths and profiles for dimple pattern 273 of FIG. 4 and an alternative dimple pattern 2-3, respectively, as well as the location of each dimple on the ball for each of these dimple patterns. Dimple pattern 2-3 is similar to dimple pattern 273 but has dimples of slightly larger chord depth than the ball with dimple pattern 273, as shown in Table 11.

TABLE 6

(Dimple Pattern 172)

| # | Dimple # / Type / Radius / SCD / TCD / Phi | 1 / spherical / 0.05 / 0.0075 / n/a / Theta |
|---|---|---|
| 1 | 0 | 28.81007 |
| 2 | 0 | 41.7187 |
| 3 | 5.308533 | 47.46948 |
| 4 | 9.848338 | 23.49139 |
| 5 | 17.85912 | 86.27884 |
| 6 | 22.3436 | 79.34939 |
| 7 | 24.72264 | 86.27886 |
| 8 | 95.27736 | 86.27886 |
| 9 | 97.6564 | 79.84939 |
| 10 | 102.1409 | 86.27884 |
| 11 | 110.1517 | 23.49139 |
| 12 | 114.6915 | 47.46948 |
| 13 | 120 | 28.81007 |
| 14 | 120 | 41.7187 |
| 15 | 125.3085 | 47.46948 |
| 16 | 129.8483 | 23.49139 |

TABLE 5

| Dimple ID# | 1 | 2 | 3 | 4 | 5 | 6 | 7 | 8 | 9 |
|---|---|---|---|---|---|---|---|---|---|
| | | | | Ball 175 | | | | | |
| Type Dimple Region | Triangle | Triangle | Triangle | Triangle | Square | Square | Square | Square | Square |
| Type Dimple | spherical | spherical | spherical | spherical | truncated | truncated | truncated | truncated | truncated |
| Dimple Radius, in | 0.05 | 0.0525 | 0.055 | 0.0575 | 0.075 | 0.0775 | 0.0825 | 0.0875 | 0.095 |
| Spherical Chord Depth, in | 0.008 | 0.008 | 0.008 | 0.008 | 0.012 | 0.0122 | 0.0128 | 0.0133 | 0.014 |
| Truncated Chord Depth, in | n/a | n/a | n/a | n/a | 0.0035 | 0.0035 | 0.0035 | 0.0035 | 0.0035 |
| # of dimples in region | 9 | 18 | 6 | 3 | 12 | 8 | 8 | 4 | 4 |
| | | | | Ball 174 | | | | | |
| Type Dimple Region | Triangle | Triangle | Triangle | Triangle | Square | Square | Square | Square | Square |
| Type Dimple | truncated | truncated | truncated | truncated | spherical | spherical | spherical | spherical | spherical |
| Dimple Radius, in | 0.05 | 0.0525 | 0.055 | 0.0575 | 0.075 | 0.0775 | 0.0825 | 0.0875 | 0.095 |
| Spherical Chord Depth, in | 0.0087 | 0.0091 | 0.0094 | 0.0098 | 0.008 | 0.008 | 0.008 | 0.008 | 0.008 |
| Truncated Chord Depth, in | 0.0035 | 0.0035 | 0.0035 | 0.0035 | n/a | n/a | n/a | n/a | n/a |
| # of dimples in region | 9 | 18 | 6 | 3 | 12 | 8 | 8 | 4 | 4 |
| | | | | Ball 173 | | | | | |
| Type Dimple Region | Triangle | Triangle | Triangle | Triangle | Square | Square | Square | Square | Square |
| Type Dimple | spherical | spherical | spherical | spherical | truncated | truncated | truncated | truncated | truncated |
| Dimple Radius, in | 0.05 | 0.0525 | 0.055 | 0.0575 | 0.075 | 0.0775 | 0.0825 | 0.0875 | 0.095 |
| Spherical Chord Depth, in | 0.0075 | 0.0075 | 0.0075 | 0.0075 | 0.012 | 0.0122 | 0.0128 | 0.0133 | 0.014 |
| Truncated Chord Depth, in | n/a | n/a | n/a | n/a | 0.005 | 0.005 | 0.005 | 0.005 | 0.005 |
| # of dimples in region | 9 | 18 | 6 | 3 | 12 | 8 | 8 | 4 | 4 |
| | | | | Ball 172 | | | | | |
| Type Dimple Region | Triangle | Triangle | Triangle | Triangle | Square | Square | Square | Square | Square |
| Type Dimple | spherical | spherical | spherical | spherical | spherical | spherical | spherical | spherical | spherical |
| Dimple Radius, in | 0.05 | 0.0525 | 0.055 | 0.0575 | 0.075 | 0.0775 | 0.0825 | 0.0875 | 0.095 |
| Spherical Chord Depth, in | 0.0075 | 0.0075 | 0.0075 | 0.0075 | 0.005 | 0.005 | 0.005 | 0.005 | 0.005 |
| Truncated Chord Depth, in | n/a | n/a | n/a | n/a | n/a | n/a | n/a | n/a | n/a |
| # of dimples in region | 9 | 18 | 6 | 3 | 12 | 8 | 8 | 4 | 4 |

TABLE 6-continued (Dimple Pattern 172)

| | | |
|---|---|---|
| 17 | 137.8591 | 86.27884 |
| 18 | 142.3436 | 79.84939 |
| 19 | 144.7226 | 86.27886 |
| 20 | 215.2774 | 86.27886 |
| 21 | 217.6564 | 79.84939 |
| 22 | 222.1409 | 86.27884 |
| 23 | 230.1517 | 23.49139 |
| 24 | 234.6915 | 47.46948 |
| 25 | 240 | 23.81007 |
| 26 | 240 | 41.7187 |
| 27 | 245.3085 | 47.46948 |
| 28 | 249.8483 | 23.49139 |
| 29 | 257.8591 | 86.27884 |
| 30 | 262.3436 | 79.84939 |
| 31 | 264.7226 | 86.27886 |
| 32 | 335.2774 | 86.27886 |
| 33 | 337.6564 | 79.84939 |
| 34 | 342.1409 | 86.27884 |
| 35 | 350.1517 | 23.49139 |
| 36 | 354.6915 | 47.46948 |

| | | |
|---|---|---|
| | Dimple # | 2 |
| | Type | spherical |
| | Radius | 0.0525 |
| | SCD | 0.0075 |
| | TCD | n/a |
| # | Phi | Theta |
| 1 | 3.606874 | 86.10963 |
| 2 | 4.773603 | 59.66486 |
| 3 | 7.485123 | 79.72027 |
| 4 | 9.566953 | 53.68971 |
| 5 | 10.81146 | 86.10963 |
| 6 | 12.08533 | 72.79786 |
| 7 | 13.37932 | 60.13101 |
| 8 | 16.66723 | 66.70139 |
| 9 | 19.58024 | 73.34845 |
| 10 | 20.76038 | 11.6909 |
| 11 | 24.53367 | 18.8166 |
| 12 | 46.81607 | 15.97349 |
| 13 | 73.18393 | 15.97349 |
| 14 | 95.46633 | 18.8166 |
| 15 | 99.23962 | 11.6909 |
| 16 | 100.4198 | 73.34845 |
| 17 | 103.3328 | 66.70139 |
| 18 | 106.6207 | 60.13101 |
| 19 | 107.9147 | 72.79786 |
| 20 | 109.1885 | 86.10963 |
| 21 | 110.433 | 53.68971 |
| 22 | 112.5149 | 79.72027 |
| 23 | 115.2264 | 59.66486 |
| 24 | 116.3931 | 86.10963 |
| 25 | 123.6069 | 86.10963 |
| 26 | 124.7736 | 59.66486 |
| 27 | 127.4851 | 79.72027 |
| 28 | 129.567 | 53.68971 |
| 29 | 130.8115 | 86.10963 |
| 30 | 132.0853 | 72.79786 |
| 31 | 133.3793 | 60.13101 |
| 32 | 136.6672 | 66.70139 |
| 33 | 139.5802 | 73.34845 |
| 34 | 140.7604 | 11.6909 |
| 35 | 144.5337 | 18.8166 |
| 36 | 166.8161 | 15.97349 |
| 37 | 193.1839 | 15.97349 |
| 38 | 215.4663 | 18.8166 |
| 39 | 219.2396 | 11.6909 |
| 40 | 220.4198 | 73.34845 |
| 41 | 223.3323 | 66.70139 |
| 42 | 226.6207 | 60.13101 |
| 43 | 227.9147 | 72.79786 |
| 44 | 229.1885 | 86.10963 |
| 45 | 230.433 | 53.68971 |
| 46 | 232.5149 | 79.72027 |
| 47 | 235.2264 | 59.66486 |
| 48 | 236.3931 | 86.10963 |
| 49 | 243.6069 | 85.10963 |
| 50 | 244.7736 | 59.66486 |

TABLE 6-continued (Dimple Pattern 172)

| | | |
|---|---|---|
| 51 | 247.4851 | 79.72027 |
| 52 | 249.567 | 53.68971 |
| 53 | 250.8115 | 86.10963 |
| 54 | 252.0853 | 72.79786 |
| 55 | 253.3793 | 60.13101 |
| 56 | 256.6672 | 66.70139 |
| 57 | 259.5802 | 73.34845 |
| 58 | 260.7604 | 11.6909 |
| 59 | 264.5337 | 18.8166 |
| 60 | 286.8161 | 15.97349 |
| 61 | 313.1839 | 15.97349 |
| 62 | 335.4663 | 18.8166 |
| 63 | 339.2396 | 11.6909 |
| 64 | 340.4198 | 73.34845 |
| 65 | 343.3328 | 66.70139 |
| 66 | 346.6207 | 60.13101 |
| 67 | 347.9147 | 72.79786 |
| 68 | 349.1885 | 86.10963 |
| 69 | 350.433 | 53.68971 |
| 70 | 352.5149 | 79.72027 |
| 71 | 355.2264 | 59.66486 |
| 72 | 356.3931 | 86.10963 |

| | | |
|---|---|---|
| | Dimple # | 3 |
| | Type | spherical |
| | Radius | 0.055 |
| | SCD | 0.0075 |
| | TCD | n/a |
| # | Phi | Theta |
| 1 | 0 | 17.13539 |
| 2 | 0 | 79.62325 |
| 3 | 0 | 53.39339 |
| 4 | 8.604739 | 66.19316 |
| 5 | 15.03312 | 79.65081 |
| 6 | 60 | 9.094473 |
| 7 | 104.9669 | 79.65081 |
| 8 | 111.3953 | 66.19316 |
| 9 | 120 | 17.13539 |
| 10 | 120 | 53.39339 |
| 11 | 120 | 79.62325 |
| 12 | 128.6047 | 66.19316 |
| 13 | 135.0331 | 79.65081 |
| 14 | 180 | 9.094473 |
| 15 | 224.9669 | 79.65081 |
| 16 | 231.3953 | 66.19316 |
| 17 | 240 | 17.13539 |
| 18 | 240 | 53.39339 |
| 19 | 240 | 79.62325 |
| 20 | 248.6047 | 66.19316 |
| 21 | 255.0331 | 79.65081 |
| 22 | 300 | 9.094473 |
| 23 | 344.9669 | 79.65081 |
| 24 | 351.3953 | 66.19316 |

| | | |
|---|---|---|
| | Dimple # | 4 |
| | Type | spherical |
| | Radius | 0.0575 |
| | SCD | 0.0075 |
| | TCD | n/a |
| # | Phi | Theta |
| 1 | 0 | 4.637001 |
| 2 | 0 | 65.89178 |
| 3 | 4.200798 | 72.89446 |
| 4 | 115.7992 | 72.89446 |
| 5 | 120 | 4.637001 |
| 6 | 120 | 65.89178 |
| 7 | 124.2008 | 72.89446 |
| 8 | 235.7992 | 72.89446 |
| 9 | 240 | 4.637001 |
| 10 | 240 | 65.89178 |
| 11 | 244.2008 | 72.89446 |
| 12 | 355.7992 | 72.89446 |

TABLE 6-continued (Dimple Pattern 172)

| # | Dimple # / Type / Radius / SCD / TCD / Phi | 5 / spherical / 0.075 / 0.005 / n/a / Theta |
|---|---|---|
| 1 | 11.39176 | 35.80355 |
| 2 | 17.86771 | 45.18952 |
| 3 | 26.35389 | 29.36327 |
| 4 | 30.46014 | 74.86406 |
| 5 | 33.84232 | 84.58637 |
| 6 | 44.16317 | 84.53634 |
| 7 | 75.83683 | 84.53634 |
| 8 | 86.15768 | 84.58637 |
| 9 | 89.53986 | 74.86406 |
| 10 | 93.64611 | 29.36327 |
| 11 | 102.1323 | 45.18952 |
| 12 | 108.6082 | 35.80355 |
| 13 | 131.3918 | 35.80355 |
| 14 | 137.3677 | 45.18952 |
| 15 | 146.3539 | 29.36327 |
| 16 | 150.4601 | 74.86406 |
| 17 | 153.3423 | 84.58637 |
| 18 | 164.1632 | 84.58634 |
| 19 | 195.8368 | 84.58634 |
| 20 | 206.1577 | 84.58637 |
| 21 | 209.5399 | 74.86406 |
| 22 | 213.6461 | 29.36327 |
| 23 | 222.1323 | 45.18952 |
| 24 | 228.6082 | 35.80355 |
| 25 | 251.3918 | 35.80355 |
| 26 | 257.8677 | 45.18952 |
| 27 | 266.3539 | 29.36327 |
| 28 | 270.4601 | 74.86406 |
| 29 | 273.8423 | 84.58637 |
| 30 | 234.1632 | 84.58634 |
| 31 | 315.8368 | 84.58634 |
| 32 | 326.1577 | 84.58637 |
| 33 | 329.5399 | 74.86406 |
| 34 | 333.6461 | 29.36327 |
| 35 | 342.1323 | 45.18952 |
| 36 | 348.6082 | 35.80355 |

| # | Dimple # / Type / Radius / SCD / TCD / Phi | 6 / spherical / 0.0775 / 0.005 / n/a / Theta |
|---|---|---|
| 1 | 22.97427 | 54.90551 |
| 2 | 27.03771 | 64.89835 |
| 3 | 47.66575 | 25.59568 |
| 4 | 54.6796 | 84.41703 |
| 5 | 65.3204 | 84.41703 |
| 6 | 72.33425 | 25.59568 |
| 7 | 92.96229 | 64.89835 |
| 8 | 97.02573 | 54.90551 |
| 9 | 142.9743 | 54.90551 |
| 10 | 147.0377 | 64.89835 |
| 11 | 167.6657 | 25.59568 |
| 12 | 174.6796 | 84.41703 |
| 13 | 185.3204 | 84.41703 |
| 14 | 192.3343 | 25.59568 |
| 15 | 212.9623 | 64.89835 |
| 16 | 217.0257 | 54.90551 |
| 17 | 262.9743 | 54.90551 |
| 18 | 267.0377 | 64.89835 |
| 19 | 237.6657 | 25.59568 |
| 20 | 294.6796 | 84.41703 |
| 21 | 305.3204 | 84.41703 |
| 22 | 312.3343 | 25.59568 |
| 23 | 332.9623 | 64.89835 |
| 24 | 337.0257 | 54.90551 |

TABLE 6-continued (Dimple Pattern 172)

| # | Dimple # / Type / Radius / SCD / TCD / Phi | 7 / spherical / 0.0825 / 0.005 / n/a / Theta |
|---|---|---|
| 1 | 35.91413 | 51.35559 |
| 2 | 38.90934 | 62.34835 |
| 3 | 50.48062 | 36.43373 |
| 4 | 54.12044 | 73.49879 |
| 5 | 65.87956 | 73.49879 |
| 6 | 69.51938 | 36.43373 |
| 7 | 31.09066 | 62.34835 |
| 8 | 84.08587 | 51.35559 |
| 9 | 155.9141 | 51.35559 |
| 10 | 158.9093 | 62.34835 |
| 11 | 170.4806 | 36.43373 |
| 12 | 174.1204 | 73.49879 |
| 13 | 185.8796 | 73.49879 |
| 14 | 189.5194 | 36.43373 |
| 15 | 201.0907 | 62.34835 |
| 16 | 204.0859 | 51.35559 |
| 17 | 275.9141 | 51.35559 |
| 18 | 278.9093 | 62.34835 |
| 19 | 290.4806 | 36.43373 |
| 20 | 294.1204 | 73.49879 |
| 21 | 305.8796 | 73.49879 |
| 22 | 309.5194 | 36.43373 |
| 23 | 321.0907 | 62.34835 |
| 24 | 324.0859 | 51.35559 |

| # | Dimple # / Type / Radius / SCD / TCD / Phi | 8 / spherical / 0.0875 / 0.005 / n/a / Theta |
|---|---|---|
| 1 | 32.46033 | 39.96433 |
| 2 | 41.97126 | 73.6516 |
| 3 | 78.02874 | 73.6516 |
| 4 | 87.53967 | 39.96433 |
| 5 | 152.4603 | 39.96433 |
| 6 | 161.9713 | 73.6516 |
| 7 | 198.0287 | 73.6516 |
| 8 | 207.5397 | 39.96433 |
| 9 | 272.4603 | 39.96433 |
| 10 | 281.9713 | 73.6516 |
| 11 | 318.0287 | 73.6516 |
| 12 | 327.5397 | 39.96433 |

| # | Dimple # / Type / Radius / SCD / TCD / Phi | 9 / spherical / 0.095 / 0.005 / n/a / Theta |
|---|---|---|
| 1 | 51.33861 | 48.53996 |
| 2 | 52.61871 | 61.45814 |
| 3 | 67.38129 | 61.45814 |
| 4 | 68.66139 | 48.53996 |
| 5 | 171.3386 | 48.53996 |
| 6 | 172.6187 | 61.45814 |
| 7 | 187.3813 | 61.45814 |
| 8 | 188.6614 | 48.53996 |
| 9 | 291.3386 | 48.53996 |
| 10 | 292.6187 | 61.45814 |
| 11 | 307.3813 | 61.45814 |
| 12 | 308.6614 | 48.53996 |

TABLE 7

(Dimple Pattern 173)

| # | Dimple # / Type / Radius / SCD / TCD / Phi | 1 / spherical / 0.05 / 0.0075 / n/a / Theta |
|---|---|---|
| 1 | 0 | 28.81007 |
| 2 | 0 | 41.7187 |
| 3 | 5.30853345 | 47.46948 |
| 4 | 9.848337904 | 23.49139 |
| 5 | 17.85912075 | 86.27884 |
| 6 | 22.34360082 | 79.84939 |
| 7 | 24.72264341 | 86.27886 |
| 8 | 95.27735659 | 86.27886 |
| 9 | 97.65639918 | 79.84939 |
| 10 | 102.1408793 | 86.27884 |
| 11 | 110.1516621 | 23.49139 |
| 12 | 114.6914665 | 47.46948 |
| 13 | 120 | 28.81007 |
| 14 | 120 | 41.7187 |
| 15 | 125.3085335 | 47.46948 |
| 16 | 129.8483379 | 23.49139 |
| 17 | 137.8591207 | 86.27884 |
| 18 | 142.3436008 | 79.84939 |
| 19 | 144.7226434 | 86.27386 |
| 20 | 215.2773566 | 86.27886 |
| 21 | 217.6563992 | 79.84939 |
| 22 | 222.1408793 | 86.27884 |
| 23 | 230.1516621 | 23.49139 |
| 24 | 234.6914665 | 47.46948 |
| 25 | 240 | 23.81007 |
| 26 | 240 | 41.7187 |
| 27 | 245.3085395 | 47.46948 |
| 28 | 249.8483379 | 23.49139 |
| 29 | 257.8591207 | 86.27884 |
| 30 | 262.3436008 | 79.84939 |
| 31 | 264.7226434 | 86.27886 |
| 32 | 335.2773566 | 86.27886 |
| 33 | 337.6563992 | 79.84939 |
| 34 | 342.1408793 | 86.27884 |
| 35 | 350.1516621 | 23.49139 |
| 36 | 354.6914665 | 47.46948 |

| # | Dimple # / Type / Radius / SCD / TCD / Phi | 2 / spherical / 0.0525 / 0.0075 / n/a / Theta |
|---|---|---|
| 1 | 3.606873831 | 86.10963 |
| 2 | 4.773603104 | 59.66486 |
| 3 | 7.485123389 | 79.72027 |
| 4 | 9.566952638 | 53.68971 |
| 5 | 10.81146128 | 86.10963 |
| 6 | 12.08533241 | 72.79786 |
| 7 | 13.37931975 | 60.13101 |
| 8 | 16.66723032 | 66.70139 |
| 9 | 19.58024114 | 73.34845 |
| 10 | 20.76038062 | 11.6909 |
| 11 | 24.53367306 | 13.8166 |
| 12 | 46.81607116 | 15.97349 |
| 13 | 73.18392884 | 15.97349 |
| 14 | 95.46632694 | 18.8166 |
| 15 | 99.23961938 | 11.6909 |
| 16 | 100.4197589 | 73.34845 |
| 17 | 103.3327697 | 66.70139 |
| 18 | 106.6206802 | 60.13101 |
| 19 | 107.9146676 | 72.79786 |
| 20 | 109.1885387 | 86.10963 |
| 21 | 110.4330474 | 53.68971 |
| 22 | 112.5148766 | 79.72027 |
| 23 | 115.2263969 | 59.66486 |
| 24 | 116.3931262 | 86.10963 |
| 25 | 123.6068738 | 86.10963 |
| 26 | 124.7736031 | 59.66486 |
| 27 | 127.4851234 | 79.72027 |

TABLE 7-continued (Dimple Pattern 173)

| | | |
|---|---|---|
| 28 | 129.5669526 | 53.68971 |
| 29 | 130.8114613 | 86.10963 |
| 30 | 132.0853324 | 72.79786 |
| 31 | 133.3793198 | 60.13101 |
| 32 | 136.6672303 | 66.70139 |
| 33 | 139.5802411 | 73.34845 |
| 34 | 140.7603806 | 11.6909 |
| 35 | 144.5336731 | 18.8166 |
| 36 | 166.8160712 | 15.97349 |
| 37 | 193.1839288 | 15.97349 |
| 38 | 215.4663269 | 18.8166 |
| 39 | 219.2396194 | 11.6909 |
| 40 | 220.4197589 | 73.34845 |
| 41 | 223.3327697 | 66.70139 |
| 42 | 226.6206802 | 60.13101 |
| 43 | 227.9146676 | 72.79786 |
| 44 | 229.1885307 | 86.10963 |
| 45 | 230.4330474 | 53.68971 |
| 46 | 232.5148766 | 79.72027 |
| 47 | 235.2263969 | 59.66486 |
| 48 | 236.3931262 | 86.10963 |
| 49 | 243.6068738 | 86.10963 |
| 50 | 244.7736031 | 59.66486 |
| 51 | 247.4851234 | 79.72027 |
| 52 | 249.5669526 | 53.68971 |
| 53 | 250.8114613 | 86.10963 |
| 54 | 252.0853324 | 72.79786 |
| 55 | 253.3793198 | 60.13101 |
| 56 | 256.6672303 | 66.70139 |
| 57 | 259.5802411 | 73.34845 |
| 58 | 260.7603806 | 11.6909 |
| 59 | 264.5336731 | 18.8166 |
| 60 | 286.8160712 | 15.97349 |
| 61 | 313.1839288 | 15.97349 |
| 62 | 335.4663269 | 18.8166 |
| 63 | 339.2396194 | 11.6909 |
| 64 | 340.4197589 | 73.34845 |
| 65 | 343.3327697 | 66.70139 |
| 66 | 346.6206802 | 60.13101 |
| 67 | 347.9146676 | 72.79786 |
| 68 | 349.1885387 | 86.10963 |
| 69 | 350.4330474 | 53.68971 |
| 70 | 352.5148766 | 79.72027 |
| 71 | 355.2263969 | 59.66486 |
| 72 | 356.3931262 | 86.10963 |

| # | Dimple # / Type / Radius / SCD / TCD / Phi | 3 / spherical / 0.055 / 0.0075 / n/a / Theta |
|---|---|---|
| 1 | 0 | 17.13539 |
| 2 | 0 | 79.62325 |
| 3 | 0 | 53.39339 |
| 4 | 8.604738835 | 66.19316 |
| 5 | 15.03312161 | 79.65081 |
| 6 | 60 | 9.094473 |
| 7 | 104.9668784 | 79.65081 |
| 8 | 111.3952612 | 66.19316 |
| 9 | 120 | 17.13539 |
| 10 | 120 | 53.39339 |
| 11 | 120 | 79.62325 |
| 12 | 128.6047388 | 66.19316 |
| 13 | 135.0331216 | 79.65081 |
| 14 | 180 | 9.094473 |
| 15 | 224.9668784 | 79.65081 |
| 16 | 231.3952612 | 66.19316 |
| 17 | 240 | 17.13539 |
| 18 | 240 | 53.39339 |
| 19 | 240 | 79.62325 |
| 20 | 248.6047388 | 66.19316 |
| 21 | 255.0331216 | 79.65081 |
| 22 | 300 | 9.094473 |
| 23 | 344.9668784 | 79.65081 |
| 24 | 351.3952612 | 66.19316 |

TABLE 7-continued (Dimple Pattern 173)

| # | Dimple # / Type / Radius / SCD / TCD / Phi | 4 / spherical / 0.0575 / 0.0075 / n/a / Theta |
|---|---|---|
| 1 | 0 | 4.637001 |
| 2 | 0 | 65.89178 |
| 3 | 4.200798314 | 72.89446 |
| 4 | 115.7992017 | 72.89446 |
| 5 | 120 | 4.637001 |
| 6 | 120 | 65.89178 |
| 7 | 124.2007983 | 72.89446 |
| 8 | 235.7902017 | 72.89446 |
| 9 | 240 | 4.637001 |
| 10 | 240 | 65.89178 |
| 11 | 244.2007983 | 72.89446 |
| 12 | 355.7992017 | 72.89446 |

| # | Dimple # / Type / Radius / SCD / TCD / Phi | 5 / truncated / 0.075 / 0.0119 / 0.005 / Theta |
|---|---|---|
| 1 | 11.39176224 | 35.80355 |
| 2 | 17.86771474 | 45.18952 |
| 3 | 26.35389345 | 29.36327 |
| 4 | 30.46014274 | 74.86406 |
| 5 | 33.84232422 | 84.58637 |
| 6 | 44.16316959 | 84.53634 |
| 7 | 75.83683042 | 84.53634 |
| 8 | 86.15767578 | 84.58637 |
| 9 | 89.53985726 | 74.86406 |
| 10 | 93.64610555 | 29.36327 |
| 11 | 102.1322853 | 45.18952 |
| 12 | 108.6082378 | 35.80355 |
| 13 | 131.3917622 | 35.80355 |
| 14 | 137.8677147 | 45.13952 |
| 15 | 146.3538935 | 29.36327 |
| 16 | 150.4601427 | 74.86406 |
| 17 | 153.3423242 | 84.58637 |
| 18 | 164.1631696 | 84.58634 |
| 19 | 195.8368304 | 84.58634 |
| 20 | 206.1576758 | 84.58637 |
| 21 | 209.5398573 | 74.86406 |
| 22 | 213.6461065 | 29.36327 |
| 23 | 222.1322853 | 45.18952 |
| 24 | 228.6082378 | 35.80355 |
| 25 | 251.3917622 | 35.80355 |
| 26 | 257.8677147 | 45.18952 |
| 27 | 266.3538935 | 29.36327 |
| 28 | 270.4601427 | 74.86406 |
| 29 | 273.8423242 | 84.58637 |
| 30 | 234.1631696 | 84.58634 |
| 31 | 315.8368304 | 84.58634 |
| 32 | 326.1576758 | 84.58637 |
| 33 | 329.5398573 | 74.86406 |
| 34 | 333.6461065 | 29.36327 |
| 35 | 342.1322853 | 45.18952 |
| 36 | 348.6082378 | 35.80355 |

| # | Dimple # / Type / Radius / SCD / TCD / Phi | 6 / truncated / 0.0775 / 0.0122 / 0.005 / Theta |
|---|---|---|
| 1 | 22.97426943 | 54.90551 |
| 2 | 27.03771469 | 64.89835 |
| 3 | 47.6657487 | 25.59568 |
| 4 | 54.67960187 | 84.41703 |
| 5 | 65.32039813 | 84.41703 |
| 6 | 72.3342513 | 25.59568 |
| 7 | 92.96228531 | 64.89835 |

TABLE 7-continued (Dimple Pattern 173)

| | | |
|---|---|---|
| 8 | 97.02573057 | 54.90551 |
| 9 | 142.9742694 | 54.90551 |
| 10 | 147.0377147 | 64.89835 |
| 11 | 167.6657487 | 25.59568 |
| 12 | 174.6796019 | 84.41703 |
| 13 | 185.3203981 | 84.41703 |
| 14 | 192.3342513 | 25.59568 |
| 15 | 212.9622853 | 64.89835 |
| 16 | 217.0257306 | 54.90551 |
| 17 | 262.9742694 | 54.90551 |
| 18 | 267.0377147 | 64.89835 |
| 19 | 237.6657487 | 25.59568 |
| 20 | 294.6796019 | 84.41703 |
| 21 | 305.3203981 | 84.41703 |
| 22 | 312.3342513 | 25.59568 |
| 23 | 332.9622853 | 64.89835 |
| 24 | 337.0257306 | 54.90551 |

| # | Dimple # / Type / Radius / SCD / TCD / Phi | 7 / truncated / 0.0825 / 0.0128 / 0.005 / Theta |
|---|---|---|
| 1 | 35.91413117 | 51.35559 |
| 2 | 38.90934195 | 62.34835 |
| 3 | 50.48062345 | 36.43373 |
| 4 | 54.12044072 | 73.49879 |
| 5 | 65.87955928 | 73.49879 |
| 6 | 69.51937655 | 36.43373 |
| 7 | 81.09065805 | 62.34835 |
| 8 | 84.08586893 | 51.35559 |
| 9 | 155.9141312 | 51.35559 |
| 10 | 158.909342 | 62.34835 |
| 11 | 170.4806234 | 36.43373 |
| 12 | 174.1204407 | 73.49879 |
| 13 | 185.8795593 | 73.49879 |
| 14 | 189.5193766 | 36.43373 |
| 15 | 201.090656 | 62.34835 |
| 16 | 204.0858688 | 51.35559 |
| 17 | 275.9141312 | 51.35559 |
| 18 | 278.909342 | 62.34835 |
| 19 | 290.4806234 | 36.43373 |
| 20 | 294.1204407 | 73.49879 |
| 21 | 305.8795593 | 73.49879 |
| 22 | 309.5193766 | 36.43373 |
| 23 | 321.090658 | 62.34835 |
| 24 | 324.0858698 | 51.35559 |

| # | Dimple # / Type / Radius / SCD / TCD / Phi | 8 / truncated / 0.0875 / 0.0133 / 0.005 / Theta |
|---|---|---|
| 1 | 32.46032855 | 39.96433 |
| 2 | 41.97126436 | 73.6516 |
| 3 | 78.02873584 | 73.6516 |
| 4 | 37.53967145 | 39.96433 |
| 5 | 152.4603285 | 39.96433 |
| 6 | 161.9712644 | 73.6516 |
| 7 | 198.0287356 | 73.6516 |
| 8 | 207.5396715 | 39.96433 |
| 9 | 272.4603285 | 39.96433 |
| 10 | 281.9712644 | 73.6516 |
| 11 | 318.0287356 | 73.6516 |
| 12 | 327.5396715 | 39.96433 |

TABLE 7-continued

| (Dimple Pattern 173) | | |
|---|---|---|
| | Dimple # | 9 |
| | Type | truncated |
| | Radius | 0.095 |
| | SCD | 0.014 |
| | TCD | 0.005 |
| # | Phi | Theta |
| 1 | 51.33861068 | 48.53996 |
| 2 | 52.61871427 | 61.45814 |
| 3 | 67.38128573 | 61.45814 |
| 4 | 68.66138932 | 48.53996 |
| 5 | 171.3386107 | 48.53996 |
| 6 | 172.6187143 | 61.45814 |
| 7 | 187.3812857 | 61.45814 |
| 8 | 188.6613893 | 48.53996 |
| 9 | 291.3386107 | 48.53996 |
| 10 | 292.6187143 | 61.45814 |
| 11 | 307.3812857 | 61.45814 |
| 12 | 308.6613893 | 48.53996 |

TABLE 8

| (Dimple Pattern 174) | | |
|---|---|---|
| | Dimple # | 1 |
| | Type | truncated |
| | Radius | 0.05 |
| | SCD | 0.0087 |
| | TCD | 0.0035 |
| # | Phi | Theta |
| 1 | 0 | 28.81007 |
| 2 | 0 | 41.7187 |
| 3 | 5.308533 | 47.46948 |
| 4 | 9.846338 | 23.49139 |
| 5 | 17.85912 | 86.27884 |
| 6 | 22.3436 | 79.34939 |
| 7 | 24.72264 | 86.27886 |
| 8 | 95.27736 | 86.27886 |
| 9 | 97.6564 | 79.84939 |
| 10 | 102.1409 | 86.27884 |
| 11 | 110.1517 | 23.49139 |
| 12 | 114.6915 | 47.46948 |
| 13 | 120 | 28.81007 |
| 14 | 120 | 41.7187 |
| 15 | 125.3085 | 47.46948 |
| 16 | 129.8483 | 23.49139 |
| 17 | 137.8591 | 86.27884 |
| 18 | 142.3436 | 79.84939 |
| 19 | 144.7226 | 86.27886 |
| 20 | 215.2774 | 86.27886 |
| 21 | 217.6564 | 79.84939 |
| 22 | 222.1409 | 86.27884 |
| 23 | 230.1517 | 23.49139 |
| 24 | 234.6915 | 47.46948 |
| 25 | 240 | 23.81007 |
| 26 | 240 | 41.7187 |
| 27 | 245.3085 | 47.46948 |
| 28 | 249.8483 | 23.49139 |
| 29 | 257.8591 | 86.27884 |
| 30 | 262.3436 | 79.84939 |
| 31 | 264.7226 | 86.27886 |
| 32 | 335.2774 | 86.27886 |
| 33 | 337.6564 | 79.84939 |
| 34 | 342.1409 | 86.27884 |
| 35 | 350.1517 | 23.49139 |
| 36 | 354.6915 | 47.46948 |

TABLE 8-continued

| (Dimple Pattern 174) | | |
|---|---|---|
| | Dimple # | 2 |
| | Type | truncated |
| | Radius | 0.0525 |
| | SCD | 0.0091 |
| | TCD | 0.0035 |
| # | Phi | Theta |
| 1 | 3.606874 | 86.10963 |
| 2 | 4.773603 | 59.66486 |
| 3 | 7.485123 | 79.72027 |
| 4 | 9.566953 | 53.68971 |
| 5 | 10.81146 | 86.10963 |
| 6 | 12.08533 | 72.79786 |
| 7 | 13.37932 | 60.13101 |
| 8 | 16.66723 | 66.70139 |
| 9 | 19.58024 | 73.34845 |
| 10 | 20.76038 | 11.6909 |
| 11 | 24.53367 | 18.8166 |
| 12 | 46.81607 | 15.97349 |
| 13 | 73.18393 | 15.97349 |
| 14 | 95.46633 | 18.8166 |
| 15 | 99.23962 | 11.6909 |
| 16 | 100.4198 | 73.34845 |
| 17 | 103.3328 | 66.70139 |
| 18 | 106.6207 | 60.13101 |
| 19 | 107.9147 | 72.79786 |
| 20 | 109.1385 | 86.10963 |
| 21 | 110.433 | 53.68971 |
| 22 | 112.5149 | 79.72027 |
| 23 | 115.2264 | 59.66486 |
| 24 | 116.3931 | 86.10963 |
| 25 | 123.6069 | 86.10963 |
| 26 | 124.7736 | 59.66486 |
| 27 | 127.4851 | 79.72027 |
| 28 | 129.567 | 53.68971 |
| 29 | 130.8115 | 86.10963 |
| 30 | 132.0853 | 72.79786 |
| 31 | 133.3793 | 60.13101 |
| 32 | 136.6672 | 66.70139 |
| 33 | 139.5802 | 73.34845 |
| 34 | 140.7604 | 11.6909 |
| 35 | 144.5337 | 18.8166 |
| 36 | 166.8161 | 15.97349 |
| 37 | 193.1839 | 15.97349 |
| 38 | 215.4663 | 18.8166 |
| 39 | 219.2396 | 11.6909 |
| 40 | 220.4198 | 73.34845 |
| 41 | 223.3323 | 66.70139 |
| 42 | 226.6207 | 60.13101 |
| 43 | 227.9147 | 72.79786 |
| 44 | 229.1885 | 86.10963 |
| 45 | 230.433 | 53.68971 |
| 46 | 232.5149 | 79.72027 |
| 47 | 235.2264 | 59.66486 |
| 48 | 236.3931 | 86.10963 |
| 49 | 243.6069 | 85.10963 |
| 50 | 244.7736 | 59.66486 |
| 51 | 247.4851 | 79.72027 |
| 52 | 249.567 | 53.68971 |
| 53 | 250.8115 | 86.10963 |
| 54 | 252.0853 | 72.79786 |
| 55 | 253.3793 | 60.13101 |
| 56 | 256.6672 | 66.70139 |
| 57 | 259.5802 | 73.34845 |
| 58 | 260.7604 | 11.6909 |
| 59 | 264.5337 | 18.8166 |
| 60 | 286.8161 | 15.97349 |
| 61 | 313.1839 | 15.97349 |
| 62 | 335.4663 | 18.8166 |
| 63 | 339.2396 | 11.6909 |
| 64 | 340.4198 | 73.34845 |
| 65 | 343.3328 | 66.70139 |
| 66 | 346.6207 | 60.13101 |
| 67 | 347.9147 | 72.79786 |
| 68 | 349.1885 | 86.10963 |

TABLE 8-continued (Dimple Pattern 174)

| | | |
|---|---|---|
| 69 | 350.433 | 53.68971 |
| 70 | 352.5149 | 79.72027 |
| 71 | 355.2264 | 59.66486 |
| 72 | 356.3931 | 86.10963 |

| | | |
|---|---|---|
| | Dimple # | 3 |
| | Type | truncated |
| | Radius | 0.055 |
| | SCD | 0.0094 |
| | TCD | 0.0035 |
| # | Phi | Theta |
| 1 | 0 | 17.13539 |
| 2 | 0 | 79.62325 |
| 3 | 0 | 53.39339 |
| 4 | 8.604739 | 66.19316 |
| 5 | 15.03312 | 79.65081 |
| 6 | 60 | 9.094473 |
| 7 | 104.9669 | 79.65081 |
| 8 | 111.3953 | 66.19316 |
| 9 | 120 | 17.13539 |
| 10 | 120 | 53.39339 |
| 11 | 120 | 79.62325 |
| 12 | 128.6047 | 66.19316 |
| 13 | 135.0331 | 79.65081 |
| 14 | 180 | 9.094473 |
| 15 | 224.9669 | 79.65081 |
| 16 | 231.3953 | 66.19316 |
| 17 | 240 | 17.13539 |
| 18 | 240 | 53.39339 |
| 19 | 240 | 79.62325 |
| 20 | 248.6047 | 66.19316 |
| 21 | 255.0331 | 79.65081 |
| 22 | 300 | 9.094473 |
| 23 | 344.9669 | 79.65081 |
| 24 | 351.3953 | 66.19316 |

| | | |
|---|---|---|
| | Dimple # | 4 |
| | Type | truncated |
| | Radius | 0.0575 |
| | SCD | 0.0098 |
| | TCD | 0.0035 |
| # | Phi | Theta |
| 1 | 0 | 4.637001 |
| 2 | 0 | 65.89178 |
| 3 | 4.200798 | 72.89446 |
| 4 | 115.7992 | 72.89446 |
| 5 | 120 | 4.637001 |
| 6 | 120 | 65.89178 |
| 7 | 124.2008 | 72.89446 |
| 8 | 235.7992 | 72.89446 |
| 9 | 240 | 4.637001 |
| 10 | 240 | 65.89178 |
| 11 | 244.2008 | 72.89446 |
| 12 | 355.7992 | 72.89446 |

| | | |
|---|---|---|
| | Dimple # | 5 |
| | Type | spherical |
| | Radius | 0.075 |
| | SCD | 0.008 |
| | TCD | n/a |
| # | Phi | Theta |
| 1 | 11.39176 | 35.80355 |
| 2 | 17.86771 | 45.18952 |
| 3 | 26.35389 | 29.36327 |
| 4 | 30.46014 | 74.86406 |
| 5 | 33.84232 | 84.58637 |
| 6 | 44.16317 | 84.53634 |
| 7 | 75.83683 | 84.53634 |
| 8 | 86.15768 | 84.58637 |
| 9 | 89.53986 | 74.86406 |
| 10 | 93.64611 | 29.36327 |
| 11 | 102.1323 | 45.18952 |
| 12 | 108.6082 | 35.80355 |
| 13 | 131.3918 | 35.80355 |
| 14 | 137.8677 | 45.18952 |

TABLE 8-continued (Dimple Pattern 174)

| | | |
|---|---|---|
| 15 | 146.3539 | 29.36327 |
| 16 | 150.4601 | 74.86406 |
| 17 | 153.8423 | 84.58637 |
| 18 | 164.1632 | 84.58634 |
| 19 | 195.8368 | 84.58634 |
| 20 | 206.1577 | 84.58637 |
| 21 | 209.5399 | 74.86406 |
| 22 | 213.6461 | 29.36327 |
| 23 | 222.1323 | 45.18952 |
| 24 | 228.6082 | 35.80355 |
| 25 | 251.3913 | 35.80355 |
| 26 | 257.8677 | 45.18952 |
| 27 | 266.3539 | 29.36327 |
| 28 | 270.4601 | 74.86406 |
| 29 | 273.3423 | 84.58637 |
| 30 | 234.1632 | 84.58634 |
| 31 | 315.8368 | 84.58634 |
| 32 | 326.1577 | 84.58637 |
| 33 | 329.5399 | 74.86406 |
| 34 | 333.6461 | 29.36327 |
| 35 | 342.1323 | 45.18952 |
| 36 | 348.6082 | 35.80355 |

| | | |
|---|---|---|
| | Dimple # | 6 |
| | Type | spherical |
| | Radius | 0.0775 |
| | SCD | 0.008 |
| | TCD | n/a |
| # | Phi | Theta |
| 1 | 22.97427 | 54.90551 |
| 2 | 27.03771 | 64.89835 |
| 3 | 47.66575 | 25.59568 |
| 4 | 54.6796 | 84.41703 |
| 5 | 65.3204 | 84.41703 |
| 6 | 72.33425 | 25.59568 |
| 7 | 92.96229 | 64.89835 |
| 8 | 97.02573 | 54.90551 |
| 9 | 142.9743 | 54.90551 |
| 10 | 147.0377 | 64.89835 |
| 11 | 167.6657 | 25.59568 |
| 12 | 174.6796 | 84.41703 |
| 13 | 185.3204 | 84.41703 |
| 14 | 192.3343 | 25.59568 |
| 15 | 212.9623 | 64.89835 |
| 16 | 217.0257 | 54.90551 |
| 17 | 262.9743 | 54.90551 |
| 18 | 267.0377 | 64.89835 |
| 19 | 237.6657 | 25.59563 |
| 20 | 294.6796 | 84.41703 |
| 21 | 305.3204 | 84.41703 |
| 22 | 312.3343 | 25.59563 |
| 23 | 332.9623 | 64.89835 |
| 24 | 337.0257 | 54.90551 |

| | | |
|---|---|---|
| | Dimple # | 7 |
| | Type | spherical |
| | Radius | 0.0825 |
| | SCD | 0.008 |
| | TCD | n/a |
| # | Phi | Theta |
| 1 | 35.91413 | 51.35559 |
| 2 | 38.90934 | 62.34835 |
| 3 | 50.48062 | 36.43373 |
| 4 | 54.12044 | 73.49879 |
| 5 | 65.87956 | 73.49879 |
| 6 | 69.51938 | 36.43373 |
| 7 | 31.09066 | 62.34835 |
| 8 | 84.08587 | 51.35559 |
| 9 | 155.9141 | 51.35559 |
| 10 | 158.9093 | 62.34835 |
| 11 | 170.4806 | 36.43373 |
| 12 | 174.1204 | 73.49879 |
| 13 | 185.8796 | 73.49879 |
| 14 | 189.5194 | 36.43373 |
| 15 | 201.0907 | 62.34835 |
| 16 | 204.0859 | 51.35559 |

TABLE 8-continued

| (Dimple Pattern 174) | | |
|---|---|---|
| 17 | 275.9141 | 51.35559 |
| 18 | 278.9093 | 62.34835 |
| 19 | 290.4806 | 36.43373 |
| 20 | 294.1204 | 73.49879 |
| 21 | 305.8796 | 73.49879 |
| 22 | 309.5194 | 36.43373 |
| 23 | 321.0907 | 62.34835 |
| 24 | 324.0859 | 51.35559 |
| | Dimple # | 8 |
| | Type | spherical |
| | Radius | 0.0875 |
| | SCD | 0.008 |
| | TCD | n/a |
| # | Phi | Theta |
| 1 | 32.46033 | 39.96433 |
| 2 | 41.97126 | 73.6516 |
| 3 | 78.02874 | 73.6516 |
| 4 | 37.53967 | 39.96433 |
| 5 | 152.4603 | 39.96433 |
| 6 | 161.9713 | 73.6516 |
| 7 | 198.0287 | 73.6516 |
| 8 | 207.5397 | 39.96433 |
| 9 | 272.4603 | 39.96433 |
| 10 | 281.9713 | 73.6516 |
| 11 | 318.0287 | 73.6516 |
| 12 | 327.5397 | 39.96433 |
| | Dimple # | 9 |
| | Type | spherical |
| | Radius | 0.095 |
| | SCD | 0.008 |
| | TCD | n/a |
| # | Phi | Theta |
| 1 | 51.33861 | 48.53996 |
| 2 | 52.61871 | 61.45814 |
| 3 | 67.38129 | 61.45814 |
| 4 | 68.66139 | 48.53996 |
| 5 | 171.3386 | 48.53996 |
| 6 | 172.6187 | 61.45814 |
| 7 | 187.3813 | 61.45814 |
| 8 | 188.6614 | 48.53996 |
| 9 | 291.3386 | 48.53996 |
| 10 | 292.6137 | 61.45814 |
| 11 | 307.3813 | 61.45814 |
| 12 | 308.6614 | 48.53996 |

TABLE 9

| (Dimple Pattern 175) | | |
|---|---|---|
| | Dimple # | 1 |
| | Type | spherical |
| | Radius | 0.05 |
| | SCD | 0.008 |
| | TCD | n/a |
| # | Phi | Theta |
| 1 | 0 | 28.81007 |
| 2 | 0 | 41.7187 |
| 3 | 5.308533 | 47.46948 |
| 4 | 9.846338 | 23.49139 |
| 5 | 17.85912 | 86.27884 |
| 6 | 22.3436 | 79.34939 |
| 7 | 24.72264 | 86.27886 |
| 8 | 95.27736 | 86.27886 |
| 9 | 97.6564 | 79.84939 |
| 10 | 102.1409 | 86.27884 |
| 11 | 110.1517 | 23.49139 |
| 12 | 114.6915 | 47.46948 |
| 13 | 120 | 28.81007 |
| 14 | 120 | 41.7187 |
| 15 | 125.3085 | 47.46948 |

TABLE 9-continued

| (Dimple Pattern 175) | | |
|---|---|---|
| 16 | 129.8483 | 23.49139 |
| 17 | 137.8591 | 86.27884 |
| 18 | 142.3436 | 79.84939 |
| 19 | 144.7226 | 86.27886 |
| 20 | 215.2774 | 86.27886 |
| 21 | 217.6564 | 79.84939 |
| 22 | 222.1409 | 86.27884 |
| 23 | 230.1517 | 23.49139 |
| 24 | 234.6915 | 47.46948 |
| 25 | 240 | 23.81007 |
| 26 | 240 | 41.7187 |
| 27 | 245.3085 | 47.46948 |
| 28 | 249.8483 | 23.49139 |
| 29 | 257.8591 | 86.27884 |
| 30 | 262.3436 | 79.34939 |
| 31 | 264.7226 | 86.27886 |
| 32 | 335.2774 | 86.27886 |
| 33 | 337.6564 | 79.84939 |
| 34 | 342.1409 | 86.27884 |
| 35 | 350.1517 | 23.49139 |
| 36 | 354.6915 | 47.46948 |
| | Dimple # | 2 |
| | Type | spherical |
| | Radius | 0.0525 |
| | SCD | 0.008 |
| | TCD | n/a |
| # | Phi | Theta |
| 1 | 3.606874 | 86.10963 |
| 2 | 4.773603 | 59.66486 |
| 3 | 7.485123 | 79.72027 |
| 4 | 9.566953 | 53.68971 |
| 5 | 10.81146 | 86.10963 |
| 6 | 12.08533 | 72.79786 |
| 7 | 13.37932 | 60.13101 |
| 8 | 16.66723 | 66.70139 |
| 9 | 19.58024 | 73.34845 |
| 10 | 20.76038 | 11.6909 |
| 11 | 24.53367 | 18.8166 |
| 12 | 46.81607 | 15.97349 |
| 13 | 73.18393 | 15.97349 |
| 14 | 95.46633 | 18.8166 |
| 15 | 99.23962 | 11.6909 |
| 16 | 100.4198 | 73.34845 |
| 17 | 103.3328 | 66.70139 |
| 18 | 106.6207 | 60.13101 |
| 19 | 107.9147 | 72.79786 |
| 20 | 109.1885 | 86.10963 |
| 21 | 110.433 | 53.68971 |
| 22 | 112.5149 | 79.72027 |
| 23 | 115.2264 | 59.66486 |
| 24 | 116.3931 | 86.10963 |
| 25 | 123.6069 | 86.10963 |
| 26 | 124.7736 | 59.66486 |
| 27 | 127.4851 | 79.72027 |
| 28 | 129.567 | 53.68971 |
| 29 | 130.8115 | 86.10963 |
| 30 | 132.0853 | 72.79786 |
| 31 | 133.3793 | 60.13101 |
| 32 | 136.6672 | 66.70139 |
| 33 | 139.5802 | 73.34845 |
| 34 | 140.7604 | 11.6909 |
| 35 | 144.5337 | 18.8166 |
| 36 | 166.8161 | 15.97349 |
| 37 | 193.1839 | 15.97349 |
| 38 | 215.4663 | 18.8166 |
| 39 | 219.2396 | 11.6909 |
| 40 | 220.4198 | 73.34845 |
| 41 | 223.3323 | 66.70139 |
| 42 | 226.6207 | 60.13101 |
| 43 | 227.9147 | 72.79786 |
| 44 | 229.1885 | 86.10963 |
| 45 | 230.433 | 53.68971 |
| 46 | 232.5149 | 79.72027 |
| 47 | 235.2264 | 59.66486 |
| 48 | 236.3931 | 86.10963 |
| 49 | 243.6069 | 85.10963 |

TABLE 9-continued (Dimple Pattern 175)

| | | |
|---|---|---|
| 50 | 244.7736 | 59.66486 |
| 51 | 247.4851 | 79.72027 |
| 52 | 249.567 | 53.68971 |
| 53 | 250.8115 | 86.10963 |
| 54 | 252.0853 | 72.79786 |
| 55 | 253.3793 | 60.13101 |
| 56 | 256.6672 | 66.70139 |
| 57 | 259.5802 | 73.34845 |
| 58 | 260.7604 | 11.6909 |
| 59 | 264.5337 | 18.8166 |
| 60 | 286.8161 | 15.97349 |
| 61 | 313.1839 | 15.97349 |
| 62 | 335.4663 | 18.8166 |
| 63 | 339.2396 | 11.6909 |
| 64 | 340.4198 | 73.34845 |
| 65 | 343.3328 | 66.70139 |
| 66 | 346.6207 | 60.13101 |
| 67 | 347.9147 | 72.79786 |
| 68 | 349.1885 | 86.10963 |
| 69 | 350.433 | 53.68971 |
| 70 | 352.5149 | 79.72027 |
| 71 | 355.2264 | 59.66486 |
| 72 | 356.3931 | 86.10963 |

| | | |
|---|---|---|
| | Dimple # | 3 |
| | Type | spherical |
| | Radius | 0.055 |
| | SCD | 0.008 |
| | TCD | n/a |
| # | Phi | Theta |
| 1 | 0 | 17.13539 |
| 2 | 0 | 79.62325 |
| 3 | 0 | 53.39339 |
| 4 | 8.604739 | 66.19316 |
| 5 | 15.03312 | 79.65081 |
| 6 | 60 | 9.094473 |
| 7 | 104.9669 | 79.65081 |
| 8 | 111.3953 | 66.19316 |
| 9 | 120 | 17.13539 |
| 10 | 120 | 53.39339 |
| 11 | 120 | 79.62325 |
| 12 | 128.6047 | 66.19316 |
| 13 | 135.0331 | 79.65081 |
| 14 | 180 | 9.094473 |
| 15 | 224.9669 | 79.65081 |
| 16 | 231.3953 | 66.19316 |
| 17 | 240 | 17.13539 |
| 18 | 240 | 53.39339 |
| 19 | 240 | 79.62325 |
| 20 | 248.6047 | 66.19316 |
| 21 | 255.0331 | 79.65081 |
| 22 | 300 | 9.094473 |
| 23 | 344.9669 | 79.65081 |
| 24 | 351.3953 | 66.19316 |

| | | |
|---|---|---|
| | Dimple # | 4 |
| | Type | spherical |
| | Radius | 0.0575 |
| | SCD | 0.008 |
| | TCD | n/a |
| # | Phi | Theta |
| 1 | 0 | 4.637001 |
| 2 | 0 | 65.89178 |
| 3 | 4.200798 | 72.89446 |
| 4 | 115.7992 | 72.89446 |
| 5 | 120 | 4.637001 |
| 6 | 120 | 65.89178 |
| 7 | 124.2008 | 72.89446 |
| 8 | 235.7992 | 72.89446 |
| 9 | 240 | 4.637001 |
| 10 | 240 | 65.89178 |
| 11 | 244.2008 | 72.89446 |
| 12 | 355.7992 | 72.89446 |

TABLE 9-continued (Dimple Pattern 175)

| | | |
|---|---|---|
| | Dimple # | 5 |
| | Type | truncated |
| | Radius | 0.075 |
| | SCD | 0.012 |
| | TCD | 0.0035 |
| # | Phi | Theta |
| 1 | 11.39176 | 35.80355 |
| 2 | 17.86771 | 45.18952 |
| 3 | 26.35389 | 29.36327 |
| 4 | 30.46014 | 74.86406 |
| 5 | 33.84232 | 84.58637 |
| 6 | 44.16317 | 84.53634 |
| 7 | 75.83683 | 84.53634 |
| 8 | 86.15768 | 84.58637 |
| 9 | 89.53986 | 74.86406 |
| 10 | 93.64611 | 29.36327 |
| 11 | 102.1323 | 45.18952 |
| 12 | 108.6082 | 35.80355 |
| 13 | 131.3918 | 35.80355 |
| 14 | 137.8677 | 45.18952 |
| 15 | 146.3539 | 29.36327 |
| 16 | 150.4601 | 74.86406 |
| 17 | 153.3423 | 84.58637 |
| 18 | 164.1632 | 84.58634 |
| 19 | 195.8368 | 84.58634 |
| 20 | 206.1577 | 84.58637 |
| 21 | 209.5399 | 74.86406 |
| 22 | 213.6461 | 29.36327 |
| 23 | 222.1323 | 45.18952 |
| 24 | 228.6082 | 35.80355 |
| 25 | 251.3918 | 35.80355 |
| 26 | 257.8677 | 45.18952 |
| 27 | 266.3539 | 29.36327 |
| 28 | 270.4601 | 74.86406 |
| 29 | 273.8423 | 84.58637 |
| 30 | 234.1632 | 84.58634 |
| 31 | 315.8368 | 84.58634 |
| 32 | 326.1577 | 84.58637 |
| 33 | 329.5399 | 74.86406 |
| 34 | 333.6461 | 29.36327 |
| 35 | 342.1323 | 45.18952 |
| 36 | 348.6082 | 35.80355 |

| | | |
|---|---|---|
| | Dimple # | 6 |
| | Type | truncated |
| | Radius | 0.0775 |
| | SCD | 0.0122 |
| | TCD | 0.0035 |
| # | Phi | Theta |
| 1 | 22.97427 | 54.90551 |
| 2 | 27.03771 | 64.89835 |
| 3 | 47.66575 | 25.59568 |
| 4 | 54.6796 | 84.41703 |
| 5 | 65.3204 | 84.41703 |
| 6 | 72.33425 | 25.59568 |
| 7 | 92.96229 | 64.89835 |
| 8 | 97.02573 | 54.90551 |
| 9 | 142.9743 | 54.90551 |
| 10 | 147.0377 | 64.89835 |
| 11 | 167.6657 | 25.59568 |
| 12 | 174.6796 | 84.41703 |
| 13 | 185.3204 | 84.41703 |
| 14 | 192.3343 | 25.59568 |
| 15 | 212.9623 | 64.89835 |
| 16 | 217.0257 | 54.90551 |
| 17 | 262.9743 | 54.90551 |
| 18 | 267.0377 | 64.89835 |
| 19 | 287.6657 | 25.59568 |
| 20 | 294.6796 | 84.41703 |
| 21 | 305.3204 | 84.41703 |
| 22 | 312.3343 | 25.59563 |
| 23 | 332.9623 | 64.89835 |
| 24 | 337.0257 | 54.90551 |

TABLE 9-continued (Dimple Pattern 175)

| | | |
|---|---|---|
| | Dimple # | 7 |
| | Type | truncated |
| | Radius | 0.0825 |
| | SCD | 0.0128 |
| | TCD | 0.0035 |
| # | Phi | Theta |
| 1 | 35.91413 | 51.35559 |
| 2 | 38.90934 | 62.34835 |
| 3 | 50.48062 | 36.43373 |
| 4 | 54.12044 | 73.49879 |
| 5 | 65.87956 | 73.49879 |
| 6 | 69.51938 | 36.43373 |
| 7 | 81.09066 | 62.34835 |
| 8 | 84.08587 | 51.35559 |
| 9 | 155.9141 | 51.35559 |
| 10 | 158.9093 | 62.34835 |
| 11 | 170.4806 | 36.43373 |
| 12 | 174.1204 | 73.49879 |
| 13 | 185.8796 | 73.49879 |
| 14 | 189.5194 | 36.43373 |
| 15 | 201.0907 | 62.34835 |
| 16 | 204.0859 | 51.35559 |
| 17 | 275.9141 | 51.35559 |
| 18 | 278.9093 | 62.34835 |
| 19 | 290.4806 | 36.43373 |
| 20 | 294.1204 | 73.49879 |
| 21 | 305.8796 | 73.49879 |
| 22 | 309.5194 | 36.43373 |
| 23 | 321.0907 | 62.34835 |
| 24 | 324.0859 | 51.35559 |

| | | |
|---|---|---|
| | Dimple # | 8 |
| | Type | truncated |
| | Radius | 0.0875 |
| | SCD | 0.0133 |
| | TCD | 0.0035 |
| # | Phi | Theta |
| 1 | 32.46033 | 39.96433 |
| 2 | 41.97126 | 73.6516 |
| 3 | 78.02874 | 73.6516 |
| 4 | 87.53967 | 39.96433 |
| 5 | 152.4603 | 39.96433 |
| 6 | 161.9713 | 73.6516 |
| 7 | 198.0287 | 73.6516 |
| 8 | 207.5397 | 39.96433 |
| 9 | 272.4603 | 39.96433 |
| 10 | 281.9713 | 73.6516 |
| 11 | 318.0287 | 73.6516 |
| 12 | 327.5397 | 39.96433 |

| | | |
|---|---|---|
| | Dimple # | 9 |
| | Type | truncated |
| | Radius | 0.095 |
| | SCD | 0.014 |
| | TCD | 0.0035 |
| # | Phi | Theta |
| 1 | 51.33861 | 48.53996 |
| 2 | 52.61871 | 61.45814 |
| 3 | 67.38129 | 61.45814 |
| 4 | 68.66139 | 48.53996 |
| 5 | 171.3386 | 48.53996 |
| 6 | 172.6187 | 61.45814 |
| 7 | 187.3813 | 61.45814 |
| 8 | 188.6614 | 48.53996 |
| 9 | 291.3386 | 48.53996 |
| 10 | 292.6187 | 61.45814 |
| 11 | 307.3813 | 61.45814 |
| 12 | 308.6614 | 48.53996 |

TABLE 10

(Dimple Pattern 273

| | | |
|---|---|---|
| | Dimple # | 1 |
| | Type | truncated |
| | Radius | 0.0750 |
| | SCD | 0.0132 |
| | TCD | 0.0050 |
| # | Phi | Theta |
| 1 | 0 | 25.85946 |
| 2 | 120 | 25.85946 |
| 3 | 240 | 25.85946 |
| 4 | 22.29791 | 84.58636 |
| 5 | 1.15E−13 | 44.66932 |
| 6 | 337.7021 | 84.58636 |
| 7 | 142.2979 | 84.58636 |
| 8 | 120 | 44.66932 |
| 9 | 457.7021 | 84.58636 |
| 10 | 262.2979 | 84.58636 |
| 11 | 240 | 44.66932 |
| 12 | 577.7021 | 84.58636 |

| | | |
|---|---|---|
| | Dimple # | 2 |
| | Type | truncated |
| | Radius | 0.0800 |
| | SCD | 0.0138 |
| | TCD | 0.0050 |
| # | Phi | Theta |
| 1 | 19.46456 | 17.6616 |
| 2 | 100.5354 | 17.6616 |
| 3 | 139.4646 | 17.6616 |
| 4 | 220.5354 | 17.6616 |
| 5 | 259.4646 | 17.6616 |
| 6 | 340.5354 | 17.6616 |
| 7 | 18.02112 | 74.614 |
| 8 | 7.175662 | 54.03317 |
| 9 | 352.8243 | 54.03317 |
| 10 | 341.9789 | 74.614 |
| 11 | 348.5695 | 84.24771 |
| 12 | 11.43052 | 84.24771 |
| 13 | 138.0211 | 74.614 |
| 14 | 127.1757 | 54.03317 |
| 15 | 472.8243 | 54.03317 |
| 16 | 461.9789 | 74.614 |
| 17 | 468.5695 | 84.24771 |
| 18 | 131.4305 | 84.24771 |
| 19 | 258.0211 | 74.614 |
| 20 | 247.1757 | 54.03317 |
| 21 | 592.8243 | 54.03317 |
| 22 | 581.9789 | 74.614 |
| 23 | 588.5695 | 84.24771 |
| 24 | 251.4305 | 84.24771 |

| | | |
|---|---|---|
| | Dimple # | 3 |
| | Type | truncated |
| | Radius | 0.0825 |
| | SCD | 0.0141 |
| | TCD | 0.0050 |
| # | Phi | Theta |
| 1 | 0 | 6.707467 |
| 2 | 60 | 13.5496 |
| 3 | 120 | 6.707467 |
| 4 | 180 | 13.5496 |
| 5 | 240 | 6.707467 |
| 6 | 300 | 13.5496 |
| 7 | 6.04096 | 73.97888 |
| 8 | 13.01903 | 64.24653 |
| 9 | 2.41E−14 | 63.82131 |
| 10 | 346.981 | 64.24653 |
| 11 | 353.959 | 73.97888 |
| 12 | 360 | 84.07838 |
| 13 | 126.041 | 73.97888 |
| 14 | 133.019 | 64.24653 |
| 15 | 120 | 63.82131 |
| 16 | 466.981 | 64.24653 |
| 17 | 473.959 | 73.97888 |
| 18 | 480 | 84.07838 |
| 19 | 246.041 | 73.97888 |

TABLE 10-continued (Dimple Pattern 273

| | | |
|---|---|---|
| 20 | 253.019 | 64.24653 |
| 21 | 240 | 63.82131 |
| 22 | 586.981 | 64.24653 |
| 23 | 593.959 | 73.97888 |
| 24 | 600 | 84.07838 |

| | | |
|---|---|---|
| | Dimple # | 4 |
| | Type | spherical |
| | Radius | 0.0550 |
| | SCD | 0.0075 |
| | TCD | — |
| # | Phi | Theta |
| 1 | 89.81848 | 78.25196 |
| 2 | 92.38721 | 71.10446 |
| 3 | 95.11429 | 63.96444 |
| 4 | 105.6986 | 42.86305 |
| 5 | 101.558 | 49.81178 |
| 6 | 98.11364 | 56.8624 |
| 7 | 100.3784 | 30.02626 |
| 8 | 86.62335 | 26.05789 |
| 9 | 69.339 | 23.82453 |
| 10 | 19.62155 | 30.03626 |
| 11 | 33.37665 | 26.05789 |
| 12 | 50.601 | 23.82453 |
| 13 | 14.30135 | 42.86305 |
| 14 | 18.44204 | 49.81178 |
| 15 | 21.38636 | 56.8624 |
| 16 | 38.18152 | 78.25196 |
| 17 | 27.61279 | 71.10446 |
| 18 | 24.88571 | 63.96444 |
| 19 | 41.03508 | 85.94042 |
| 20 | 48.61817 | 85.94042 |
| 21 | 56.20813 | 85.94042 |
| 22 | 78.96492 | 85.94042 |
| 23 | 71.38183 | 85.94042 |
| 24 | 63.79187 | 85.94042 |
| 25 | 209.8185 | 78.25196 |
| 26 | 212.3872 | 71.10446 |
| 27 | 215.1143 | 63.96444 |
| 28 | 225.6986 | 42.86305 |
| 29 | 221.558 | 49.81178 |
| 30 | 218.1136 | 56.8624 |
| 31 | 220.3784 | 30.02626 |
| 32 | 206.6234 | 26.05789 |
| 33 | 189.399 | 23.82453 |
| 34 | 139.6216 | 30.02626 |
| 35 | 153.3765 | 26.05789 |
| 36 | 170.601 | 23.82453 |
| 37 | 134.3014 | 42.86305 |
| 38 | 133.442 | 49.81178 |
| 39 | 141.8864 | 66.8624 |
| 40 | 150.1815 | 78.25196 |
| 41 | 147.6128 | 71.10446 |
| 42 | 144.8857 | 53.96444 |
| 43 | 161.0351 | 85.94042 |
| 44 | 168.6182 | 85.94042 |
| 45 | 176.2081 | 85.94042 |
| 46 | 198.9649 | 85.94042 |
| 47 | 191.3818 | 85.94042 |
| 48 | 193.7919 | 85.94042 |
| 49 | 329.8185 | 78.25196 |
| 50 | 332.3872 | 71.10446 |
| 51 | 335.1143 | 63.96444 |
| 52 | 345.6986 | 42.86305 |
| 53 | 341.558 | 49.81178 |
| 54 | 338.1136 | 56.8624 |
| 55 | 340.3784 | 30.02626 |
| 56 | 326.6234 | 26.05789 |
| 57 | 309.399 | 23.82453 |
| 58 | 259.6216 | 30.02626 |
| 59 | 273.3765 | 26.05789 |
| 60 | 290.601 | 23.82453 |
| 61 | 254.3014 | 42.86305 |
| 62 | 258.442 | 49.81178 |
| 63 | 261.8864 | 56.8624 |
| 64 | 270.1815 | 78.25196 |
| 65 | 267.6128 | 71.10446 |

TABLE 10-continued (Dimple Pattern 273

| | | |
|---|---|---|
| 66 | 264.8857 | 63.36444 |
| 67 | 281.0351 | 85.94042 |
| 68 | 288.6182 | 85.94042 |
| 69 | 296.2081 | 85.94042 |
| 70 | 318.9649 | 85.94042 |
| 71 | 311.3919 | 85.94042 |
| 72 | 303.7919 | 85.94042 |

| | | |
|---|---|---|
| | Dimple # | 5 |
| | Type | spherical |
| | Radius | 0.0575 |
| | SCD | 0.0075 |
| | TCD | — |
| # | Phi | Theta |
| 1 | 83.35856 | 69.4058 |
| 2 | 85.57977 | 61.65549 |
| 3 | 91.04137 | 46.06539 |
| 4 | 88.0815 | 53.82973 |
| 5 | 81.86535 | 34.37733 |
| 6 | 67.54444 | 32.56834 |
| 7 | 38.13465 | 34.37733 |
| 8 | 52.45556 | 32.56834 |
| 9 | 28.95863 | 46.06539 |
| 10 | 31.9185 | 53.02973 |
| 11 | 36.64144 | 69.4858 |
| 12 | 34.42023 | 61.65549 |
| 13 | 47.55421 | 77.35324 |
| 14 | 55.84333 | 77.16119 |
| 15 | 72.44579 | 77.35324 |
| 16 | 64.15697 | 77.16119 |
| 17 | 203.3586 | 69.4858 |
| 18 | 205.5798 | 61.65549 |
| 19 | 211.0414 | 46.06539 |
| 20 | 200.0815 | 53.82973 |
| 21 | 201.8653 | 34.37733 |
| 22 | 187.5444 | 32.56834 |
| 23 | 158.1347 | 34.37733 |
| 24 | 172.4556 | 32.56834 |
| 25 | 148.9586 | 46.06539 |
| 26 | 151.9185 | 53.82973 |
| 27 | 156.6414 | 69.4858 |
| 28 | 154.4202 | 61.65549 |
| 29 | 167.5642 | 77.35324 |
| 30 | 175.843 | 77.16119 |
| 31 | 192.4458 | 77.35324 |
| 32 | 184.157 | 77.16119 |
| 33 | 323.3586 | 69.4858 |
| 34 | 325.5798 | 61.65549 |
| 35 | 331.0414 | 46.06539 |
| 36 | 328.0815 | 53.82973 |
| 37 | 321.8653 | 34.37733 |
| 38 | 307.5444 | 32.56834 |
| 39 | 278.1347 | 34.37733 |
| 40 | 292.4556 | 32.56834 |
| 41 | 268.9586 | 46.06539 |
| 42 | 271.9185 | 53.82973 |
| 43 | 275.6414 | 69.4858 |
| 44 | 274.4202 | 61.65549 |
| 45 | 287.5542 | 77.35324 |
| 46 | 295.843 | 77.16119 |
| 47 | 312.4458 | 77.35324 |
| 48 | 304.157 | 77.16119 |

| | | |
|---|---|---|
| | Dimple # | 6 |
| | Type | spherical |
| | Radius | 0.0600 |
| | SCD | 0.0075 |
| | TCD | — |
| # | Phi | Theta |
| 1 | 86.88247 | 85.60198 |
| 2 | 110.7202 | 35.62098 |
| 3 | 9.279821 | 35.62098 |
| 4 | 33.11753 | 85.60198 |
| 5 | 206.8825 | 85.60198 |
| 6 | 230.7202 | 35.62098 |
| 7 | 129.2798 | 35.62098 |

TABLE 10-continued (Dimple Pattern 273

| | | |
|---|---|---|
| 8 | 153.1175 | 85.60198 |
| 9 | 326.8825 | 85.60198 |
| 10 | 350.7202 | 35.62098 |
| 11 | 249.2798 | 35.62098 |
| 12 | 273.1175 | 85.60198 |

| | | |
|---|---|---|
| | Dimple # | 7 |
| | Type | spherical |
| | Radius | 0.0625 |
| | SCD | 0.0075 |
| | TCD | — |
| # | Phi | Theta |
| 1 | 80.92949 | 77.43144 |
| 2 | 76.22245 | 60.1768 |
| 3 | 77.98598 | 51.7127 |
| 4 | 94.40845 | 38.09724 |
| 5 | 66.573 | 40.85577 |
| 6 | 53.427 | 40.85577 |
| 7 | 25.59155 | 38.09724 |
| 8 | 42.01402 | 51.7127 |
| 9 | 43.77755 | 60.1763 |
| 10 | 39.07051 | 77.43144 |
| 11 | 55.39527 | 68.86469 |
| 12 | 64.60473 | 68.86469 |
| 13 | 200.9295 | 77.43144 |
| 14 | 196.2224 | 60.1768 |
| 15 | 197.986 | 51.7127 |
| 16 | 214.4085 | 38.09724 |
| 17 | 186.573 | 40.85577 |
| 18 | 173.427 | 40.85577 |
| 19 | 145.5915 | 38.09724 |
| 20 | 162.014 | 51.7127 |
| 21 | 163.7776 | 60.1768 |
| 22 | 159.0705 | 77.43144 |
| 23 | 175.3953 | 68.86469 |
| 24 | 184.6047 | 68.86469 |
| 25 | 320.9295 | 77.43144 |
| 26 | 316.2224 | 60.1768 |
| 27 | 317.986 | 51.7127 |
| 28 | 334.4085 | 38.09724 |
| 29 | 306.573 | 40.85577 |
| 30 | 293.427 | 40.85577 |
| 31 | 265.5915 | 38.09724 |
| 32 | 282.014 | 51.7127 |
| 33 | 283.7776 | 60.1768 |
| 34 | 279.0705 | 77.43144 |
| 35 | 295.3953 | 68.86469 |
| 36 | 304.6047 | 68.86469 |

| | | |
|---|---|---|
| | Dimple # | 8 |
| | Type | spherical |
| | Radius | 00675 |
| | SCD | 0.0075 |
| | TCD | — |
| # | Phi | Theta |
| 1 | 74.18416 | 68.92141 |
| 2 | 79.64177 | 42.85974 |
| 3 | 40.35823 | 42.85974 |
| 4 | 45.81584 | 68.92141 |
| 5 | 194.1842 | 68.92141 |
| 6 | 199.6418 | 42.85974 |
| 7 | 160.3582 | 42.85974 |
| 8 | 165.8158 | 68.92141 |
| 9 | 314.1842 | 68.92141 |
| 10 | 319.6418 | 42.85974 |
| 11 | 280.3582 | 42.85974 |
| 12 | 285.8158 | 68.92141 |

TABLE 10-continued (Dimple Pattern 273

| | | |
|---|---|---|
| | Dimple # | 9 |
| | Type | spherical |
| | Radius | 0.0700 |
| | SCD | 0.0075 |
| | TCD | — |
| # | Phi | Theta |
| 1 | 65.60484 | 59.710409 |
| 2 | 66.31567 | 50.052318 |
| 3 | 53.68433 | 50.052318 |
| 4 | 54.39516 | 59.710409 |
| 5 | 185.6048 | 59.710409 |
| 6 | 186.3157 | 50.052318 |
| 7 | 173.6843 | 50.052318 |
| 8 | 174.3952 | 59.710409 |
| 9 | 305.6048 | 59.710409 |
| 10 | 306.3157 | 50.052318 |
| 11 | 293.6843 | 50.052318 |
| 12 | 294.3952 | 59.710409 |

TABLE 11

(Dimple Pattern 2-3)

| | | |
|---|---|---|
| | Dimple # | 1 |
| | Type | spherical |
| | Radius | 0.0550 |
| | SCD | 0.0080 |
| | TCD | — |
| # | Phi | Theta |
| 1 | 89.818 | 78.252 |
| 2 | 92.387 | 71.104 |
| 3 | 95.114 | 63.964 |
| 4 | 105.699 | 42.863 |
| 5 | 101.558 | 49.812 |
| 6 | 98.114 | 56.862 |
| 7 | 100.378 | 30.026 |
| 8 | 86.623 | 26.058 |
| 9 | 69.3989 | 23.825 |
| 10 | 19.622 | 30.026 |
| 11 | 33.377 | 26.858 |
| 12 | 50.601 | 29.825 |
| 13 | 14.301 | 42.863 |
| 14 | 18.442 | 49.812 |
| 15 | 21.886 | 56.862 |
| 16 | 30.182 | 78.252 |
| 17 | 27.613 | 71.104 |
| 18 | 24.886 | 63.964 |
| 19 | 41.035 | 85.940 |
| 20 | 48.618 | 85.940 |
| 21 | 56.208 | 85.940 |
| 22 | 78.985 | 85.940 |
| 23 | 71.382 | 85.940 |
| 24 | 63.792 | 85.940 |
| 25 | 209.818 | 78.252 |
| 26 | 212.387 | 71.104 |
| 27 | 215.114 | 63.964 |
| 28 | 225.699 | 42.863 |
| 29 | 221.558 | 49.812 |
| 30 | 218.114 | 56.862 |
| 31 | 220.376 | 30.026 |
| 32 | 206.623 | 26.058 |
| 33 | 189.399 | 23.825 |
| 34 | 149.622 | 30.026 |
| 35 | 153.377 | 26.058 |
| 36 | 170.601 | 23.825 |
| 37 | 134.301 | 42.863 |
| 38 | 130.442 | 49.812 |
| 39 | 141.885 | 56.862 |
| 40 | 150.182 | 78.252 |
| 41 | 147.613 | 71.104 |
| 42 | 144.886 | 63.954 |
| 43 | 161.035 | 85.940 |
| 44 | 168.618 | 85.940 |

TABLE 11-continued (Dimple Pattern 2-3)

| | | |
|---|---|---|
| 45 | 176.208 | 85.940 |
| 46 | 198.965 | 85.940 |
| 47 | 191.382 | 85.940 |
| 48 | 183.792 | 85.940 |
| 49 | 329.818 | 78.252 |
| 50 | 332.387 | 71.104 |
| 51 | 335.114 | 63.964 |
| 52 | 345.699 | 42.863 |
| 53 | 341.558 | 49.812 |
| 54 | 338.114 | 56.862 |
| 55 | 340.378 | 30.026 |
| 56 | 326.623 | 26.058 |
| 57 | 309.399 | 23.825 |
| 58 | 259.622 | 30.026 |
| 59 | 273.377 | 26.058 |
| 60 | 290.601 | 23.825 |
| 61 | 254.301 | 42.863 |
| 62 | 258.442 | 49.812 |
| 63 | 261.886 | 56.862 |
| 64 | 270.182 | 78.252 |
| 65 | 267.613 | 71.104 |
| 66 | 264.886 | 63.964 |
| 67 | 281.035 | 85.940 |
| 68 | 288.618 | 85.940 |
| 69 | 296.208 | 85.940 |
| 70 | 318.965 | 85.940 |
| 71 | 311.382 | 85.940 |
| 72 | 303.792 | 85.940 |

| | Dimple # | 2 |
|---|---|---|
| | Type | spherical |
| | Radius | 0.0575 |
| | SCD | 0.0080 |
| | TCD | — |
| # | Phi | Theta |
| 1 | 83.359 | 69.486 |
| 2 | 85.580 | 61.655 |
| 3 | 91.041 | 46.065 |
| 4 | 88.081 | 53.830 |
| 5 | 81.865 | 34.377 |
| 6 | 67.544 | 32.568 |
| 7 | 38.135 | 34.377 |
| 8 | 52.456 | 32.568 |
| 9 | 28.959 | 46.065 |
| 10 | 31.919 | 53.830 |
| 11 | 36.641 | 69.486 |
| 12 | 34.420 | 61.655 |
| 13 | 47.554 | 77.353 |
| 14 | 55.843 | 77.161 |
| 15 | 72.446 | 77.363 |
| 16 | 64.157 | 77.161 |
| 17 | 203.359 | 69.485 |
| 18 | 205.580 | 51.655 |
| 19 | 211.041 | 46.065 |
| 20 | 208.081 | 53.830 |
| 21 | 201.865 | 34.377 |
| 22 | 187.544 | 32.568 |
| 23 | 158.135 | 34.377 |
| 24 | 172.456 | 32.568 |
| 25 | 148.959 | 46.065 |
| 26 | 151.919 | 53.830 |
| 27 | 156.641 | 63.486 |
| 28 | 154.420 | 61.655 |
| 29 | 167.554 | 77.353 |
| 30 | 175.843 | 77.161 |
| 31 | 132.446 | 77.353 |
| 32 | 184.157 | 77.161 |
| 33 | 323.359 | 63.486 |
| 34 | 325.580 | 61.655 |
| 35 | 331.041 | 46.065 |
| 36 | 328.081 | 53.830 |
| 37 | 321.865 | 34.377 |
| 38 | 307.544 | 32.568 |
| 39 | 278.135 | 34.377 |
| 40 | 292.456 | 32.568 |
| 41 | 268.959 | 46.065 |
| 42 | 271.919 | 53.830 |

TABLE 11-continued (Dimple Pattern 2-3)

| | | |
|---|---|---|
| 43 | 276.641 | 69.486 |
| 44 | 274.420 | 61.655 |
| 45 | 287.554 | 77.353 |
| 46 | 295.843 | 77.161 |
| 47 | 312.446 | 77.363 |
| 48 | 304.157 | 77.161 |

| | Dimple # | 3 |
|---|---|---|
| | Type | spherical |
| | Radius | 0.0600 |
| | SCD | 0.0080 |
| | TCD | — |
| # | Phi | Theta |
| 1 | 86.882 | 85.602 |
| 2 | 110.720 | 35.621 |
| 3 | 9.280 | 35.621 |
| 4 | 33.116 | 85.602 |
| 5 | 205.882 | 85.602 |
| 6 | 230.720 | 35.621 |
| 7 | 129.280 | 35.621 |
| 8 | 153.118 | 85.602 |
| 9 | 326.682 | 85.602 |
| 10 | 350.720 | 35.621 |
| 11 | 249.280 | 35.621 |
| 12 | 273.118 | 85.602 |

| | Dimple # | 4 |
|---|---|---|
| | Type | spherical |
| | Radius | 0.0625 |
| | SCD | 0.0080 |
| | TCD | — |
| # | Phi | Theta |
| 1 | 80.929 | 77.431 |
| 2 | 76.222 | 60.177 |
| 3 | 77.986 | 51.713 |
| 4 | 94.408 | 38.097 |
| 5 | 66.573 | 40.856 |
| 6 | 53.427 | 40.856 |
| 7 | 25.592 | 38.097 |
| 8 | 42.014 | 51.713 |
| 9 | 43.778 | 60.177 |
| 10 | 39.071 | 77.431 |
| 11 | 55.395 | 68.865 |
| 12 | 64.605 | 68.865 |
| 13 | 200.929 | 77.431 |
| 14 | 196.222 | 60.177 |
| 15 | 197.986 | 51.717 |
| 16 | 214.408 | 38.097 |
| 17 | 136.573 | 40.856 |
| 18 | 173.427 | 40.856 |
| 19 | 145.592 | 38.097 |
| 20 | 162.014 | 51.713 |
| 21 | 163.778 | 60.177 |
| 22 | 159.071 | 77.431 |
| 23 | 175.395 | 68.865 |
| 24 | 184.605 | 68.865 |
| 25 | 320.929 | 77.431 |
| 26 | 316.222 | 60.177 |
| 27 | 317.986 | 51.713 |
| 28 | 334.408 | 38.037 |
| 29 | 306.573 | 40.856 |
| 30 | 293.427 | 40.856 |
| 31 | 265.592 | 38.097 |
| 32 | 282.014 | 51.713 |
| 33 | 233.778 | 60.177 |
| 34 | 279.071 | 77.431 |
| 35 | 295.395 | 68.865 |
| 36 | 304.605 | 68.865 |

TABLE 11-continued (Dimple Pattern 2-3)

| | | |
|---|---|---|
| | Dimple # | 5 |
| | Type | spherical |
| | Radius | 0.0675 |
| | SCD | 0.0080 |
| | TCD | — |
| # | Phi | Theta |
| 1 | 74.184 | 68.921 |
| 2 | 79.642 | 42.860 |
| 3 | 40.358 | 42.860 |
| 4 | 45.816 | 68.921 |
| 5 | 194.184 | 68.921 |
| 6 | 199.642 | 42.860 |
| 7 | 160.358 | 42.860 |
| 8 | 165.816 | 68.921 |
| 9 | 314.184 | 68.921 |
| 10 | 319.842 | 42.860 |
| 11 | 280.358 | 42.860 |
| 12 | 285.816 | 68.921 |
| | Dimple # | 6 |
| | Type | spherical |
| | Radius | 0.0700 |
| | SCD | 0.0080 |
| | TCD | — |
| # | Phi | Theta |
| 1 | 65.605 | 59.710 |
| 2 | 66.316 | 50.052 |
| 3 | 53.684 | 50.052 |
| 4 | 54.395 | 59.710 |
| 5 | 185.605 | 59.710 |
| 6 | 186.316 | 50.052 |
| 7 | 173.634 | 50.052 |
| 8 | 174.395 | 59.710 |
| 9 | 305.605 | 59.710 |
| 10 | 306.316 | 50.052 |
| 11 | 293.684 | 50.052 |
| 12 | 294.395 | 59.710 |
| | Dimple # | 7 |
| | Type | truncated |
| | Radius | 0.0750 |
| | SCD | 0.0132 |
| | TCD | 0.0055 |
| # | Phi | Theta |
| 1 | 0.000 | 25.859 |
| 2 | 120.000 | 25.859 |
| 3 | 240.000 | 25.859 |
| 4 | 22.298 | 84.586 |
| 5 | 0.000 | 44.669 |
| 6 | 337.702 | 84.586 |
| 7 | 142.298 | 84.586 |
| 8 | 120.000 | 44.669 |
| 9 | 457.702 | 84.586 |
| 10 | 262.298 | 84.586 |
| 11 | 240.000 | 44.659 |
| 12 | 577.702 | 84.586 |
| | Dimple # | 8 |
| | Type | truncated |
| | Radius | 0.0800 |
| | SCD | 0.0138 |
| | TCD | 0.0055 |
| # | Phi | Theta |
| 1 | 19.465 | 17.662 |
| 2 | 100.535 | 17.662 |
| 3 | 139.465 | 17.662 |
| 4 | 220.535 | 17.662 |
| 5 | 259.465 | 17.662 |
| 6 | 340.535 | 17.662 |
| 7 | 18.021 | 74.614 |
| 8 | 7.176 | 54.033 |
| 9 | 352.824 | 54.033 |
| 10 | 341.979 | 74.614 |
| 11 | 348.569 | 84.248 |

TABLE 11-continued (Dimple Pattern 2-3)

| | | |
|---|---|---|
| 12 | 11.431 | 84.248 |
| 13 | 138.021 | 74.614 |
| 14 | 127.176 | 54.033 |
| 15 | 472.824 | 54.033 |
| 16 | 461.979 | 74.614 |
| 17 | 468.569 | 84.248 |
| 18 | 131.431 | 84.248 |
| 19 | 258.021 | 74.614 |
| 20 | 247.176 | 54.033 |
| 21 | 592.824 | 54.033 |
| 22 | 581.979 | 74.614 |
| 23 | 588.569 | 84.248 |
| 24 | 251.431 | 84.248 |
| | Dimple # | 9 |
| | Type | truncated |
| | Radius | 0.0825 |
| | SCD | 0.0141 |
| | TCD | 0.0055 |
| # | Phi | Theta |
| 1 | 0.000 | 6.707 |
| 2 | 60.000 | 13.550 |
| 3 | 120.000 | 6.707 |
| 4 | 180.000 | 13.550 |
| 5 | 240.000 | 6.707 |
| 6 | 300.000 | 13.550 |
| 7 | 6.041 | 73.979 |
| 8 | 13.019 | 64.247 |
| 9 | 0.000 | 63.821 |
| 10 | 346.931 | 64.247 |
| 11 | 353.959 | 73.979 |
| 12 | 360.000 | 84.078 |
| 13 | 126.041 | 73.979 |
| 14 | 133.019 | 64.247 |
| 15 | 120.000 | 63.821 |
| 16 | 466.981 | 64.247 |
| 17 | 473.959 | 73.979 |
| 18 | 480.000 | 84.078 |
| 19 | 246.041 | 73.979 |
| 20 | 355.019 | 64.247 |
| 21 | 240.000 | 63.821 |
| 22 | 586.981 | 64.247 |
| 23 | 593.959 | 73.979 |
| 24 | 600.000 | 84.078 |

The geometric and dimple patterns 172-175, 273 and 2-3 described above have been shown to reduce dispersion. Moreover, the geometric and dimple patterns can be selected to achieve lower dispersion based on other ball design parameters as well. For example, for the case of a golf ball that is constructed in such a way as to generate relatively low driver spin, a cuboctahedral dimple pattern with the dimple profiles of the 172-175 series golf balls, shown in Table 5, or the 273 and 2-3 series golf balls shown in Tables 10 and 11, provides for a spherically symmetrical golf ball having less dispersion than other golf balls with similar driver spin rates. This translates into a ball that slices less when struck in such a way that the ball's spin axis corresponds to that of a slice shot. To achieve lower driver spin, a ball can be constructed from e.g., a cover made from an ionomer resin utilizing high-performance ethylene copolymers containing acid groups partially neutralized by using metal salts such as zinc, sodium and others and having a rubber-based core, such as constructed from, for example, a hard Dupont™ Surlyn® covered two-piece ball with a polybutadiene rubber-based core such as the TopFlite XL Straight or a three-piece ball construction with a soft thin cover, e.g., less than about 0.04 inches, with a relatively high flexural modulus mantle layer and with a polybutadiene rubber-based core such as the Titleist ProV1®.

Similarly, when certain dimple pattern and dimple profiles describe above are used on a ball constructed to generate relatively high driver spin, a spherically symmetrical golf ball that has the short iron control of a higher spinning golf ball and when imparted with a relatively high driver spin causes the golf ball to have a trajectory similar to that of a driver shot trajectory for most lower spinning golf balls and yet will have the control around the green more like a higher spinning golf ball is produced. To achieve higher driver spin, a ball can be constructed from e.g., a soft Dupont™ Surlyn® covered two-piece ball with a hard polybutadiene rubber-based core or a relatively hard Dupont™ Surlyn® covered two-piece ball with a plastic core made of 30-100% DuPont™ HPF 2000®, or a three-piece ball construction with a soft thicker cove, e.g., greater than about 0.04 inches, with a relatively stiff mantle layer and with a polybutadiene rubber-based core.

It should be appreciated that the dimple patterns and dimple profiles used for 172-175, 273, and 2-3 series golf balls causes these golf balls to generate a lower lift force under various conditions of flight, and reduces the slice dispersion.

Golf balls dimple patterns 172-175 were subjected to several tests under industry standard laboratory conditions to demonstrate the better performance that the dimple configurations described herein obtain over competing golf balls. In these tests, the flight characteristics and distance performance for golf balls with the 173-175 dimple patterns were conducted and compared with a Titleist Pro V1® made by Acushnet. Also, each of the golf balls with the 172-175 patterns were tested in the Poles-Forward-Backward (PFB) and Pole Horizontal (PH) orientations. The Pro V1® being a USGA conforming ball and thus known to be spherically symmetrical was tested in no particular orientation (random orientation). Golf balls with the 172-175 patterns were all made from basically the same materials and had a standard polybutadiene-based rubber core having 90-105 compression with 45-55 Shore D hardness. The cover was a Surlyn™ blend (38% 9150, 38% 8150, 24% 6320) with a 58-62 Shore D hardness, with an overall ball compression of approximately 110-115.

The tests were conducted with a "Golf Laboratories" robot and hit with the same Taylor Made® driver at varying club head speeds. The Taylor Made® driver had a 10.5° r7 425 club head with a lie angle of 54 degrees and a REAX 65 'R' shaft. The golf balls were hit in a random-block order, approximately 18-20 shots for each type ball-orientation combination. Further, the balls were tested under conditions to simulate a 20-25 degree slice, e.g., a negative spin axis of 20-25 degrees.

The testing revealed that the 172-175 dimple patterns produced a ball speed of about 125 miles per hour, while the Pro V1® produced a ball speed of between 127 and 128 miles per hour.

The data for each ball with patterns 172-175 also indicates that velocity is independent of orientation of the golf balls on the tee.

The testing also indicated that the 172-175 patterns had a total spin of between 4200 rpm and 4400 rpm, whereas the Pro V1® had a total spin of about 4000 rpm. Thus, the core/cover combination used for balls with the 172-175 patterns produced a slower velocity and higher spinning ball.

Keeping everything else constant, an increase in a ball's spin rate causes an increase in its lift. Increased lift caused by higher spin would be expected to translate into higher trajectory and greater dispersion than would be expected, e.g., at 200-500 rpm less total spin; however, the testing indicates that the 172-175 patterns have lower maximum trajectory heights than expected. Specifically, the testing revealed that the 172-175 series of balls achieve a max height of about 21 yards, while the Pro V1® is closer to 25 yards.

The data for each of golf balls with the 172-175 patterns indicated that total spin and max height was independent of orientation, which further indicates that the 172-175 series golf balls were spherically symmetrical.

Despite the higher spin rate of a golf ball with, e.g., pattern 173, it had a significantly lower maximum trajectory height (max height) than the Pro V M. Of course, higher velocity will result in a higher ball flight. Thus, one would expect the Pro V1® to achieve a higher max height, since it had a higher velocity. If a core/cover combination had been used for the 172-175 series of golf balls that produced velocities in the range of that achieved by the Pro V1®, then one would expect a higher max height. But the fact that the max height was so low for the 172-175 series of golf balls despite the higher total spin suggests that the 172-175 Vballs would still not achieve as high a max height as the Pro V1® even if the initial velocities for the 172-175 series of golf balls were 2-3 mph higher.

Figure 11:
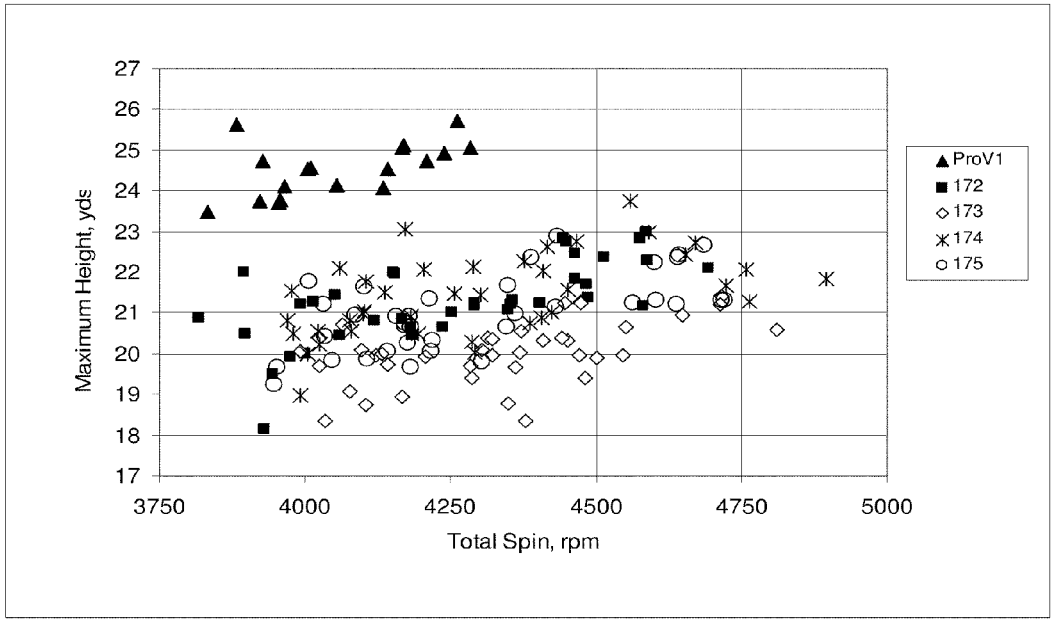
FIG. 11 is a graph illustrating the max height versus total spin for all of a 172-175 series golf balls, configured in accordance with certain embodiments, and the Pro V1® when hit with a driver imparting a slice on the golf balls.

FIG. 11 is a graph of the maximum trajectory height (Max Height) versus initial total spin rate for all of the 172-175 series golf balls and the Pro V1®. These balls were when hit with Golf Labs robot using a 10.5 degree Taylor Made r7 425 driver with a club head speed of approximately 90 mph imparting an approximately 20 degree spin axis slice. As can be seen, the 172-175 series of golf balls had max heights of between 18-24 yards over a range of initial total spin rates of between about 3700 rpm and 4100 rpm, while the Pro V1® had a max height of between about 23.5 and 26 yards over the same range.

The maximum trajectory height data correlates directly with the CL produced by each golf ball. These results indicate that the Pro V1® golf ball generated more lift than any of the 172-175 series balls. Further, some of balls with the 172-175 patterns climb more slowly to the maximum trajectory height during flight, indicating they have a slightly lower lift exerted over a longer time period. In operation, a golf ball with the 173 pattern exhibits lower maximum trajectory height than the leading comparison golf balls for the same spin, as the dimple profile of the dimples in the square and triangular regions of the cuboctahedral pattern on the surface of the golf ball cause the air layer to be manipulated differently during flight of the golf ball.

Despite having higher spin rates, the 172-175 series golf balls have Carry Dispersions that are on average less than that of the Pro V1® golf ball. The data in FIGS. 12-16 clearly shows that the 172-175 series golf balls have Carry Dispersions that are on average less than that of the Pro V1® golf ball. It should be noted that the 172-175 series of balls are spherically symmetrical and conform to the USGA Rules of Golf.

FIG. 12 is a graph illustrating the carry dispersion for the balls tested and shown in FIG. 11. As can be seen, the average carry dispersion for the 172-175 balls is between 50-60 ft, whereas it is over 60 feet for the Pro V1®.

FIG. 13-16 are graphs of the Carry Dispersion versus Total Spin rate for the 172-175 golf balls versus the Pro V1®. The graphs illustrate that for each of the balls with the 172-175 patterns and for a given spin rate, the balls with the 172-175 patterns have a lower Carry Dispersion than the Pro V1®. For example, for a given spin rate, a ball with the 173 pattern appears to have 10-12 ft lower carry dispersion than the Pro V1® golf ball. In fact, a 173 golf ball had the lowest dispersion performance on average of the 172-175 series of golf balls.

Figure 17:
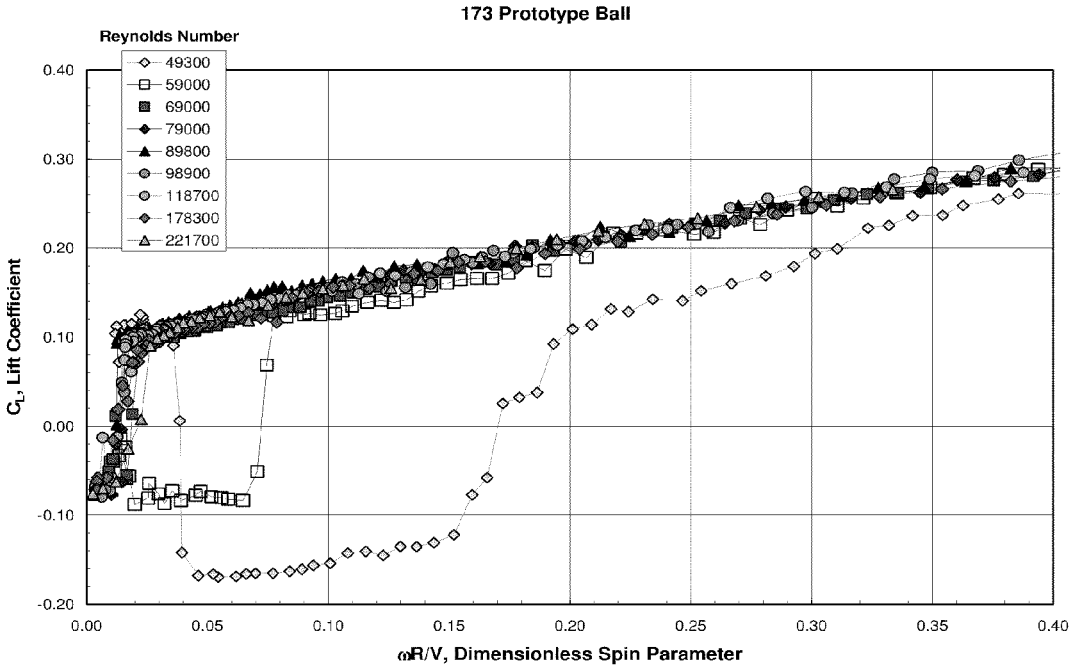
FIG. 17 is a graph of the wind tunnel testing results showing Lift Coefficient (CL) versus DSP for the 173 golf ball against different Reynolds Numbers.
Figure 18:
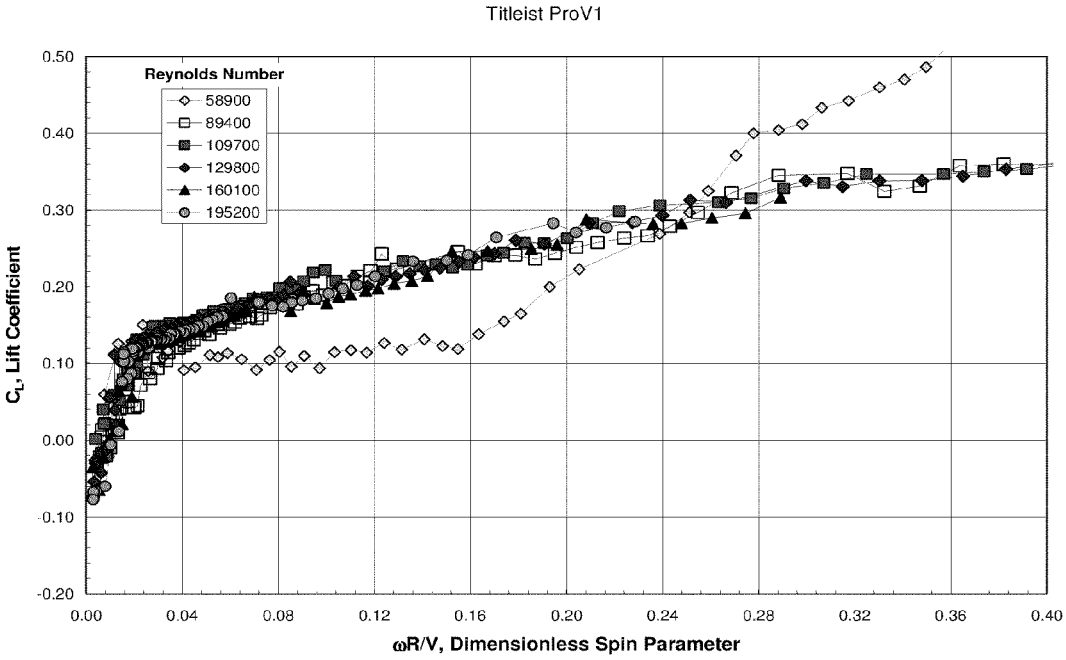
FIG. 18 is a graph of the wind tunnel test results showing the CL versus DSP for the Pro V1 golf ball against different Reynolds Numbers.

The overall performance of the 173 golf ball as compared to the Pro V1® golf ball is illustrated in FIGS. 17 and 18. The data in these figures shows that the 173 golf ball has lower lift than the Pro V1® golf ball over the same range of Dimensionless Spin Parameter (DSP) and Reynolds Numbers.

FIG. 17 is a graph of the wind tunnel testing results showing of the Lift Coefficient (CL) versus DSP for the 173 golf ball against different Reynolds Numbers. The DSP values are in the range of 0.0 to 0.4. The wind tunnel testing was performed using a spindle of $1/16^{th}$ inch in diameter.

FIG. 18 is a graph of the wind tunnel test results showing the CL versus DSP for the Pro V1 golf ball against different Reynolds Numbers.

In operation and as illustrated in FIGS. 17 and 18, for a DSP of 0.20 and a Re of greater than about 60,000, the CL for the 173 golf ball is approximately 0.19-0.21, whereas for the Pro V1® golf ball under the same DSP and Re conditions, the CL is about 0.25-0.27. On a percentage basis, the 173 golf ball is generating about 20-25% less lift than the Pro V1® golf ball. Also, as the Reynolds Number drops down to the 60,000 range, the difference in CL is pronounced—the Pro V1® golf ball lift remains positive while the 173 golf ball becomes negative. Over the entire range of DSP and Reynolds Numbers, the 173 golf ball has a lower lift coefficient at a given DSP and Reynolds pair than does the Pro V1® golf ball. Furthermore, the DSP for the 173 golf ball has to rise from 0.2 to more than 0.3 before CL is equal to that of CL for the Pro V1® golf ball. Therefore, the 173 golf ball performs better than the Pro V1® golf ball in terms of lift-induced dispersion (non-zero spin axis).

Therefore, it should be appreciated that the cuboctahedron dimple pattern on the 173 golf ball with large truncated dimples in the square sections and small spherical dimples in the triangular sections exhibits low lift for normal driver spin and velocity conditions. The lower lift of the 173 golf ball translates directly into lower dispersion and, thus, more accuracy for slice shots.

"Premium category" golf balls like the Pro V1® golf ball often use a three-piece construction to reduce the spin rate for driver shots so that the ball has a longer distance yet still has good spin from the short irons. The 173 dimple pattern can cause the golf ball to exhibit relatively low lift even at relatively high spin conditions. Using the low-lift dimple pattern of the 173 golf ball on a higher spinning two-piece ball results in a two-piece ball that performs nearly as well on short iron shots as the "premium category" golf balls currently being used.

The 173 golf ball's better distance-spin performance has important implications for ball design in that a ball with a higher spin off the driver will not sacrifice as much distance loss using a low-lift dimple pattern like that of the 173 golf ball. Thus the 173 dimple pattern or ones with similar low-lift can be used on higher spinning and less expensive two-piece golf balls that have higher spin off a PW but also have higher spin off a driver. A two-piece golf ball construction in general uses less expensive materials, is less expensive, and easier to manufacture. The same idea of using the 173 dimple pattern on a higher spinning golf ball can also be applied to a higher spinning one-piece golf ball.

Golf balls like the MC Lady and MaxFli Noodle use a soft core (approximately 50-70 PGA compression) and a soft cover (approximately 48-60 Shore D) to achieve a golf ball with fairly good driver distance and reasonable spin off the short irons. Placing a low-lift dimple pattern on these balls allows the core hardness to be raised while still keeping the cover hardness relatively low. A ball with this design has increased velocity, increased driver spin rate, and is easier to manufacture; the low-lift dimple pattern lessens several of the negative effects of the higher spin rate.

The 172-175 dimple patterns provide the advantage of a higher spin two-piece construction ball as well as being spherically symmetrical. Accordingly, the 172-175 series of golf balls perform essentially the same regardless of orientation.

In an alternate embodiment, a non-Conforming Distance Ball having a thermoplastic core and using the low-lift dimple pattern, e.g., the 173 pattern, can be provided. In this alternate embodiment golf ball, a core, e.g., made with DuPont™ Surlyn® HPF 2000 is used in a two- or multi-piece golf ball. The HPF 2000 gives a core with a very high COR and this directly translates into a very fast initial ball velocity—higher than allowed by the USGA regulations.

Figure 19:
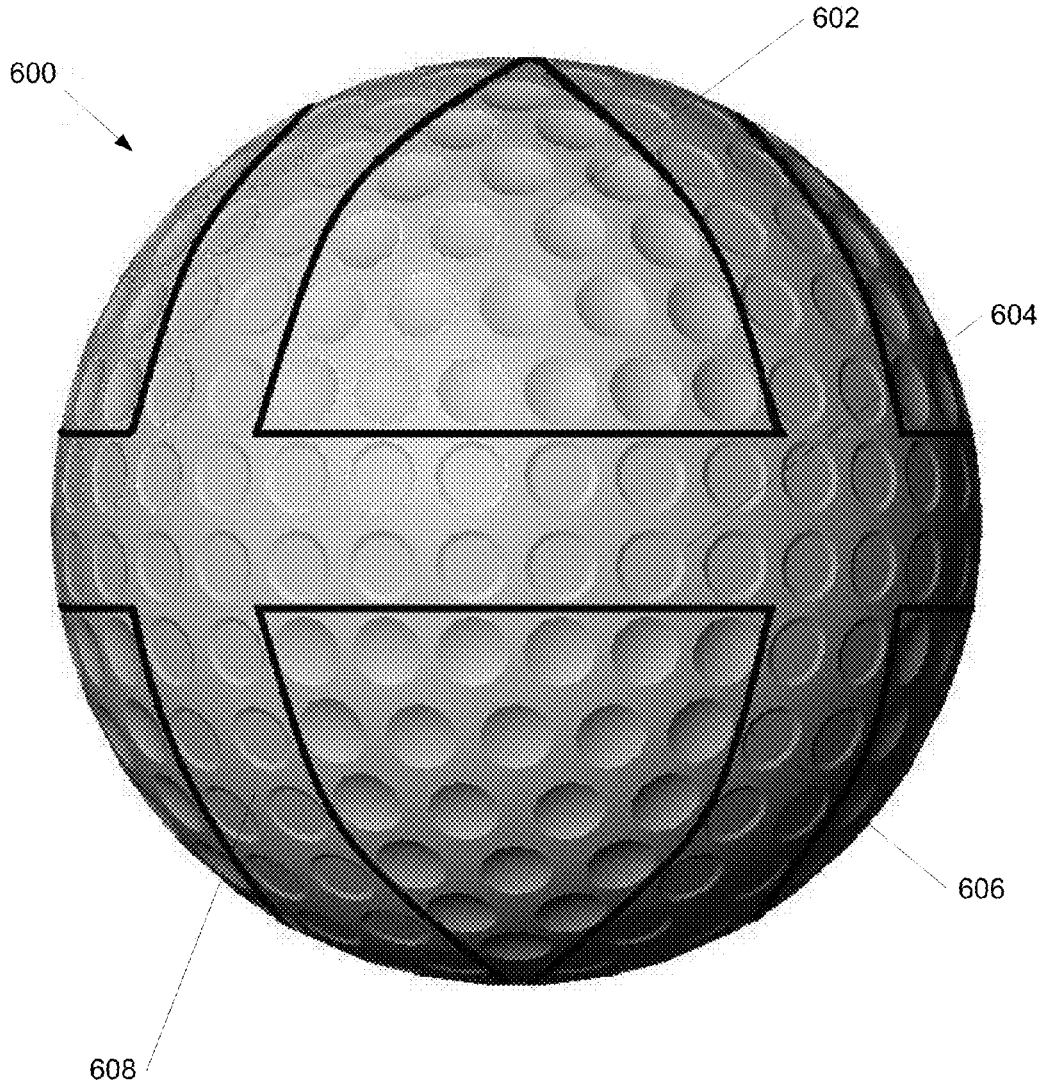
FIG. 19 is picture of a golf ball with a dimple pattern in accordance with another embodiment.
Figure 20:
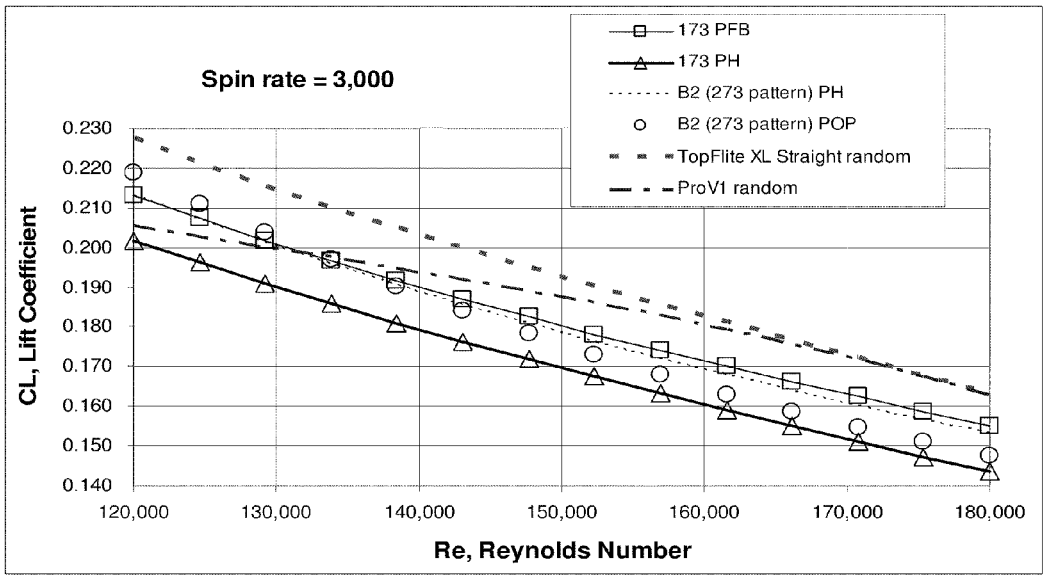
FIG. 20 is a graph of the lift coefficient versus Reynolds Number at 3,000 rpm spin rate for the TopFlite® XL Straight, Pro V1®, 173 dimple pattern and a 273 dimple pattern in accordance with certain embodiments.
Figure 21:
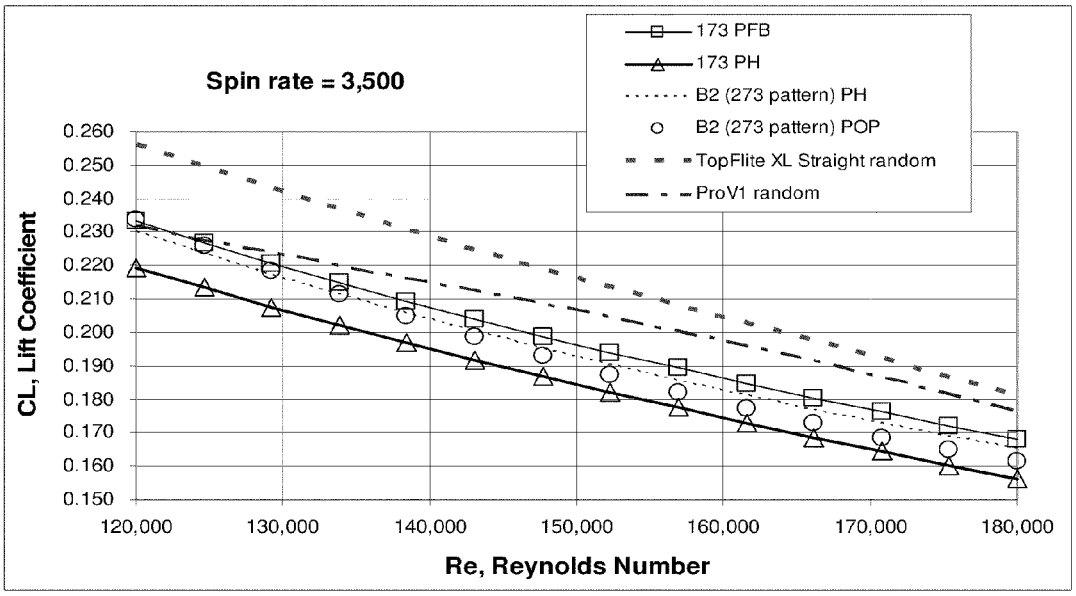
FIG. 21 is a graph of the lift coefficient versus Reynolds Number at 3,500 rpm spin rate for the TopFlite® XL Straight, Pro V1®, 173 dimple pattern and 273 dimple pattern.
Figure 22:
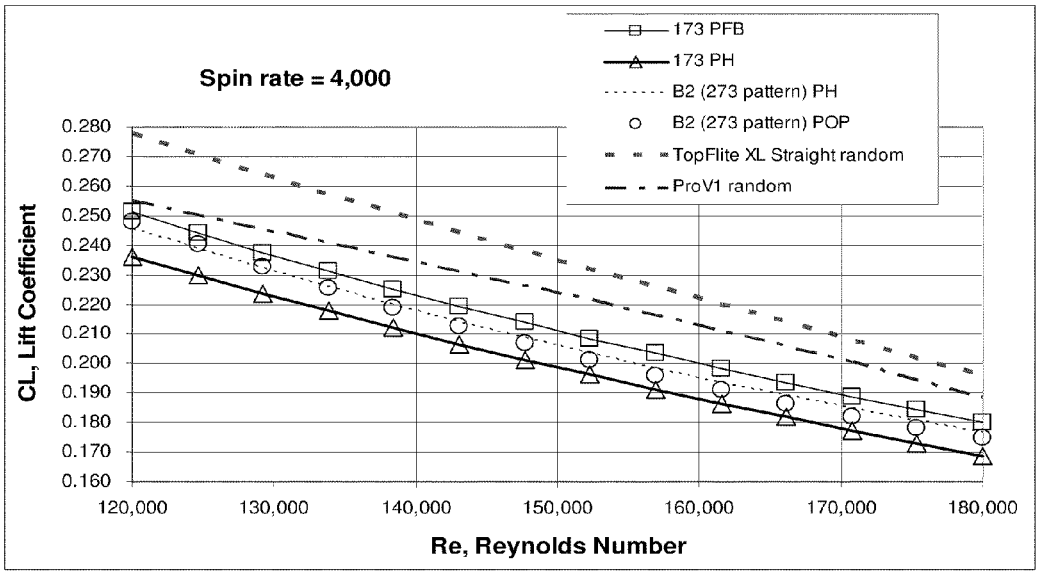
FIG. 22 is a graph of the lift coefficient versus Reynolds Number at 4,000 rpm spin rate for the TopFlite® XL Straight, Pro V1®, 173 dimple pattern and 273 dimple pattern.
Figure 23:
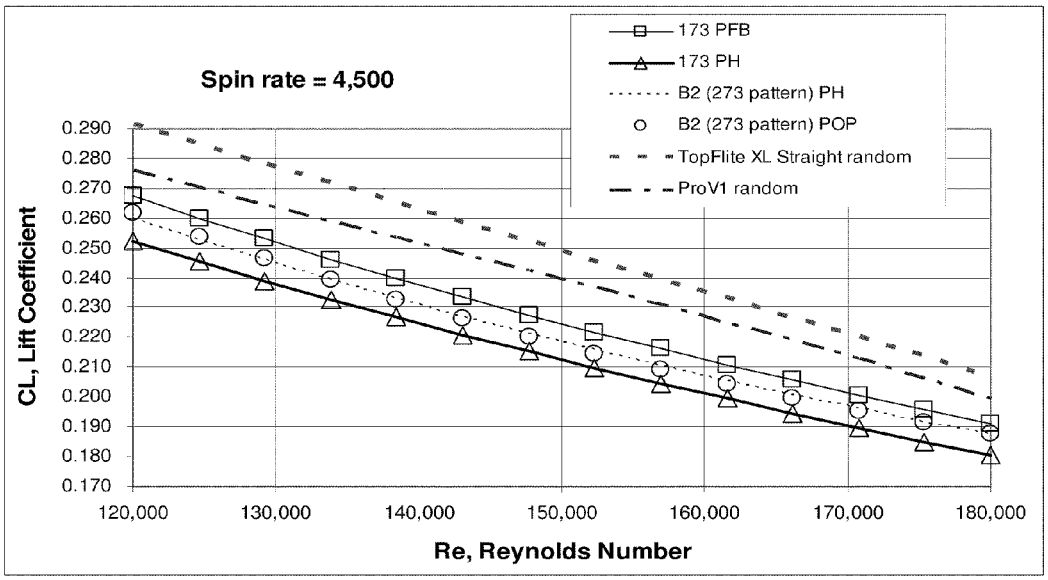
FIG. 23 is a graph of the lift coefficient versus Reynolds Number at 4,500 rpm spin rate for the TopFlite® XL Straight, Pro V1®, 173 dimple pattern and 273 dimple pattern.
Figure 24:
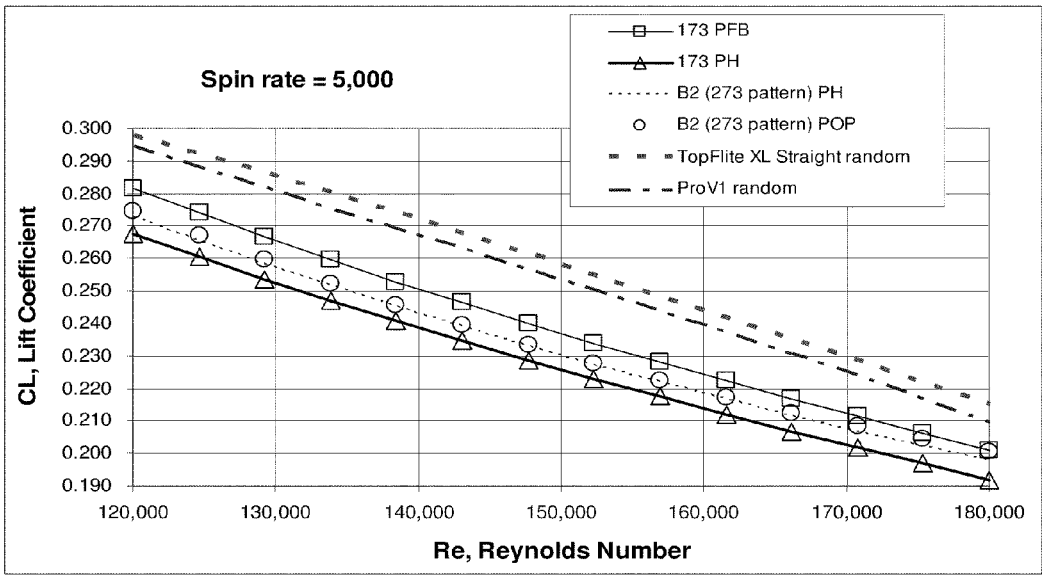
FIG. 24 is a graph of the lift coefficient versus Reynolds Number at 5,000 rpm spin rate for the TopFlite® XL Straight, Pro V1®, 173 dimple pattern and 273 dimple pattern.

In yet another embodiment, as shown in FIG. 19, golf ball 600 is provided having a spherically symmetrical low-lift pattern that has two types of regions with distinctly different dimples. As one non-limiting example of the dimple pattern used for golf ball 600, the surface of golf ball 600 is arranged in an octahedron pattern having eight symmetrical triangular shaped regions 602, which contain substantially the same types of dimples. The eight regions 602 are created by encircling golf ball 600 with three orthogonal great circles 604, 606 and 608 and the eight regions 602 are bordered by the intersecting great circles 604, 606 and 608. If dimples were placed on each side of the orthogonal great circles 604, 606 and 608, these "great circle dimples" would then define one type of dimple region two dimples wide and the other type region would be defined by the areas between the great circle dimples. Therefore, the dimple pattern in the octahedron design would have two distinct dimple areas created by placing one type of dimple in the great circle regions 604, 606 and 608 and a second type dimple in the eight regions 602 defined by the area between the great circles 604, 606 and 608.

As can be seen in FIG. 19, the dimples in the region defined by circles 604, 606, and 608 can be truncated dimples, while the dimples in the triangular regions 602 can be spherical dimples. In other embodiments, the dimple type can be reversed. Further, the radius of the dimples in the two regions can be substantially similar or can vary relative to each other.

Figure 25:
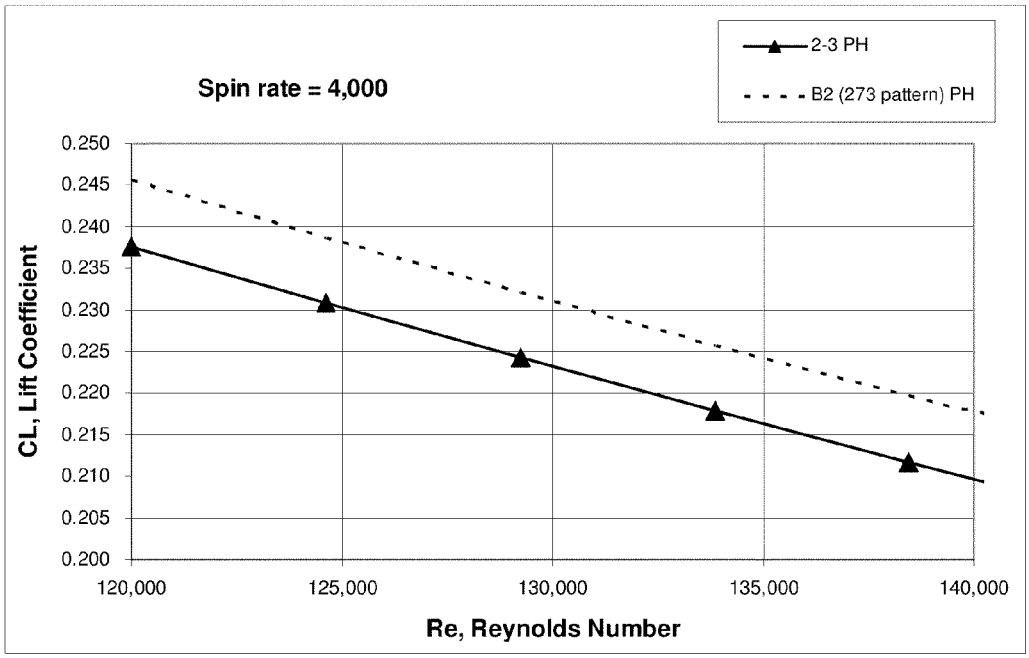
FIG. 25 is a graph of the lift coefficient versus Reynolds Number at 4000 RPM initial spin rate for the 273 dimple pattern and 2-3 dimple pattern balls of Tables 10 and 11.
Figure 26:
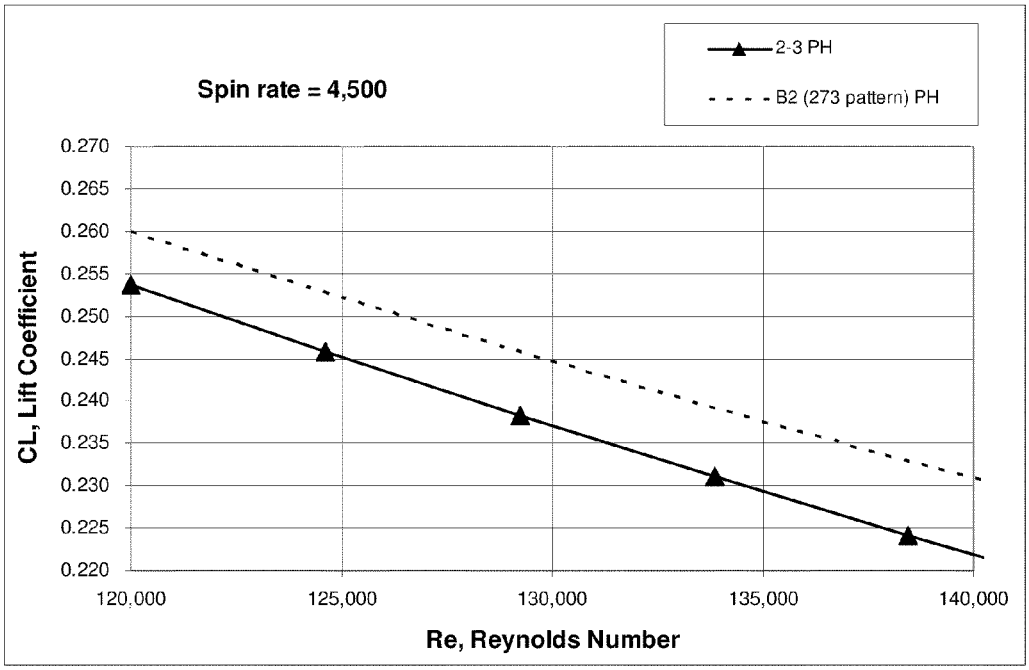
FIG. 26 is a graph of the lift coefficient versus Reynolds Number at 4500 RPM initial spin rate for the 273 dimple pattern and 2-3 dimple pattern balls of Tables 10 and 11.
Figure 27:
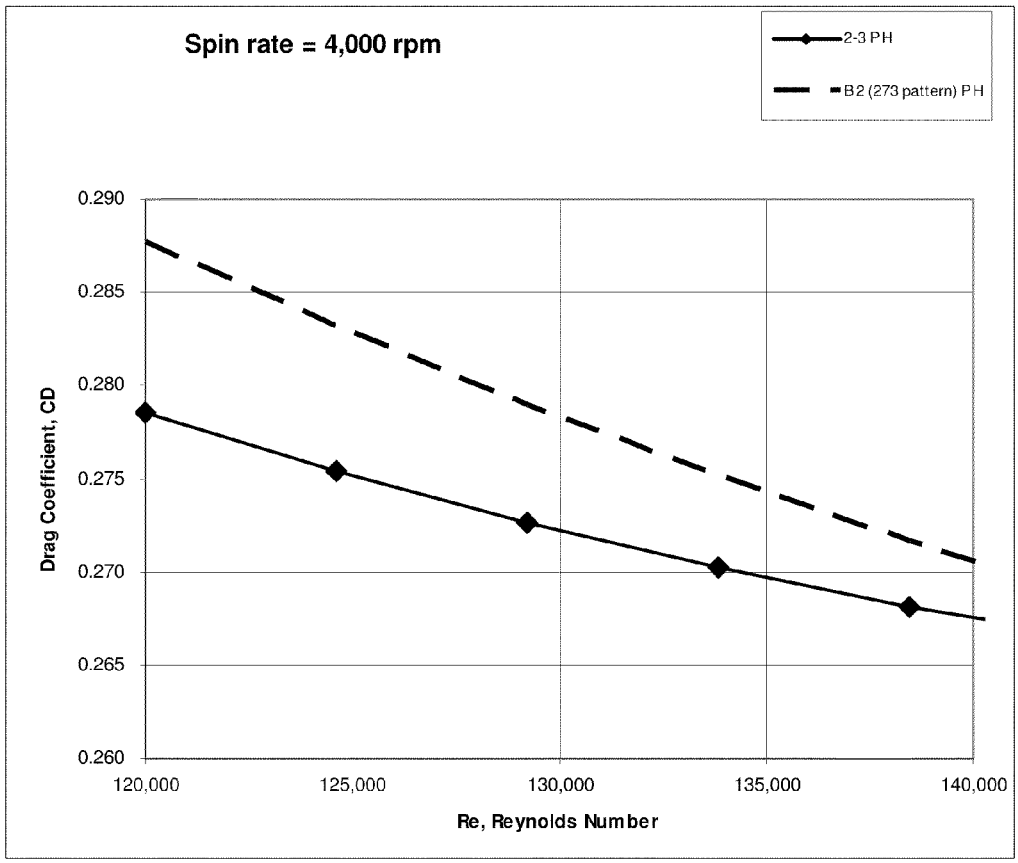
FIG. 27 is a graph of the drag coefficient versus Reynolds Number at 4000 RPM initial spin rate for the 273 dimple pattern and 2-3 dimple pattern balls of Tables 10 and 11.
Figure 28:
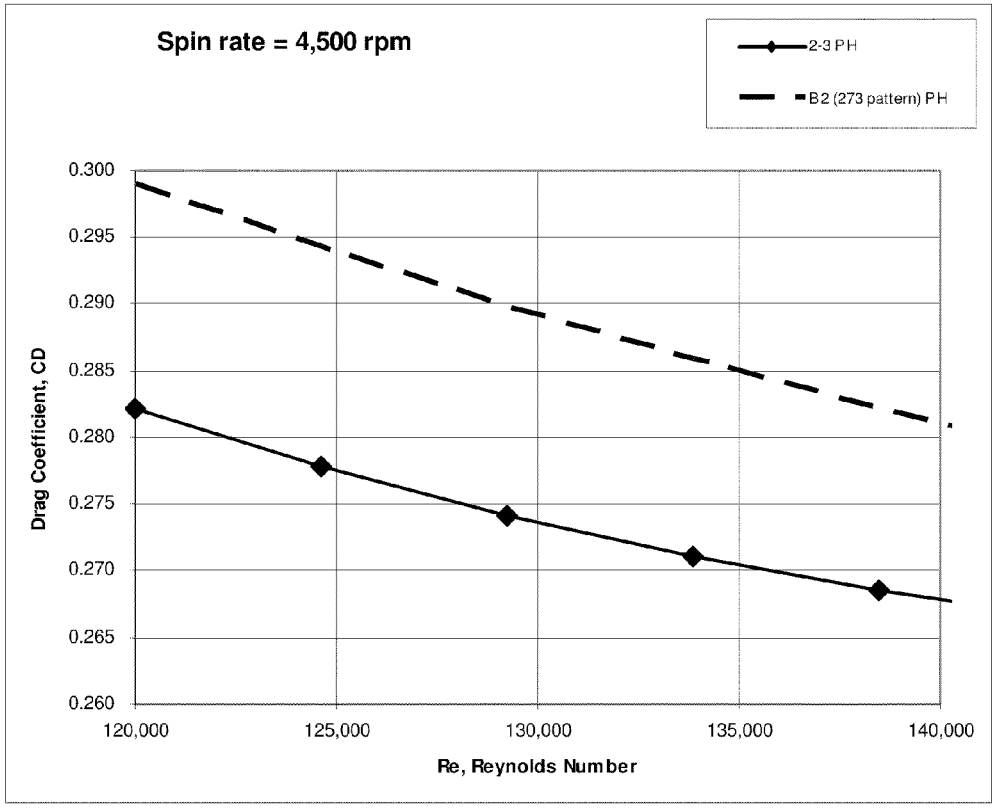
FIG. 28 is a graph of the drag coefficient versus Reynolds Number at 4500 RPM initial spin rate for the 273 dimple pattern and 2-3 dimple pattern balls of Tables 10 and 11.

FIGS. 25 and 26 are graphs which were generated for balls 273 and 2-3 in a similar manner to the graphs illustrated in FIGS. 20 to 24 for some known balls and the 173 and 273 balls. FIGS. 25 and 26 show the lift coefficient versus Reynolds Number at initial spin rates of 4,000 rpm and 4,500 rpm, respectively, for the 273 and 2-3 dimple pattern. FIGS. 27 and 28 are graphs illustrating the drag coefficient versus Reynolds number at initial spin rates of 4000 rpm and 4500 rpm, respectively, for the 273 and 2-3 dimple pattern. FIGS. 25 to 28 compare the lift and drag performance of the 273 and 2-3 dimple patterns over a range of 120,000 to 140,000 Re and for 4000 and 4500 rpm. This illustrates that balls with dimple pattern 2-3 perform better than balls with dimple pattern 273. Balls with dimple pattern 2-3 were found to have the lowest lift and drag of all the ball designs which were tested.

While certain embodiments have been described above, it will be understood that the embodiments described are by way of example only. Accordingly, the systems and methods described herein should not be limited based on the described embodiments. Rather, the systems and methods described herein should only be limited in light of the claims that follow when taken in conjunction with the above description and accompanying drawings.

What is claimed is:

1. A golf ball having a plurality of dimples formed on its outer surface, the outer surface of the golf ball being divided into plural areas comprising at least first areas containing a plurality of first dimples and second areas containing a plurality of second dimples, the areas together forming a spherical polyhedron shape, the first dimples comprising truncated spherical dimples having a first, truncated chord depth and the second dimples comprising spherical dimples having a second, spherical chord depth, the first dimples are of larger radius than the second dimples and have a truncated chord depth which is less than the spherical chord depth of the second dimples, and the total surface area of all first areas being less than the total surface area of all second areas.

2. The golf ball of claim 1, wherein each truncated spherical dimple has a flat inner end.

3. The golf ball of claim 1, wherein each spherical dimple has a part-spherical surface contour and each truncated dimple is part spherical with a flat inner end.

4. The golf ball of claim 3, wherein the shape of the areas is selected from the group consisting of triangles, squares, and pentagons.

5. The golf ball of claim 1, wherein the first and second areas are of different shapes.

6. The golf ball of claim 5, wherein the shapes comprise two different shapes selected from the group consisting of triangles, squares, pentagons, hexagons, octagons, and decagons.

7. The golf ball of claim 6, wherein the first areas are triangles and the second areas are squares.

8. The golf ball of claim 7, wherein the areas together form a substantially cuboctahedral shape.

9. The golf ball of claim 1, further comprising a third area containing a plurality of third dimples.

10. The golf ball of claim 9, wherein the first, second and third areas are of three different shapes.

11. The golf ball of claim 10, wherein the shapes comprise three different shapes selected from the group consisting of triangles, squares, pentagons, hexagons, octagons and decagons.

12. The golf ball of claim 1, wherein each first area contains at dimples of at least two different sizes.

13. The golf ball of claim 1, wherein the first dimples being of different dimensions from the second dimples such that the first and second areas are visually contrasting.

14. The golf ball of claim 1, wherein the first and second areas produce different aerodynamic effects.

15. The golf ball of claim 1, wherein some of the dimples are formed from a lattice structure.

16. The golf ball of claim 1, wherein the average volume per dimple is greater in one of the groups of areas relative to the other.

17. The golf ball of claim 1, wherein the unit volume in one area is greater than in the other area, and wherein unit volume is defined as the volume of the dimples in the area divided by the surface area in that area.

18. The golf ball of claim 1, wherein the unit volume in one area is at least 5% greater than in the other area, and wherein unit volume is defined as the volume of the dimples in the area divided by the surface area in that area.

19. The golf ball of claim 1, wherein the unit volume in one area is at least 15% greater than in the other area, and wherein unit volume is defined as the volume of the dimples in the area divided by the surface area in that area.

20. The golf ball of claim 1, wherein the first group of areas is formed by adding a portion of the second group of areas to the first group of areas or vice versa.

* * * * *